US009770804B2

(12) United States Patent
Byers et al.

(10) Patent No.: US 9,770,804 B2
(45) Date of Patent: Sep. 26, 2017

(54) SLURRY SUPPLY AND/OR CHEMICAL BLEND SUPPLY APPARATUSES, PROCESSES, METHODS OF USE AND METHODS OF MANUFACTURE

(71) Applicant: AIR PRODUCTS AND CHEMICALS, INC., Allentown, PA (US)

(72) Inventors: Gary Allen Byers, Sandia Park, NM (US); Bela Derecskei, Fountain Hill, AZ (US); Benjamin Patrick Bayer, Albuquerque, NM (US)

(73) Assignee: VERSUM MATERIALS US, LLC, Allentown, PA (US)

( * ) Notice: Subject to any disclaimer, the term of this patent is extended or adjusted under 35 U.S.C. 154(b) by 0 days.

(21) Appl. No.: 14/218,578

(22) Filed: Mar. 18, 2014

(65) Prior Publication Data

US 2014/0261824 A1 Sep. 18, 2014

Related U.S. Application Data

(63) Continuation-in-part of application No. PCT/US2013/069868, filed on Nov. 13, 2013.

(60) Provisional application No. 61/899,560, filed on Nov. 4, 2013, provisional application No. 61/861,739, filed on Aug. 2, 2013, provisional application No. 61/802,950, filed on Mar. 18, 2013.

(51) Int. Cl.
*B24B 57/00* (2006.01)
*B24B 57/02* (2006.01)

(52) U.S. Cl.
CPC ..... *B24B 57/02* (2013.01); *Y10T 137/87652* (2015.04)

(58) Field of Classification Search
CPC B28C 5/365; B22C 5/08; B24B 57/02; Y10T 137/87652
USPC ..... 366/16, 17, 140, 8
See application file for complete search history.

(56) References Cited

U.S. PATENT DOCUMENTS

| | | | |
|---|---|---|---|
| 3,166,020 | A | 1/1965 | Cook |
| 3,946,994 | A | 3/1976 | Mertz et al. |
| 4,045,004 | A | 8/1977 | Berger |
| 4,538,222 | A | 8/1985 | Crain et al. |
| 5,098,843 | A | 3/1992 | Johnson et al. |
| 5,148,945 | A | 9/1992 | Geatz |
| 5,330,072 | A | 7/1994 | Ferri, Jr. et al. |
| 5,370,269 | A | 12/1994 | Bernosky et al. |
| 5,407,526 | A | 4/1995 | Cadien et al. |
| 5,417,346 | A | 5/1995 | Ferri, Jr. et al. |

(Continued)

FOREIGN PATENT DOCUMENTS

| | | |
|---|---|---|
| DE | 12 75 512 B | 8/1968 |
| EP | 2 336 093 A1 | 6/2011 |

(Continued)

*Primary Examiner* — Tony G Soohoo
*Assistant Examiner* — Anshu Bhatia
(74) *Attorney, Agent, or Firm* — Anne B. Kiernan

(57) ABSTRACT

A slurry and/or chemical blend supply apparatus suitable for providing slurry and/or chemical blend to chemical mechanical planarization (CMP) tools or other tools in a semiconductor fabrication facility, related processes, methods of use and methods of manufacture. The slurry and/or chemical blend supply apparatus includes one or more of the following: feed module, blend module, analytical module and distribution module.

22 Claims, 21 Drawing Sheets

(56) References Cited

U.S. PATENT DOCUMENTS 5,490,611 A 2/1996 Bernosky et al.
5,750,440 A 5/1998 Vanell et al.
5,803,599 A 9/1998 Ferri, Jr. et al.
5,887,974 A 3/1999 Pozniak et al.
5,928,492 A 7/1999 Corlett et al.
5,957,759 A 9/1999 Cardenas et al.
6,019,250 A 2/2000 Poznak et al.
6,027,240 A 2/2000 Han
6,048,256 A 4/2000 Schultz et al.
6,059,920 A 5/2000 Kawashima et al.
6,076,541 A 6/2000 Trang et al.
6,096,185 A 8/2000 Corlett et al.
6,123,602 A 9/2000 Stetzler et al.
6,125,876 A 10/2000 Laederich et al.
6,132,078 A 10/2000 Lin
6,165,048 A 12/2000 Thomas et al.
6,168,048 B1 1/2001 Xu et al.
6,183,352 B1 2/2001 Kurisawa
6,200,414 B1 3/2001 Yun et al.
6,224,252 B1 5/2001 Munroe et al.
6,244,929 B1 6/2001 Thomas et al.
6,257,965 B1 7/2001 Satou et al.
6,269,975 B2 8/2001 Soberanis et al.
6,280,300 B1 8/2001 Komatsu
6,293,849 B1 9/2001 Kawashima
6,306,020 B1 10/2001 Fuchs et al.
6,319,099 B1 11/2001 Hashimoto et al.
6,338,670 B1 1/2002 Okumura et al.
6,338,671 B1 1/2002 Kawashima et al.
6,340,098 B2 1/2002 Soberanis et al.
6,358,125 B2 3/2002 Chono et al.
6,379,538 B1 4/2002 Geatz et al.
6,406,364 B1 6/2002 Hiyama et al.
6,457,852 B1 10/2002 Hiraide et al.
6,482,325 B1 11/2002 Geatz et al.
6,544,109 B1 4/2003 Moore et al.
6,547,646 B2 4/2003 Wells et al.
6,554,467 B2 4/2003 Snyder et al.
6,565,422 B1 5/2003 Sakuma et al.
6,572,255 B2 6/2003 Husher
6,585,560 B2 7/2003 Hashimoto et al.
6,585,570 B2 7/2003 Hah et al.
6,589,099 B2 7/2003 Haggart et al.
6,604,849 B2 8/2003 Tsai et al.
6,616,014 B1 9/2003 Roberts et al.
6,632,012 B2 10/2003 Vogtmann et al.
6,659,634 B2 12/2003 Hiraoka et al.
6,659,848 B1 12/2003 Gautreau et al.
6,675,987 B2 1/2004 Johnson et al.
6,679,764 B2 1/2004 Schwortschik et al.
6,702,655 B2 3/2004 Chen et al.
6,721,628 B1 4/2004 Lai et al.
6,732,017 B2 5/2004 Nguyen et al.
6,767,124 B2 7/2004 Kawasaki et al.
6,769,960 B2 8/2004 Sakai
6,790,127 B2 9/2004 Hashimoto et al.
6,796,703 B2 9/2004 Lemke
6,802,762 B2 10/2004 Tanaka et al.
6,860,723 B2 3/2005 Chen et al.
6,866,784 B2 3/2005 Park et al.
6,874,929 B2 4/2005 Hiraoka
6,880,727 B2 4/2005 Roberts et al.
6,884,145 B2 4/2005 Ali et al.
6,910,954 B2 6/2005 Ahn Seng Hoon et al.
6,921,193 B2 7/2005 Fukui
6,923,568 B2 8/2005 Lull et al.
6,955,764 B2 10/2005 Kobayashi
7,007,822 B2 3/2006 Johnson et al.
7,025,493 B2 4/2006 Hwang et al.
7,052,377 B2 5/2006 Hashimoto et al.
7,054,719 B2 5/2006 Nguyen et al.
7,086,933 B2 8/2006 Downum et al.
7,144,552 B1 12/2006 Fukuizumi et al.
7,166,018 B2 1/2007 Hashimoto et al.
7,183,117 B2 2/2007 Osuda et al.
7,204,679 B2 4/2007 Wheeler et al.
7,208,417 B2 4/2007 Hiraoka
7,232,360 B2 6/2007 Gadd et al.
7,249,995 B2 7/2007 Hashimoto et al.
7,281,840 B2 10/2007 Anderson et al.
7,314,402 B2 1/2008 Laursen et al.
7,331,844 B2 2/2008 Hashimoto et al.
7,338,352 B2 3/2008 Hong et al.
7,344,298 B2 3/2008 Mcallister et al.
7,363,114 B2 4/2008 Anderson et al.
7,363,115 B2 4/2008 Anderson et al.
7,419,419 B2 9/2008 Moon
7,419,946 B2 9/2008 Hiraoka et al.
7,465,221 B2 12/2008 Hayashide et al.
7,538,880 B2 5/2009 Crum et al.
7,557,041 B2 7/2009 Hiraoka
7,661,871 B2 2/2010 Hyatt et al.
7,695,589 B2 4/2010 Stark et al.
7,726,870 B1 6/2010 Lott
7,810,516 B2 10/2010 Gerken et al.
7,863,195 B2 1/2011 Hiraoka et al.
7,887,396 B2 2/2011 Laursen et al.
7,890,213 B2 2/2011 Benatti et al.
7,905,653 B2 3/2011 Lull et al.
8,087,817 B2 1/2012 Zhong et al.
8,113,236 B2 2/2012 Kandiyeli et al.
RE43,288 E 4/2012 Barger et al.
8,282,084 B2 10/2012 Nichols et al.
2001/0037821 A1 11/2001 Bogush et al.
2002/0034122 A1 3/2002 Lemke
2003/0031086 A1 2/2003 Shikami
2003/0185690 A1 10/2003 Chang et al.
2003/0211743 A1 11/2003 Chang et al.
2003/0225167 A1 12/2003 Nunez et al.
2004/0049301 A1 3/2004 Kawasaki
2004/0190367 A1 9/2004 Wierzbicki et al.
2005/0107016 A1 5/2005 Hoshino
2006/0196541 A1 9/2006 Gerken et al.
2006/0246821 A1 11/2006 Downum et al.
2007/0042687 A1 2/2007 Petitdidier et al.
2007/0204913 A1 9/2007 Hanada et al.
2007/0205214 A1 9/2007 Roberts
2007/0221615 A1 9/2007 Isobe et al.
2008/0160568 A1 7/2008 Allen
2008/0172141 A1 7/2008 Anderson et al.
2008/0295871 A1 12/2008 Miki et al.
2009/0037028 A1 2/2009 Garcia
2009/0205821 A1 8/2009 Smith
2009/0212071 A1 8/2009 Tom et al.
2009/0298393 A1 12/2009 Kozasa
2010/0128555 A1 5/2010 Hughes
2010/0130101 A1 5/2010 Chang Kuo Lih
2010/0157720 A1 6/2010 Woodmansee et al.
2010/0224256 A1 9/2010 Tseng et al.
2010/0246312 A1* 9/2010 Welker et al. ..... 366/4
2010/0258196 A1 10/2010 Melcer et al.
2011/0008964 A1 1/2011 Hughes et al.
2011/0030815 A1 2/2011 Hanada et al.
2011/0269381 A1 11/2011 Groschopf et al.
2011/0315228 A1 12/2011 Yokota
2012/0042575 A1 2/2012 Amoroso et al.
2012/0111413 A1 5/2012 Kandiyeli et al.

FOREIGN PATENT DOCUMENTS

GB 798 983 A 7/1968
WO 9323791 11/1993

* cited by examiner

SLURRY SUPPLY AND/OR CHEMICAL BLEND SUPPLY APPARATUSES, PROCESSES, METHODS OF USE AND METHODS OF MANUFACTURE

RELATED PATENTS

This patent application claims the benefit of PCT Patent Application Ser. No. PCT/US13/69868, filed Nov. 13, 2013, U.S. Patent Application Ser. No. 61/899,560, filed Nov. 4, 2013, U.S. Provisional Application Ser. No. 61/861,739, filed Aug. 2, 2013, U.S. Provisional Application Ser. No. 61/802,950, filed Mar. 18, 2013, all having the similar title "Slurry Supply and/or Chemical Blend Supply Apparatuses, Methods of Use and Methods of Manufacture", the contents of each of which are hereby incorporated by reference as if fully set forth.

BACKGROUND OF THE INVENTION

Modern semiconductor electronic devices such as integrated circuit chips are formed by building multiple stacked layers of materials and components on a semiconductor substrate. The semiconductor devices typically incorporate numerous electrically active components which are formed on the substrate. Metal conductor interconnects, which may be made of copper in some embodiments, are formed by various additive patterning and deposition processes such as damascene and dual damascene to electrically couple the active components together by means of circuit paths or traces formed within one or more layers of dielectric material. Modern semiconductor fabrication entails a repetitive sequence of process steps including material deposition (conductive and non-conductive dielectric materials), photolithographic patterning of circuits in the dielectric material, and material removal such as etching and ashing which gradually build the stacked semiconductor device structures.

Chemical-mechanical polishing or planarization ("CMP") is a technique used in semiconductor fabrication for planarization of the layers formed on the substrate in order to provide a uniform surface profile or topography upon which successive layers of materials may be built. As well known to those skilled in the art, CMP basically entails use of a polishing apparatus that is supplied with an abrasive chemical slurry which may contain an abrasive such as colloidal silicon dioxide or alumina, deionized water, and chemical solvents or oxidants such as hydrogen peroxide, potassium or ammonium hydroxide. The slurry is typically pumped under pressure to the CMP station by a slurry supply system and applied directly onto the surface of the semiconductor wafer. The slurry is then worked into the wafer surface by a rotating polisher pad or head to polish/plane the surface.

Slurries used for chemical-mechanical planarization may be divided into three categories including silicon planarization slurries, dielectric polish slurries and metals polish slurries. A silicon polish slurry is designed to polish and planarize poly silicon layers. The silicon polish slurry can include a proportion of particles in a slurry typically with a range from 1-15 percent by weight. An oxide polish slurry may be utilized for polishing and planarization of a dielectric layer formed upon a semiconductor wafer. Oxide polish slurries typically have a proportion of particles in the slurry within a range of 1-15 percent by weight. Conductive layers upon a semiconductor wafer may be polished and planarized using chemical-mechanical polishing and a metals polish slurry. A proportion of particles in a metals polish slurry may be within a range of 1-5 percent by weight.

Many slurry compositions are blended slurries that comprise a mixture of raw or concentrated slurry comprising slurry particles, water and at least one chemical component. Examples of raw slurries (that may also be referred to as concentrated slurries), include fumed and colloidal silica, alumina, and ceria. Examples of chemical components that may be used in CMP slurries include acids, bases, surfactants, and oxidizers or mixtures thereof. Many of the blended slurries which comprises raw slurry and/or water and/or one or more chemical components do not have a long shelf life and once they are combined may begin to deteriorate within a few hours if not used; therefore, necessitating the combination of the components of a blended slurry near the tool and once combined, the use of the blended slurry in less than 24 or fewer hours.

A slurry is a colloid, a suspension of particles in liquid. The suspension of the particles in a liquid can be detrimentally impacted by the components added to a raw slurry, particularly the chemical components and the manner and order of the additions of the components making up a blended slurry. The slurry must also be kept in motion to keep the particles dispersed in the liquid. Also, since the slurry deteriorates with time, it is important to check its characteristics and adjust them if necessary.

Additionally, the semiconductor and other industries require chemical blends for cleaning and surface preparation that do not contain slurry particles, but require blending a short time prior to use and movement of the chemical blend to mix and optionally keep the chemical blend homogeneous.

Electronic fabs continue to increase in size and output of semiconductor components. Apparatuses that can supply relatively large amounts and/or consistently blended slurries and/or chemical blends are needed.

BRIEF SUMMARY OF THE INVENTION

The inventors have designed apparatuses, methods, and processes of manufacturing the apparatus, and for blending and delivering slurries and/or chemical blends to CMP tools, and other parts of the semiconductor fabrication or other factory, the apparatuses and the methods provide one or more of the following benefits: consistently providing the same slurry and/or chemical blend blend(s), carefully blending the components of the slurry and/or chemical blend to avoid the negative impact to the slurry suspension and/or chemical blend as a result of the combination of the components of a blended slurry and/or chemical blend, providing the same slurry and/or chemical blend to a large number of CMP tools and/or other tools with the capability to quickly respond to demand for additional slurry and/or chemical blend, the ability to check (monitor) certain characteristics of the slurry and/or chemical blend in-line, and keeping the slurry and/or chemical blend (for examples, blended slurry and/or chemical blend and/or raw slurry and/or chemical blend and/or partially blended slurry and/or chemical blend) in motion to keep the slurry and/or chemical blend particles dispersed in the liquid. In some embodiments, this apparatus is not for point of use blending, that is, blending adjacent to the tool for supply to that tool or a limited number of tools, for example, two or three tools.

In one embodiment of this invention the slurry and/or chemical blend supply apparatus of this invention comprises at least one of a feed module and/or blend module and/or analytical module and/or distribution module alone or in any combination or aspects of the feed module and/or blend module and/or analytical module and/or distribution module alone or in any combination and/or in combination with other aspects of this invention as disclosed and described herein. For example, the slurry and/or chemical blend supply apparatus of this invention may comprise a blend module and a distribution module, or feed module, blend module and distribution module, or an analytical module and a blend module, or a feed and an analytical module, etc.

This invention further provides a slurry and/or chemical blend supply apparatus comprising alone or in combination with any other aspects or embodiments of this invention disclosed anywhere herein, a feed module. A slurry and/or chemical blend supply apparatus may comprise a feed module, said feed module comprising at least one pump and at least one feed tank for holding raw slurry. The apparatus and/or the feed module of the slurry and/or chemical blend supply apparatus may comprise or further comprise at least one circulation loop connected to the at least one tank, that may be selected from the group consisting of a feed tank and a distribution tank, for circulating the raw slurry in the tank. A slurry and/or chemical blend supply apparatus may comprise or may further comprise a circulation loop connected to a tank, that may be the feed tank or the distribution tank, said circulation loop may comprise a pump connected to a pipe at or near the bottom of the tank and a return pipe that returns the slurry to the tank. A slurry and/or chemical blend supply apparatus may comprise a circulation loop, further comprising a back pressure controller and/or a flow sensor (that may be used to regulate the speed of the pump) and/or a pressure sensor that may be used to regulate a valve in the back pressure controller and may be connected to any tank in the slurry and/or chemical blend supply apparatus. Any of the slurry and/or chemical blend supply apparatuses having a circulation loop connected to a feed tank may further comprise at least one pipe that may be connected to the circulation loop that transfers slurry to a blend module from the feed tank via the circulation loop, preferably a portion of said slurry from said circulation loop. Another aspect or embodiment of any feed module of a slurry and/or chemical blend supply apparatus of this invention is that it may comprise at least one or two or more pumps. Another aspect or embodiment of any feed module of a slurry and/or chemical blend supply apparatus of this invention is that the at least one pump may comprise at least one raw slurry pump (a first pump) that pumps raw slurry from one or more slurry supply containers and transfers the slurry to the at least one feed tank, and/or the at least one pump may comprise (and it may be a second pump) at least one pump that circulates raw slurry preferably continuously in a circulation loop and/or supplies raw slurry to the blend module that may be provided as needed to (that is, on demand from) the blend module.

A slurry and/or chemical blend supply apparatus is provided by this invention, that may be in combination with any one or more of the aspects or embodiments described herein, comprising a feed module that further comprises an in-line liquid particle counter and/or particle size distribution analyzer that draws slurry and/or chemical blend samples from at least one or more locations in the feed module for analysis. A slurry and/or chemical blend supply apparatus of this invention is provided comprising at least one filter element that may be a filter loop comprising piping, at least one filter element and a pump in the loop. This invention further provides at least one filter or filter loop (connected to the piping) in the feed module and/or blend module and/or analytical module and/or distribution module. A slurry and/or chemical blend supply apparatus of this invention may comprise an optional feed module in combination with any of the other described embodiments of the slurry and/or chemical blend supply apparatus of this invention, including the optional blend module and/or analytical module and/or distribution module and/or other aspects, such as the eductors present in tanks in those one or more optional feed, and/or blend and/or distribution modules, and/or strainers, filters, filter loops, dilution fixtures, restricted orifice to redirect flow, split mixers, etc. connected to or in the pipes of those one or more modules.

This invention further provides a slurry and/or chemical blend supply apparatus comprising alone or in combination with any one or more other aspects or embodiments of this invention disclosed herein an analytical module. The slurry and/or chemical blend supply apparatus may comprise an analytical module, said analytical module comprising one or more analytical apparatuses that may be selected from the group consisting of liquid particle counter, particle size distribution analyzer, pH sensor, hydrogen peroxide sensor, density sensor and conductivity sensor, alone or in combination with a feed module and/or a blend module and/or a distribution module or one or more other aspects of the invention described herein, for examples, one or more strainers, filters, filter loops, dilution fixtures, restricted orifices to redirect flow, split mixers, etc. This invention provides a slurry and/or chemical blend supply apparatus of the invention (that may be in combination with any one or more other aspects or embodiments of this invention) comprising an (in-line) analytical module, said analytical module comprising two or more of at least one type of analytical apparatus selected from the group consisting of liquid particle counter, particle size distribution analyzer, pH sensor, hydrogen peroxide sensor, density sensor and conductivity sensor, preferably the analytical module comprises at least two pH sensors. A slurry and/or chemical blend supply apparatus alone or in combination with any other aspect or embodiment may comprise one or more analytical modules, wherein at least one of said analytical modules further comprises in-line single dilution equipment (means) and/or in-line double dilution equipment (means) for performing a single and/or double dilution (respectively) of a slurry and/or chemical blend sample, said in-line dilution equipment being located upstream of at least one analytical apparatus in said at least one analytical module. A slurry and/or chemical blend supply apparatus, alone or in combination with any other one or more aspects or embodiments of the invention, comprising an analytical module further comprising at least one peristaltic pump, at least one flow sensor and at least one needle valve that may be used to dilute the slurry and/or chemical blend sample prior to analyzing the diluted sample, optionally further comprising a dilution fixture. This invention further provides a slurry and/or chemical blend supply apparatus alone or in combination with any other one or more aspects or embodiments of the invention, comprising an analytical module wherein said analytical module comprises more than one flow sensor, more than one needle valve and more than one pneumatically controlled valve, optionally further comprising more than one dilution fixture that may be used to dilute the slurry and/or chemical blend sample prior to analyzing the diluted sample. This invention further provides a slurry and/or chemical blend supply apparatus wherein said analytical module may comprise at least one dilution fixture, alone or with one or more modules or other aspects or embodiments of the invention, said at least one dilution fixture, for the purpose of mixing slurry and/or chemical blend (stream) and UPW (stream) to create a diluted sample prior to analyzing the diluted sample. This invention provides a slurry and/or chemical blend supply apparatus, alone or in combination with one or more other aspects or embodiments, comprising an analytical module further comprising at least two analytical apparatuses selected from the group consisting of pH sensors, hydrogen peroxide sensors, density sensors, conductivity sensors, particle size distribution analyzers and liquid particle counters and at least one or two other apparatuses selected from the group consisting of pH sensors, hydrogen peroxide sensors, density sensors, conductivity sensors, liquid particle counters and particle size distribution analyzers, preferably two pH sensors. Any sample that is diluted will be sent to a waste stream. Any sample that is not diluted may be returned to one of the modules of the invention.

The invention provides a slurry and/or chemical blend supply apparatus that comprises a blend module. The slurry and/or chemical blend supply apparatus may comprise a blend module alone or in combination with one or more modules selected from the group consisting of the feed module and/or analytical module and/or distribution module and/or any of the one or more other embodiments of the invention and/or one or more aspects of the invention. The invention provides a slurry and/or chemical blend supply apparatus comprising a blend module that combines two or more flowing component streams to form a blended slurry and/or chemical blend stream or a partially blended slurry and/or chemical blend stream in a pipe. The blend module may comprise a pipe for each component stream and at least one flow controller in each of the component pipes to control the flow rate of the components and wherein said component pipes are connected and combined into a single pipe to form the blended slurry and/or chemical blend stream. The at least one of the said flowing component streams may be said raw slurry and/or chemical component from a feed module, preferably a feed module in accordance with this invention. This invention provides a slurry and/or chemical blend supply apparatus comprising a blend module that may combine three or more flowing component streams, said blend module comprises three or more pipes one pipe for each of said three or more component streams and at least one flow controller in each of said three or more pipes to control the flow rate of the three or more component streams and wherein two of said three or more pipes are combined into a single (combined streams) pipe to form a partially blended slurry and/or partially blended chemical blend stream and then a third pipe of said three or more pipes is combined with the said single (combined streams) pipe to combine a third component stream with the partially blended slurry and/or partially blended chemical blend stream in a second single (combined streams) pipe. This invention further provides a slurry and/or chemical blend supply apparatus, that may be in accordance with one or more of the above embodiments or aspects of the invention, further comprising a blend module, said blend module further comprises at least one static mixer and/or the static mixer may be downstream of where at least two of three or more pipes are connected into a single pipe into which the component streams flow together in the blend module. This invention further provides a slurry and/or chemical blend supply apparatus that may further comprise one or more of the above embodiments or aspects of the invention, comprising a blend module and an analytical module, wherein optionally at least a portion of the blended slurry and/or chemical blend stream from the blend module flows through and is analyzed in the analytical module. (The apparatus may comprise one analytical module for the analysis of samples from various locations and/or modules in the apparatus.) The flow of the slurry and/or chemical blend component streams to and through the blend module is continuous as long as there is demand for the blended slurry and/or chemical blend by the distribution module and/or room in the distribution tank for the blended slurry and/or chemical blend. This invention further provides a slurry and/or chemical blend supply apparatus that may further comprise one or more of the above embodiments or aspects of the invention, comprising a distribution module and a blend module, said blend module comprising (blending) as components of a blended slurry or chemical blend already blended slurry and/or already blended chemical blend and optionally wherein at least a portion of the blended slurry and/or chemical blend stream from the blend module is transported to the distribution module.

This invention further provides a slurry and/or chemical blend supply apparatus that may further comprise one or more of the above embodiments or aspects of the invention, comprising an analytical module and distribution module optionally wherein at least a portion of the blended slurry and/or chemical blend stream from the analytical module is transported to the distribution module. This invention further provides a slurry and/or chemical blend supply apparatus that may further comprise one or more of the above embodiments or aspects of the invention, comprising a blend module and an analytical module and said blended slurry and/or chemical blend stream analyzed in said analytical module was blended in said blend module prior to flowing to said analytical module. This invention further provides a slurry and/or chemical blend supply apparatus that may further comprise one or more of the above embodiments or aspects of the invention, comprising an analytical module and a blend module, optionally wherein at least a portion of the blended slurry and/or chemical blend stream from the analytical module after analysis is transported (back) to the blend module for blending with components (component streams) of the slurry or chemical blend. This invention further provides a slurry and/or chemical blend supply apparatus that may further comprise one or more of the above embodiments or aspects of the invention, comprising a blend module comprising a blend module pump and two or more component pipes for each of two or more component streams, said component streams are selected from the group consisting of raw slurry and/or chemical streams, water, one or more chemical components, one or more chemical components blended with water, and partially blended or fully blended slurry and/or chemical blend streams and further wherein said at least two component pipes are connected and/or combined into a single pipe upstream of and within 1 foot or 2 or 5 or 12 feet or other distance of said blend module pump. This invention further provides a slurry and/or chemical blend supply apparatus that may further comprise one or more of the above embodiments or aspects of the invention, comprising a blend module having one or more static mixers and/or one or more blend module pumps to blend the slurry and/or chemical blend component streams and/or one or more additional pumps for transporting raw slurry from one or more raw slurry supply containers to a feed tank for supplying said blend module.

This invention provides a slurry and/or chemical blend supply apparatus, alone or in combination with any other one or more aspects or embodiments, comprising a blend module and a blend module pump that is downstream of and within 12 feet or within 5 feet or within 2 feet or within 1 foot or other distance of at least two junctions where two or more component streams are combined into a single stream in each of said junctions in said blend module, said three or more streams being selected from the group consisting of raw slurry streams, water, chemical component streams comprising one or more chemicals or one or more chemicals and water, partially blended slurry and/or partially blended chemical blend streams and fully blended slurry and/or fully blended chemical blend streams. This invention further provides a slurry and/or chemical blend supply apparatus that may further comprise one or more of the above embodiments or aspects of the invention, comprising a blend module pump selected from the group consisting of a centrifugal pump, a diaphragm pump and a peristaltic pump, preferably a centrifugal pump for slurry supply apparatuses. When an apparatus of this invention is used to supply a chemical blend and not slurries, a diaphragm pump and a pulse dampener may be used to provide similar steady flow rates as would be provided by a centrifugal pump. For chemical blends, the particle shear caused by a diaphragm pump to slurry particles is not an issue. Therefore, for the embodiments shown in the figures and described below a diaphragm pump and a pulse dampener may be substituted for the centrifugal pumps when the apparatus is used for chemical blends.

This invention further provides a slurry and/or chemical blend supply apparatus that may further comprise one or more of the above embodiments or aspects of the invention, comprising a blend module comprising at least one junction between component streams and wherein at said one or more junctions three of said streams are combined into a single stream. This invention further provides a slurry and/or chemical blend supply apparatus that may further comprise one or more of the above embodiments or aspects of the invention, wherein upstream of a blend module pump is a first junction and a second junction wherein said first junction is closer to said pump, in said first junction a first stream comprising one or more chemical components and water is combined with a second stream comprising raw slurry and/or chemical blend said first stream flowing from said second junction wherein at said second junction a third and a fourth stream are combined, wherein said third stream comprises water and said fourth stream comprises one or more chemical components to make said first stream and optionally the blend module further comprises at least one static mixer present after the third and fourth steams are combined and/or after said first and second streams are combined. This invention further provides a slurry and/or chemical blend supply apparatus that may further comprise one or more of the above embodiments or aspects of the invention, wherein a stream of fully blended slurry and/or chemical blend is combined in said blend module with at least one component stream to form a partially blended slurry and/or chemical blend stream or an additional fully blended slurry and/or chemical blend. (If a partially blended slurry and/or chemical blend stream is formed it will be combined with one or more component streams to form an additional fully blended slurry and/or chemical blend which is the same as the blended slurry and/or chemical blend stream and may be referred to as "additional blend slurry and/or additional chemical blend" or "blended slurry and/or chemical blend".) The slurry and/or chemical blend supply apparatus may further comprise an analytical module wherein at least a sample of the [additional] fully blended slurry and/or [additional] chemical blend stream is sent to the analytical module. Further in this embodiment at least a portion of the sample may be returned to the blend module at a pipe connection between the analytical module and the blend module, and/or the analytical module may be downstream of a blend module pump and pipe connection between the analytical module and the blend module for the returned sample may be upstream of the blend module pump. Alternatively, the sample after analysis by the analytical module may be directed to the distribution module. Note the use of "and/or" means that an apparatus may be used to make either chemical blend or slurry or both, however, the apparatus and method steps are used to make those products separately. Therefore blended slurry is not mixed with the chemical blend. Some of the chemical blend components may be the same or different from those used to make the blended slurry.

In an alternative embodiment, alone or in combination with any other aspect or embodiment, the slurry and/or chemical blend supply apparatus of this invention comprises a split mixer.

In an alternative embodiment, alone or in combination with any other aspect or embodiment, the slurry and/or chemical blend supply apparatus of this invention comprises a blend module comprising a split mixer.

In an alternative embodiment, alone or in combination with any other aspect or embodiment, the slurry and/or chemical blend supply apparatus of this invention comprises a distribution module comprising one or more pressurized vessels.

This invention also provides a slurry and/or chemical blend supply apparatus comprising one or more filters, filter banks, filter loops alone or that may also comprise any one or more additional aspects or embodiments of this invention. This invention provides a slurry and/or chemical blend supply apparatus comprising a blend module further comprising at least one filter (optionally at least one filter bank or filter loop) optionally located downstream of the blend module pump, or downstream of where the component streams are otherwise combined to form the blended slurry (or additional blended slurry) or chemical blend (or additional chemical blend). This invention also provides a slurry and/or chemical blend supply apparatus comprising dosing pipes connecting the component streams in the blend module to the distribution module to provide for adding one or more components from the blend module to the distribution module.

This invention further provides a slurry and/or chemical blend supply apparatus comprising alone or in combination with any one or more other aspects or embodiments of this invention, a distribution module. The distribution module may comprise at least one distribution tank, wherein at least a portion of said blended slurry and/or chemical blend stream is transported to at least one said distribution tank from said blend module.

A slurry and/or chemical blend supply apparatus, alone or in combination of the other aspect(s) or embodiment(s) disclosed herein comprising means to change the direction of at least part of a stream, said means comprising a three-way valve, pipes and a restricted orifice in one of said pipes, said three-way valve capable of directing the stream into said pipe having said restricted orifice therein. A slurry and/or chemical blend supply apparatus comprising an analytical module and a means to change direction, optionally wherein the at least part of the stream that is redirected by said means is a blended slurry and/or chemical blend stream and it is directed into an analytical module; optionally further comprising a blend module, a blend module pump, and said stream is directed into said analytical module downstream of said blend module pump. (Additionally, the at least part of the stream that is not redirected may flow via pipes connecting said blend module to said distribution module.) Any apparatus or method of this invention may comprise the means to change direction and it may be in any module or embodiment of the apparatus of this invention.

A slurry and/or chemical blend supply apparatus comprising, alone or in combination with any other one or more aspect(s) or embodiment(s) of the invention, a carboy compartment, said carboy compartment is optionally located downstream of a blend module. A carboy compartment is for removing samples of the blended slurry and/or chemical blend from said apparatus.

A slurry and/or chemical blend supply apparatus comprising, alone or in combination with any other aspect(s) or embodiment(s) of the invention, a distribution module comprising one or more distribution tanks, and/or one or more global loops, and/or one or more pumps. This invention further provides alone or in combination with any other aspect(s) or embodiment(s) of the invention, a slurry and/or chemical blend supply apparatus comprising a distribution module and one or more filter elements in said distribution module. This invention further provides alone or in combination with any other aspect(s) or embodiment(s) of the invention, a slurry and/or chemical blend supply apparatus comprising an analytical module and at least one other module (e.g., feed, blend and/or distribution module), at least one of said at least one other module comprises piping and one or more sample ports in said piping and one or more tubes in fluid communication with said sample ports, each sample port and tube provides slurry (or raw slurry) and/or chemical blend to the analytical module for analysis. This invention further provides alone or in combination with any other aspect(s) or embodiment(s) of the invention, a slurry and/or chemical blend supply apparatus comprising an analytical module and at least one other module (e.g., feed, blend, distribution), said at least one other module further comprises one or more sample loops that provide slurry and/or chemical blend to the analytical module and return it to at least one of the at least one other module; the loop may return the slurry and/or chemical blend to the same module that the slurry and/or chemical blend came from, alternatively, the loop may return the slurry and/or chemical blend to the distribution tank that is presently being used by the apparatus. The slurry and/or chemical blend apparatus comprises one analytical module for the apparatus optionally further comprising if the apparatus comprises a blend module, a liquid particle counter and/or a particle size distribution analyzer that may be connected to the feed module. The distribution module may comprises one or more than one sample ports and optionally comprise one or more than one sample loops to said analytical apparatus. The slurry and/or chemical blend supply apparatus may comprise a distribution module comprising a pump and one or more pressure vessel elements that provide for the continuous flow of slurry and/or chemical blend to a global loop.

A slurry and/or chemical blend supply apparatus comprising, alone or in combination with any one or more of the other aspects or embodiments of the invention, a distribution module comprising one or more global loops and further comprising one or more back pressure controllers and pressure sensors on each of the one or more global loops, and optionally, one or more flow sensors on each of the one or more global loops. The global loop is a circulation loop; the global loop may comprise aspects described for the circulation loop (in the feed module) and vice versa. The global loop may be referred to as the global circulation loop. The global loop may comprise one or more filters or banks of filters or filter loops optionally upstream of the tools which the global loop provides slurry or chemical blend to. This invention further provides alone or in combination with any other aspect(s) or embodiment(s) of the invention, a slurry and/or chemical blend supply apparatus comprising one or more tanks (for example, a distribution tank and/or feed tank), and/or at least one of the one or more tanks comprises one or more level sensors (optionally ultrasonic level sensors) and/or at least one of the one or more tanks may comprise one or more eductors wherein the piping connected to the eductors penetrates the wall of the tank near the bottom of the tank. This invention further provides alone or in combination with any one or more other aspect(s) or embodiment(s) of the invention, a slurry and/or chemical blend supply apparatus comprising a tank comprising a double exit loop.

This invention further provides alone or in combination with any other aspect(s) or embodiment(s) of the slurry and/or chemical blend supply apparatus of this invention, a process of using a slurry and/or chemical blend supply apparatus comprising the step of pumping raw slurry from a slurry supply container into a feed tank that is part of a feed module of a slurry and/or chemical blend supply apparatus. The apparatus of this invention may be used to provide (or the process of this invention may further comprise one or more steps of providing) raw slurry to a blend module, blend slurry, supply slurry to a global loop, used to provide (or providing) blended slurry to one or more CMP or other tools, and/or used to provide (or providing) slurry to an analytical module and/or other modules/processes. Alternatively or additionally, the apparatus and processes of this invention may be used to blend or for blending chemical blend, used to provide or providing chemical blend to a global loop, used to provide or providing chemical blend to one or more CMP or other tools, and/or used to provide or providing chemical blend to an analytical module and/or other modules/processes. The apparatus and processes of using a slurry and/or chemical blend supply apparatus of this invention may further comprise the step of, alone or in any combination with one or more process steps of this invention, pumping the raw slurry in a circulation loop from said slurry supply container for a period of time prior to and/or simultaneously with pumping the raw slurry from the slurry supply container into a feed tank. This invention further provides a process comprising the step of, alone or in any combination with other one or more process steps of this invention, passing raw slurry through a strainer before one or more pumps in the feed module. This invention further provides a process comprising the step of, alone or in any combination with one or more other process steps of this invention, filtering said raw slurry from said slurry supply container prior to and/or simultaneously with transporting it into a feed tank of the slurry and/or chemical blend supply apparatus of this invention. This invention further provides a process comprising the step of, alone or in any combination with one or more other process steps of this invention, filtering said raw slurry in a filter loop from and to the slurry supply container prior to transferring the slurry to the feed tank. This invention further provides a process comprising the step of, alone or in any combination with one or more other process steps of this invention, by-passing the feed tank and transporting raw slurry to the blend module if there is an urgent demand for raw slurry in the blend module of the slurry and/or chemical blend supply apparatus (that cannot be met by the raw slurry in the feed tank, if any). This invention further provides a process comprising the step of, alone or in combination with any one or more other process steps of this invention, circulating raw slurry from the feed tank through a circulation loop and back to the feed tank.

This invention further provides a process comprising the step of, alone or in combination with any one or more other process steps of this invention, transferring at least a portion of the slurry in the circulation loop of the feed module to a blend module when the blend module is blending slurry. This invention further provides a process comprising the step of, alone or in combination with any one or more other process steps of this invention, stopping the transfer of the slurry from the circulation loop in the feed module to the blend module when the blend module is not blending slurry, and optionally filtering the slurry while it circulates in the circulation loop. This invention further provides a process comprising the step of, alone or in combination with any one or more other process steps of this invention, filtering the slurry in the circulation loop when the slurry is not being transferred to the blend module, and not filtering the slurry in the circulation loop when the slurry is being transferred to the blend module. This invention further provides a process comprising the step of, alone or in any combination with one or more other process steps of this invention, analyzing (using one or more analyzing apparatuses) the slurry and/or chemical blend from one or more modules (feed, and/or blend and/or distribution) of the slurry and/or chemical blend supply apparatus. This invention further provides a process comprising the step of, alone or in any combination with one or more other process steps of this invention, diluting at least a portion of the slurry and/or chemical blend prior to analyzing the slurry and/or chemical blend from one or more modules (feed, and/or blend and/or distribution) of the slurry and/or chemical blend supply apparatus, said diluting step may provide a single dilution or a double dilution of the slurry and/or chemical blend. This invention further provides a process comprising the step of, alone or in any combination with other one or more process steps of this invention, transporting the slurry and/or chemical blend from one or more modules (feed, and/or blend and/or distribution) of the slurry and/or chemical blend supply apparatus to an analytical module via sample tubes or via sample loops. (The use of the sample loops includes the additional step of returning the slurry and/or chemical blend to the slurry and/or chemical blend supply apparatus, which may be (back) to the same module from which the slurry and/or chemical blend was transported to the analytical module). This invention further provides a process comprising the step of, alone or in any combination with any one or other process steps of this invention, controlling the flow and/or dilution of slurry and/or chemical blend in said analytical module using one or more pieces of equipment selected from the group consisting of: a needle valve, a peristaltic pump, a rotometer and a dilution fixture.

This invention further provides a process comprising the step of, alone or in any combination with any one or other process steps of this invention, transporting slurry and/or chemical blend from one or more modules (feed and/or blend and/or distribution) of the slurry and/or chemical blend supply apparatus to an analytical module and analyzing the slurry and/or chemical blend, and optionally diluting the slurry and/or chemical blend prior to analyzing, and optionally returning the slurry and/or chemical blend to a module of the slurry and/or chemical blend supply apparatus which may be the same module from which the slurry and/or chemical blend was transported from. In alternative embodiments, the slurry or chemical blend may be returned to the distribution tank from the analytical module regardless of where in the apparatus the sample of blended slurry or chemical blend was transported (drawn) from, or alternatively sent to drain. This invention provides a process comprising the step, alone or in combination with one or more other steps, of drawing slurry and/or chemical blend from multiple modules sequentially for analysis by the analytical module and/or analytical apparatuses. The measurements made by the analytical module or any analytical apparatus or any combination of apparatuses may be used by the controller (computer) for directing the apparatus to take action based on the measurements, for example, directing raw slurry and/or blended slurry and/or partially blended slurry and/or one or more chemical component streams and/or partially blended chemical blend and/or a chemical blended stream to a waste stream from any module in the apparatus, or directing the slurry to one or more filters, or other treatment means, or adjusting the composition in the blend module via adjusting the flow controllers in the blend module, or adding a metered (timed) amount of one or more components to the distribution tank from the blend module or sounding an alarm to alert a technician, or continuing normal operation of the apparatus if the measurements are within the acceptable ranges or other actions described herein.

This invention further provides a process comprising the step of, alone or in combination with any one or more other process steps of this invention using the data obtained from the particle size distribution analyzer alone or in any combination with one or more of the other analytical data measured for the slurry or chemical blend to perform the step of providing slurry and/or chemical blend quality control real time recipe adjustment and/or technician notification. The particle data distribution analyzer and any other analytical data, when measured in the feed module, may provide a threshold control for the raw slurry's transfer to the feed tank in the feed module and/or from the feed module to the blend module in order to distinguish a good raw slurry batch from a bad raw slurry batch (meaning that the number of particles and/or particle size distribution of the slurry particles are not within the desired specification). This invention further provides a process comprising the step of, alone or in combination with any one or more other process steps of this invention, analyzing the raw slurry by liquid particle counter or particle size distribution analyzer, checking the results against a previously determined acceptable range prior to transferring the slurry to the feed tank and/or to the blend module. When the analyzer(s) is/are used alone or in any combination to measure raw slurry or blended slurry or chemical blend in the blend module, it may be used to provide real time adjustment to the recipes being used to minimize process variation. When the particle size distribution analyzer and/or other measurements from other analytical apparatuses measure the slurry and/or chemical blend in the distribution module, it provides a final process control threshold before the raw or blended slurry and/or chemical blend is allowed to be transferred to the feed tank from the slurry supply container, or transferred to the blend module from the feed module or from the slurry supply container, or transferred to the distribution module from the blend module or from the analytical module or transferred to the global loop and into the planarization or other equipment from the distribution module or from the blend module. This invention may utilize one or more of the above methods to improve the quality of the slurry and/or chemical blend delivered to and through the various modules of the apparatus of this invention.

This invention further provides a process comprising the step of, alone or in any combination with one or more other process steps of this invention, passing slurry and/or chemical blend through a strainer in one or more pipes in the slurry and/or chemical blend supply apparatus, for example, flowing the slurry and/or chemical blend through a strainer upstream of one or more of the pieces of equipment selected from the group consisting of flow controllers, pumps, needle valves, other restricted valves and orifices. This invention further provides a process comprising the step of, alone or in any combination with one or more other process steps of this invention, controlling the flow through a circulation loop (or global loop) by measuring a flow rate using a flow sensor and using the measured flow rate to adjust a pump speed and/or measuring a pressure and using the pressure in the circulation loop or global loop to adjust the pump speed, and/or using a pressure sensor to adjust a back pressure controller, said back pressure controller being located near the return of the circulation loop (or global loop), which may be to a distribution or feed tank and/or a slurry supply container.

This invention further provides a process comprising the step of, alone or in any combination with any one or more other process steps of this invention, filtering (using one or more filter elements, such as filters or filter banks optionally in a filter loop) the slurry and/or chemical blend in one or more modules (for example, feed, and/or blend and/or distribution and/or analytical of the slurry and/or chemical blend supply apparatus. This invention further provides a process comprising the step of, alone or in any combination with one or more other process steps of this invention, filtering slurry and/or chemical blend in a separate filter loop, said filter loop comprising a pipe loop, a filter loop pump, and one or more filters in fluid communication with the pipe loop, and/or constructing the loop out of stronger piping and connections and/or using higher pump pressure and/or filters having smaller pores than if the filter were in-line.

This invention further provides a process comprising the step of, alone or in any combination with one or more other process steps of this invention, blending at least two or more component streams in a slurry and/or chemical blend supply apparatus, the at least two or more component streams being selected from the group consisting of raw slurry, water, one or more chemical components, one or more chemical components blended with water, a partially blended slurry, partially blended chemical blend stream, fully blended slurry or fully blended chemical blend stream, said process comprising the steps of flowing the at least two streams through flow controllers that provide measured amounts of each of the streams to be combined and combining the at least two streams to form a single stream, optionally wherein said combining step to form said single stream occurs upstream of the pump within less than 5 or 2 feet or 1 foot or 6 inches of flowing distance of said single stream to the pump and flowing said single stream through the pump. The process above further comprising the step of flowing said raw slurry stream through a strainer upstream of said flow controller. The process above wherein said flowing step and said combining step comprises combining three of said component streams. Any process above wherein prior to said combining step is a first step of combining at least two of said component streams to form a first partially blended slurry and/or first partially blended chemical blend stream. Any of the processes above and wherein said first partially blended stream (slurry or chemical blend) is combined in said combining step. Any process above wherein after said first step of combining but before said combining step is a second step of combining at least two of said component streams to form a second partially blended (slurry and/or chemical blend) stream or a fully blended (slurry and/or chemical blend) stream, said combining step therefore becoming a third step of combining. Any process above wherein one of said at least two component streams that are combined in said second step of combining is said first partially blended slurry and/or first partially blended chemical blend. Any of the above processes wherein the first step or second or first and second or first, second and third steps of combining is (are) within 5 feet or 2 feet or 1 foot upstream of said pump. This invention further provides a process comprising the step of, alone or in any combination with one or more other process steps of this invention combining a fully blended slurry or fully blended chemical blend in any one of said first, second or third combining steps in said blend module, or in an additional combining step (that is fourth or fifth). In any of these processes, the finally blended slurry or finally blended chemical blend exiting the blend module may be fully blended slurry or fully chemical blend or additional fully blended slurry or additional blended chemical blend. The blended slurry or blended chemical blend combined with other component streams in the blend module may come from one or more of the following modules: the analytical module, the blend module and the distribution module. Any of the above processes, wherein said step of combining blended slurry or blended chemical blend may be preceded by one or more steps selected from the group consisting of: filtering said blended slurry or chemical blend, analyzing said blended slurry or chemical blend, or directing said blended slurry or chemical blend from said distribution tank to said blend module. One, two or all three of these streams may be continuously directed to the blend module optionally at a steady and controlled flow rate. If desired, flow controllers or other valves or pumps may be used to provide a steady flow of the blended slurry or blended chemical blend to be combined with the other component streams in the blend module. In any of these processes the blended streams after any of the combining steps may be selected from the group consisting of partially blended slurry stream or partially blended chemical blend stream (which may be one or more streams of chemical components optionally blended with water and/or raw or blended slurry or other components, for example water and raw or blended slurry, or raw or blended slurry and one or more chemicals, or two or more chemicals, or chemical and water), fully blended slurry, or fully blended chemical blend, or additional fully blended slurry (which is the components of a fully blended slurry combined with a stream of already fully blended slurry), or additional fully blended chemical blend stream (which is the components of a fully blended slurry combined with a stream of already fully blended slurry).

This invention further provides a process comprising the step of, alone or in any combination with any one or any combination of other process steps of this invention of pumping slurry and/or chemical blend through pipes in at least one of the feed, blend, analytical and distribution modules or from one module to at least one other module using one or more centrifugal pumps, or one or more diaphragm pumps, or one or more peristaltic pumps or any combination of pumps.

This invention further provides a process comprising the step of, alone or in any combination with any one or any combination of other process steps of this invention, analyzing the slurry and/or chemical blend in, of or from, one or more modules (feed, and/or blend and/or distribution) of the slurry and/or chemical blend supply apparatus, which may occur using one or multiple in-line analytical modules. Such analysis can be used for the steps of monitoring and/or controlling the slurry and/or chemical blend via controlling the slurry and/or chemical blend supply apparatus and/or its individual modules either automatically by a controller or manually by a technician. In one such process, alone or in combination with any of the other process steps of this invention, said process comprises the step of flowing at least a portion of (additional) blended slurry or (additional) chemical blend from said blend module into said analytical module, and/or either before or after said flowing step into said analytical module, the step of flowing said at least a portion of said (additional) blended slurry or (additional) chemical blend from said blend module into a treatment means, such as a filter. The process of this invention alone or in combination with any one or more of the process steps herein, further comprising flowing blended slurry or chemical blend into an analytical module comprising one or more analytical apparatuses and analyzing said slurry or chemical blend. The process of this invention alone or in combination with any one or more of the process steps herein, further comprising dosing said distribution tank with one or more components in response to the analysis of said blended slurry or chemical blend by said analytical apparatuses. The process of this invention alone or in combination with any one or more of the process steps herein, further comprising dosing said distribution tank with one or more components in response to the analysis of said blended slurry or chemical blend by said analytical apparatuses by terminating blending in said blend module (if blending is occurring) and flowing one or more components from said blend module to said distribution tank, terminating dosing (which may be after dosing for a period of time) and optionally resuming blending if or when the distribution tank is calling for more blended slurry of chemical blend.

The process of this invention alone or in combination with any one or more of the process steps herein, further comprising blending slurry or chemical blend by flowing two or more component streams into a split mixer.

This invention further provides a process comprising the step of, alone or in any combination with any one or any combination of other process steps of this invention, pumping or otherwise transporting or flowing blended slurry and/or chemical blend (which may be fully blended slurry and/or fully blended chemical blend or additional fully blended slurry and/or additional fully blended chemical blend) from the blend module to the distribution module, the distribution module may comprise a distribution tank for receiving the blended slurry and/or chemical blend, and the process may further comprise pumping or otherwise transporting or flowing the blended slurry and/or chemical blend from the distribution tank through a global loop to one or more CMP or other tools. The process of pumping the slurry and/or chemical blend around the global loop may further include the step of transporting (preferably continuously when the apparatus is in use and slurry and/or chemical blend is present in the global loop) at least a portion of the blended slurry and/or chemical blend in the global loop back to the one or more distribution tanks, and the process may additionally include the step of measuring the pressure is said global loop and/or the flow rate of blended slurry and/or chemical blend in the global loop and adjusting the speed of the pump and/or the back pressure controller in response to the measured pressure and/or flow rate to regulate the flow of the blended slurry and/or chemical blend in the global loop. The apparatus may communicate the measured pressure and/or flow rate information to a controller for the apparatus, and the apparatus (controller) may, based on the measured back pressure in the global loop and/or the measured level of blended slurry and/or chemical blend in the distribution tank perform the step of directing the blend module to blend slurry and/or chemical blend or, if the blend module is blending, may direct the flow controllers to proportionally increase the flow through the flow controllers in the blend module.

This invention further provides a process comprising the steps of, alone or in any combination with any one or any combination of other process steps of this invention, the step of providing a slurry and/or chemical blend supply apparatus comprising a distribution module comprising first and second distribution tanks and/or first and second pumps and/or first and second global loops (all or some of which may be in direct fluid communication in any combination and/or at least one or both of the first and second distribution tanks may be in direct fluid communication with the blend module and/or analytical module); and switching from the first to the second distribution tank and/or from the first to the second pump in the distribution module and/or from the first to the second global loop. The process comprising the steps of, alone or in any combination with any one or any combination of other process steps of this invention, providing a slurry and/or chemical blend supply apparatus comprising first and/or second distribution tanks, first and second distribution pumps, and first and second global loops; and switching the flow of blended slurry and/or chemical blend to and through the first distribution tank, the first pump, and the first global loop to and through the second distribution tank, the second pump and the second global loop that may be in response to first distribution tank, first pump and/or first global loop failure or contamination of the first distribution tank. The process comprising the steps of, alone or in any combination with any one or any combination of other process steps of this invention, providing a slurry and/or chemical blend supply apparatus comprising first and second distribution tanks, first and second distribution pumps, and first and second global loops; and pumping blended slurry and/or chemical blend from the first distribution tank via (and through and/or by the action of) the first pump to the first global loop, and pumping blended slurry and/or chemical blend from the second distribution tank, via (and through and/or by the action of) the second pump to the second global loop. The blended slurry and/or chemical blend flowing (pumped) through the first distribution tank, first pump and first global loop may be the same or different from the blended slurry and/or chemical blend flowing (pumped) through the second distribution tank, second pump and second global loop. The process may further comprise alone or in any combination with any one or any combination of other process steps of this invention blending the one or more blended slurries and/or one or more chemical blends in the blend module. The process may further comprise a blend module that may blend a first blended slurry and/or first chemical blend and transport it to the first distribution tank for pumping via (through and/or by the action of) the first pump through the first global loop, and may blend a second blended slurry and/or second chemical blend and transport it to the second distribution tank for pumping via (through and/or by the action of) the second pump through the second global loop. The process may further comprise controlling the timing and/or volume of the blending by the blend module of the first and/or second blended slurry and/or first and/or second chemical blend based on the demand of the first and/or second blended slurry and/or first and/or second chemical blend by the first global loop and/or second global loop, which may be controlled by the controller of the apparatus based on variables measured by one or more tank level sensors and/or speed of one or more pumps operating in the first or second global loops and/or the flow rates measured by one or more flow sensors and/or pressures measured by one or more pressure sensors in the global loops and communicated to the controller. The first and second blended slurries and/or first and second chemical blends may be the same or different. In any of the just described embodiments, the first distribution tank may hold a blended slurry, and the second tank may hold a chemical blend. In any of the above-described embodiments, the apparatus may comprise only one distribution tank, and more than one global loop, wherein each global loop may comprise its own pump. In any of the above-described embodiments, the one or more distribution tanks may comprise one or more chemical blends therein. This invention further provides a process comprising the steps of, alone or in any combination with any one or any combination of other process steps of this invention of supplying raw slurry to the feed tank and/or the blend module (which may be from a slurry supply container to the blend module while bypassing the feed tank) in response to demand from the slurry and/or chemical blend supply apparatus for blended slurry in distribution module. This invention further provides a process comprising the steps of, alone or in any combination with any one or any combination of other process steps of this invention, increasing or decreasing the speed of the global loop supply pump in response to an increase or decrease in the consumption (use) of blended slurry and/or chemical blend by the CMP or other tools in fluid communication with the global loop (as measured by flow and/or pressure sensors and/or pump speed in the global loop). This invention further provides a process comprising the steps of, alone or in any combination with any one or any combination of other process steps of this invention, blending more or less blended slurry and/or chemical blend in the blend module or starting or stopping the blending in the blend module when the level sensor in at least one distribution tank indicates an increased or decreased need for blended slurry and/or chemical blend. This invention further provides a process comprising the steps of, alone or in any combination with any one or any combination of other process steps of this invention, increasing or decreasing the feed module pump speed on the circulation loop when the blend module consumes an increased or decreased amount of raw slurry. This invention further provides a process comprising the steps of, alone or in any combination with any one or more other process steps of this invention, operating the slurry and/or chemical blend supply apparatus such that the feed module and/or blend module and/or distribution module and/or analytical module are continuously transporting (and/or circulating and/or blending and/or analyzing) at least some slurry and/or chemical blend through most of the pipes, tanks, and other parts and equipment of the slurry and/or chemical blend supply apparatus when slurry and/or chemical blend is being supplied to the global loop. (Most of the pipes, tanks and other parts means more than 50%, or more than 75%, or more than 90%, or more than 95%, of the total linear flowing distance (measuring the shortest distance through a tank or equipment) of the slurry and/or chemical blend (that slurry and/or chemical blend flow through) through the slurry and/or chemical blend supply apparatus, excluding redundant modules or parts that are not in use or on-line.) The process of this invention, further comprises, even if the blend module stops blending, the steps of continuing to circulate raw slurry in the circulation loop in the feed module and continuing to circulate the blended slurry and/or chemical blend in the one or more global loops in the distribution module. This invention further provides a process comprising the steps of, alone or in any combination with one or more other process steps of this invention of flowing slurry and/or chemical blend into a tank by passing the slurry and/or chemical blend through an eductor. This invention further provides a process comprising, alone or in any combination with one or more of other process steps of this invention, when the apparatus is operating and slurry or chemical blend is present in a distribution and/or feed tank at or above a certain level, the step of continuously returning fluid to a tank from a global loop or circulation loop. This invention further provides a process comprising the step of, alone or in any combination with any one or more process steps of this invention, controlling the pressure in a circulation loop (including a global loop) using a back pressure controller. This invention further provides a process comprising the step of, alone or in any combination with any one or any combination of other process steps of this invention, transporting slurry and/or chemical blend from the exit opening at the bottom of each tank through a circulation loop including a global loop) to the return pipe to the tank, and/or flowing the slurry and/or chemical blend out of one or more eductors located at the end of the return pipe inside the tank. In any embodiment, each of the circulation loops provides for substantially continuous or near continuous mixing and moving of the slurry and/or chemical blend so that no detrimental settlement of the slurry and/or separation of the components of the chemical blend occurs. This invention further provides alone or in combination with any other aspect(s) or embodiment(s) of the invention, a process comprising the step of flowing slurry and/or chemical blend out of the exit opening at the bottom of a tank into a double line exit loop and/or the additional step of flowing the slurry and/or chemical blend to a pump.

This invention further provides alone or in combination with any one or more process steps of the invention, a process comprising the step of redirecting the flow of at least a portion of a slurry or chemical blend stream using a restricted orifice and a three-way valve which optionally may be used for directing at least a portion of a slurry or chemical blend stream into an analytical module.

This invention further provides alone or in combination with any one or more process steps of the invention, a process comprising the step of pumping slurry or chemical blend from a distribution tank into one or more pressure vessel elements (each pressure vessel element comprising one or more pressure vessels). This invention further provides alone or in combination with any one or more process steps of the invention, a process comprising the step of maintaining the one or more pressure vessel elements (one or more pressure vessels) under a constant elevated pressure via a pressure regulator and connection to a pressurized gas source. This invention further provides alone or in combination with any one or more process steps of the invention, continuously pumping the slurry or chemical blend from a distribution tank at a pressure greater than the pressure in the one or more pressure vessel elements (one or more pressure vessels) to continuously supply the one or more pressure vessel elements with slurry or chemical blend, when said one or more pressure vessel elements (one or more pressure vessels) are continuously supplying one or more global loops with slurry or chemical blend. This invention further provides alone or in combination with any one or more process steps of the invention, switching from the supply by a first pump to a first pressure vessel element to the supply by a second pump to a second pressure vessel element in a distribution module to supply one or more global loops with slurry or chemical blend, preferably the first pump and first pressure vessel element supply the same global loop as the second pump and the second pressure vessel element.

BRIEF DESCRIPTION OF SEVERAL VIEWS OF THE DRAWINGS

FIG. 1A shows one embodiment of the feed module. FIG. 1B shows one embodiment of each of the blend module and analytical module. FIG. 1C shows one embodiment of the distribution module.

DETAILED DESCRIPTION OF THE INVENTION

Figure 1A:
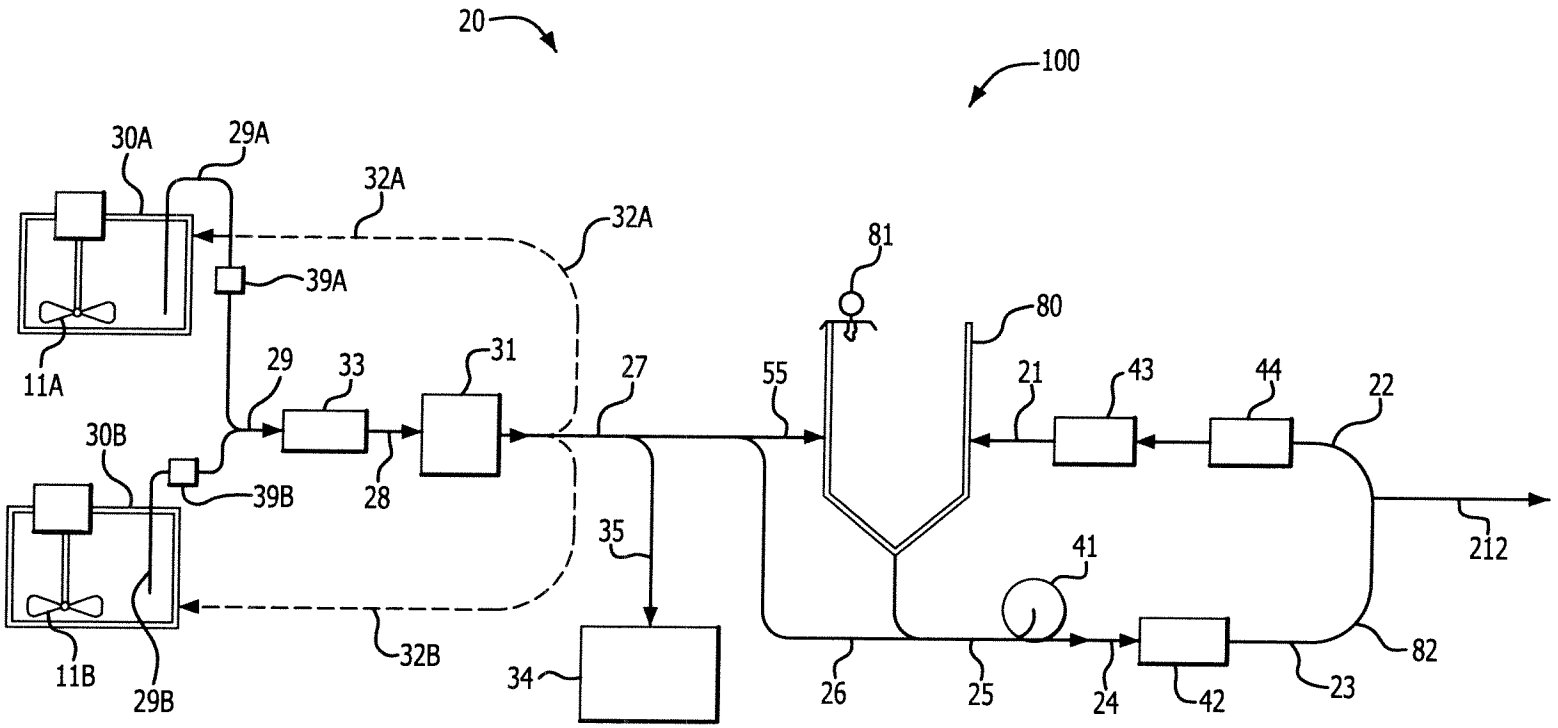
FIGS. 1A, 1B and 1C is one embodiment of a slurry and/or chemical blend supply apparatus of this invention comprising one or more of the following modules: feed module, blend module, analytical module and distribution module.

This description of illustrative embodiments is intended to be read in connection with the accompanying drawings, which are to be considered part of the entire written description. In the description of embodiments disclosed herein, any reference to direction or orientation is merely intended for convenience of description and may not limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and may not require that the apparatus be constructed or operated in a particular orientation unless otherwise stated. Terms such as "attached," "affixed," "connected" and "interconnected," refer to a relationship wherein structures are secured or attached to one another either directly or indirectly through intervening structures, as well as both movable or rigid attachments or relationships, unless expressly described otherwise. The term "adjacent" as used herein to describe the relationship between structures/components includes both direct contact between the respective structures/components referenced and the presence of other intervening structures/components between respective structures/components. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

As used herein and in the claims, the terms "comprising," "comprises," "including," and "includes" are inclusive or open-ended and do not exclude additional unrecited elements, composition components, or method steps. Accordingly, these terms encompass the more restrictive terms "consisting essentially of" and "consisting of." Therefore, any use of the open-ended terms can be read as including "consisting essentially of" and "consisting of" although it may not be explicitly stated.

As used herein, the terms "line," "piping," "pipe," "tube," and "tubing" are used interchangeably and refer to any type, size, or configuration of flow conduit conventionally used in the art for transporting liquids (including slurries) and/or gaseous materials and combinations thereof. Additionally those terms may or may not include multiple pipe sections that also may or may not have in-line devices installed therein, such devices include pumps, flow sensors, pressure sensors, valves, apparatuses and the like. (The term "in-line" means that the one or more devices are in fluid communication with each other. The term "off-line" means that a device is not in fluid communication with any module of the slurry and/or chemical blend supply apparatus and is separate from or separated from the slurry and/or chemical blend supply apparatus. Alternatively an in-line device can temporarily be off-line when the valves in fluid communication and to and/or from the device are closed and/or when a bypass line directing the flow of a stream away from the device is opened, for example, when the part is being repaired or replaced.) If pipes are connected to each other or other elements such as pumps, filters, modules etc, of this invention, the term "in fluid communication" can be substituted for "connected" and vice-versa, although the connection may be direct or indirect. In most places in this application, the use of line, piping and tubing may refer to per fluoro alkoxy (PFA), stainless steel (SS) or polyethylene (PE) tubing having an outside diameter of between from ⅛ inch to 1 inch, except where described differently. Useful tubing is commercially available from Entegris, Finger Lakes Extrusion, Swagelok, Cardinal, Marco Tubing and Valex. The connections between the tubing may be made from the same materials listed above for the tubes and are also commercially available. If an apparatus is going to blend slurries or chemical blends having very high pH (for example, greater than 10) or very low pH (for example, less than 4), then the parts of the apparatus that will contact the chemicals having very high or very low pH will be Teflon-coated parts, for example, pipes, tubing, tanks, valves, etc. Such parts are available from the same providers listed above.

Any reference to "slurry" unless otherwise specified or apparent from the context includes raw slurry, blended slurry, fully blended slurry, additional blended slurry, or already blended slurry. Any reference to "blended slurry" unless otherwise specified includes blended slurry, fully blended slurry, additional blended slurry, or already blended slurry. Any reference to "chemical blend" unless otherwise specified or apparent from the context includes chemical blend, fully blended chemical blend, additional blended chemical blend or already blended chemical blend. Blended slurry and fully blended slurry refer to the same thing. Chemical blend and fully blended chemical blend refer to the same thing.

To make the solenoid manifold in the apparatus more robust, a custom metal connector may be used to connect the polymer tubing for the supply of the pressurized air to the solenoid manifold and to connect the return tubing of the pressurized air from the solenoid manifold. The invention provides a slurry and/or chemical blend supply apparatus using such a solenoid manifold.

As used herein and in the claims, the term "filter element" includes one or more filters in one or more housings. The term "filter bank" is used to describe more than one filter in a single housing, more than one filter or filter banks in series or more than one filter in a parallel arrangement. The parallel arrangement means that there are at least two filters or at least two filter banks, each having a separate line upstream and downstream of at least one filter or at least one filter bank and at least one valve either upstream or downstream, preferably at least upstream, more preferably upstream and downstream of at least one filter or at least one filter bank, the separate lines to each of the at least one of the at least two filters or filter banks are in fluid communication with at least the same upstream line and optionally the same line downstream of the parallel filters or filter banks. The valves provide for the isolation of the filters, so they can be taken off-line and changed. A filter element may also be include a filter or filter element in a filter loop wherein the filter loop comprises at least one filter or filter bank that may be in a serial or parallel arrangement and a pump. A filter bank is two or more, for example two to five filters that are closely connected and may be in a single filter housing.

Figure 1B:
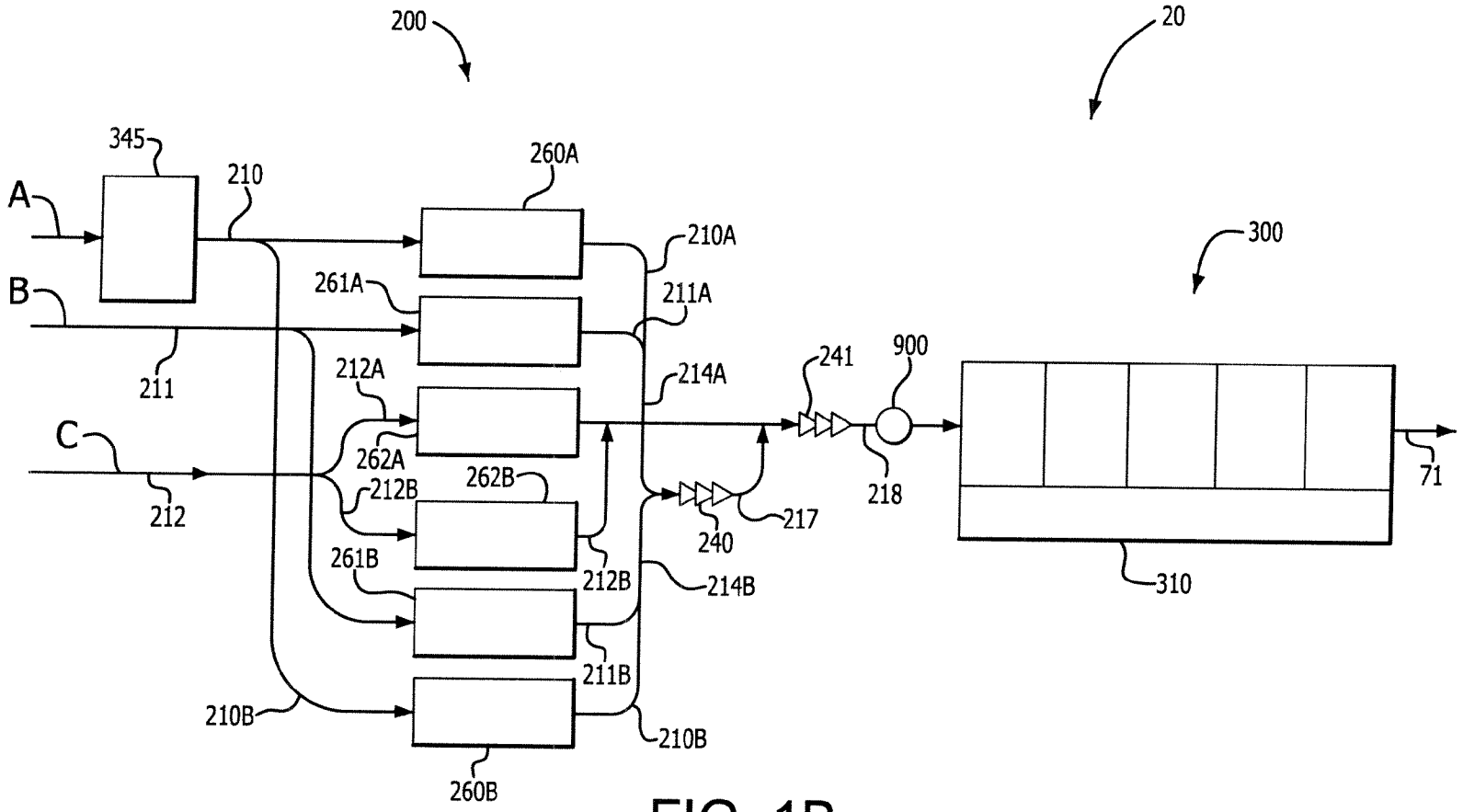
Figure 1C:
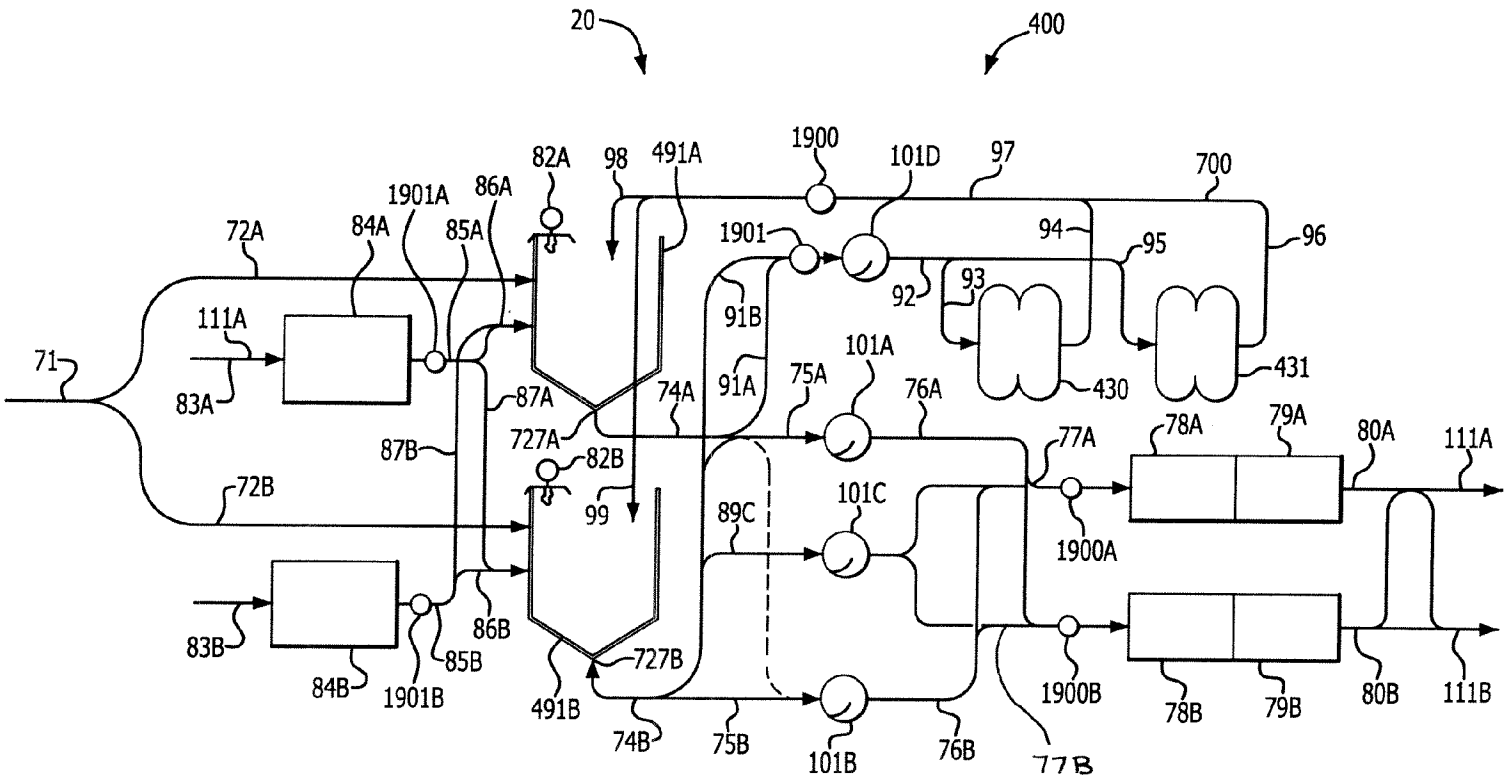

Referring to FIGS. 1A, 1B and 1C, a slurry and/or chemical blend supply apparatus 20 according to one embodiment of the present invention is shown comprising slurry and/or chemical blend feed module 100, blend module 200, optional analytical module 300 and distribution module 400. Alternatively the slurry and/or chemical blend supply apparatus may comprise each of the modules or aspects of the modules described below either alone or in any combination. For example, the apparatus may comprise blend module, distribution module and optional analytical module, particularly if it is a chemical blend supply apparatus (meaning it has no feed module).

For many commercially available slurries, the slurry must be kept moving at a minimum flow rate. If not, the force of gravity will cause the slurry particles to fall out of suspension. The minimum flow rate is dependent upon the type of slurry particles and for some may be greater than 0.2 ft/sec, for others between from 2.5 to 10 ft/sec, and for other about 3.5+/−1 ft/sec through the tubes. The apparatus of this invention comprises pumps, circulation loops, tanks, pipes, valves and eductors to keep large quantities of slurry and/or chemical blend moving and the slurry particles in suspension and ready for blending if raw slurry, or, if already blended slurry or chemical blend, ready for use by the CMP or other tools. The apparatus further comprises the means via level sensors, pressure sensors and flow sensors and a controller that controls pump speeds, valve openings and flow controllers to respond to the fab's needs, that is, to deliver the blended slurry and/or chemical blend to and make blended slurry and/or chemical blend as needed by the CMP tools. Additionally the slurry and/or chemical blend supply apparatus of the invention comprises one or more in-line analytical modules comprising analytical tools (also referred to as analytical apparatuses) to check periodically or continuously and quickly to be sure that the specifications (or characteristics) of the slurry and/or chemical blend are within the desired ranges so that any adjustments can be made before a large quantity of out-of-specification slurry and/or chemical blend is made. The analytical module may comprise one or more analytical apparatuses and the piping to and/or from the analytical module. The terms analytical package and analytical module may be used interchangeably. Additionally the invention provides a slurry and/or chemical blend supply apparatus comprising one or more in-line filter elements to remove slurry particles that are too large (out of specification), again, so that a large (or as-needed) supply of in-specification blended slurry having the desired particle sizes is ready for use by the CMP tools in a fab, and for removing any particles (impurities) above a maximum allowable size from a chemical blend so that a large supply of in-specification chemical blend not having any particles above a maximum allowable size therein is ready for use by the tools requiring the chemical blend.

The slurry feed module 100 will be described in reference to FIGS. 1A and 2. The slurry feed module 100 comprises at least one slurry transfer pump 31 for removing slurry from one or more slurry supply containers 30A, 30B. The slurry feed module 100 further comprises one or more raw slurry day tanks also referred to as slurry feed tanks or feed tanks 80 (one shown) in fluid communication with the one or more slurry transfer pumps for receiving the raw slurry removed by the suction provided by the one or more slurry transfer pumps 31 (one shown) from the supply containers 30A, 30B. The slurry feed module 100 can draw slurry from one or more slurry supply containers 30A, 30B. Typically raw slurry is supplied in drums or totes. The drums typically hold 55 gallons, the totes comprise 300 gallons; therefore, the slurry supply containers are typically from 55 to 300 gallons, however, the slurry supply containers can be any size. The term "slurry supply container" shall be used herein, and it is understood that the containers can be drums or totes or other types or sizes of containers. Typically the slurry supply containers have openings only on the top, thereby typically requiring a pump that can lift the slurry out of the slurry supply container. The slurry feed module 100 of the slurry and/or chemical blend supply apparatus 20 comprises one or more pipes or connections 29A, 29B that are attached or otherwise placed into the containers typically through an opening at the top of the slurry supply containers 30A, 30B. The pipe or connections 29A, 29B are sized so that the opening of the pipe (where the slurry enters the pipe) which is located at the end of the pipe is located at or just above (for example one inch or less or within 3 inches above) the bottom of the slurry supply containers 30A and 30B. The slurry and/or chemical blend supply containers 30A, 30B preferably are not pressurized, are at atmospheric pressure, and may be open to the atmosphere so that the pump does not create a vacuum inside the containers 30A, 30B as the slurry is drawn from the containers. The containers may have a lid with an optional filter screen (not shown) thereon to allow for the flow of filtered, dust-free (clean) air into the in-line slurry container. Additionally, as shown in FIG. 1A, in the lines 29A, 29B are strainer components 39A, 39B which capture any debris that may be present or may fall into the slurry supply containers. One embodiment of the strainer component is shown in greater detail in FIG. 10.

Figure 10:
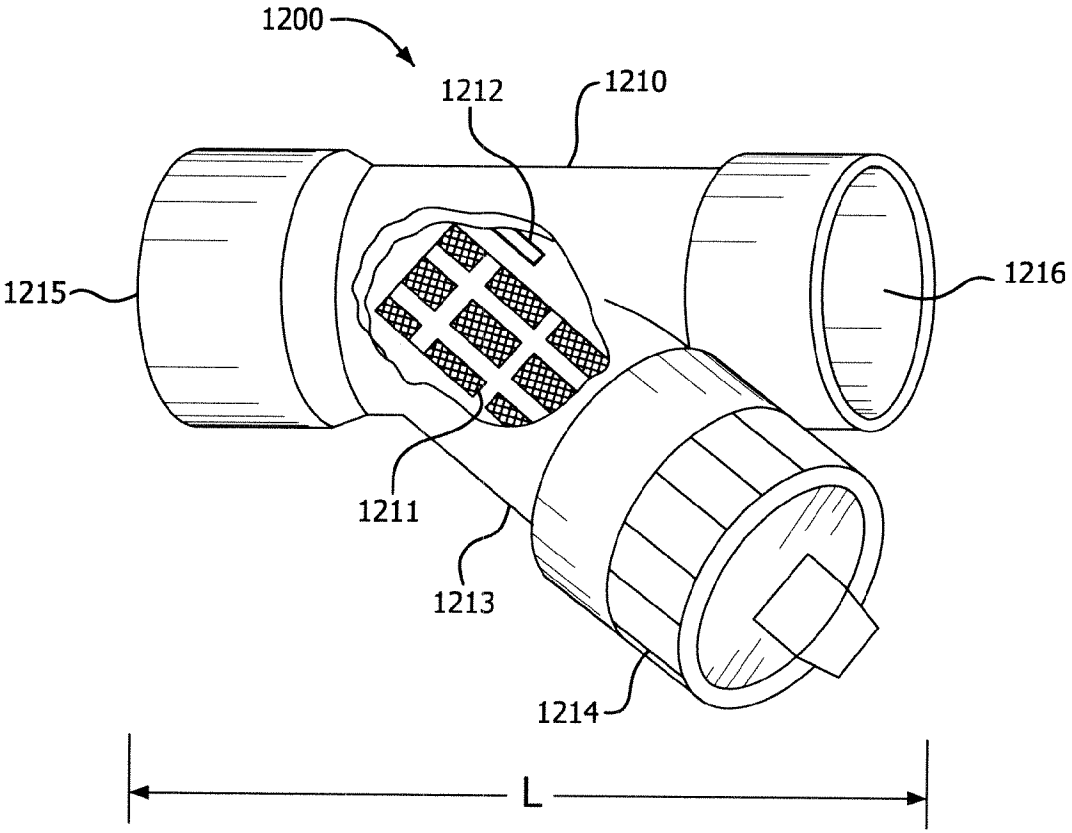
FIG. 10 is a strainer that is useful in this invention.

FIG. 10 shows one embodiment of a strainer component 1200 in cutaway to show the filter 1211 in a housing 1210 that may be connected and used in lines 29A and 29B in the feed module as shown in FIG. 1A. Alternatively or additionally one or more strainer components can be connected and used in one or more lines in one or more of any of the modules (blend, analytical, distribution) of the apparatus. The strainer component comprises a strainer, filter, netting or mesh to capture the debris and preferably has a large enough mesh, filter or other opening size and component flow area and/or flow volume to provide for relatively unhampered and unrestricted flow, meaning that there is only a relatively small pressure drop (e.g. less than 1 psi) through the strainer component. Additionally, the strainer component 1200 may comprise a housing 1210 that defines a flow area and flow volume that may be larger than the flow area and flow volume of the tubing of the same length L that is connected to the strainer component and provides for the flow of the slurry and/or chemical blend to and through the strainer component 1200. The strainer component comprises a fluid inlet 1215 and fluid outlet 1216 that are each connected to the pipe (not shown in FIG. 10) that transports the fluid to and from the strainer component 1200. The strainer component 1200 as shown further comprises a cylinder shaped filter 1211 and optional one or more internal flow directors 1212 that direct the flow of the slurry and/or chemical blend through the filter 1211 through the fluid outlet 1216 and to the pipe downstream of the strainer component 1200. As shown, the strainer component 1200 has a trap 1213 into which the filter 1211 may be extended. The trap 1213 also provides room to hold (larger) debris and a threaded clean-out cap 1214 for cleaning out any debris that is present in the slurry and/or chemical blend that passes through the fluid inlet 1215 but does not pass through the filter 1211.

In one aspect of this invention, this invention provides a slurry and/or chemical blend supply apparatus comprising one or more optional strainer components. The strainer components can be used in any one or more of the modules, in any embodiment of the slurry and/or chemical blend supply apparatus of this invention. It is beneficial to add a strainer component in the line before the slurry transfer pump 31 in feed module 100 to prevent debris that may fall into the slurry supply container from being pumped into the feed tank. It also provides the additional benefit of providing a means for breaking up or capturing any agglomerated particles that may have formed in the slurry supply container and is present in the slurry. For that latter reason, it may also be beneficial to add a strainer component in any of one or more other lines in the apparatus 20 to capture any larger particles that may be present in the slurry and/or chemical blend. Although, in the present slurry and/or chemical blend supply apparatus, smooth pipes and fittings are used, and dead legs are reduced in number and size and/or eliminated in favor of circulating loops, it is still possible that agglomerated particles may form at bends, junctions and dead legs. For that reason it is beneficial and preferred to add one or more strainer components to one or more pipes in one or more modules or in the pipes between one or more modules of the slurry and/or chemical blend supply apparatus. The strainer components are particularly beneficial when present up stream of connectors or features having restricted or narrow openings, such as before flow controllers (particularly in the blend module or the analytical module), needle valves and the like and/or before one or more sensors or one or more analytical apparatuses. The strainer components help to remove and thereby prevent any larger particles present in the slurry and/or chemical blend from plugging up any small orifices in the apparatus. The filter or mesh used in the strainer component preferably has a mesh size of from 0.050 to 1.2 millimeters (mm) or from 0.1 to 0.9 mm or from 0.4 to 0.6 mm mesh size. It is preferred that the one or more strainer components in the apparatus 20 are cleaned out or changed out (removed and replaced) every six months to a year and can be changed more or less frequently depending upon the characteristics of the slurry and/or chemical blend.

In alternative embodiments of the slurry or chemical blend supply apparatus, a simple strainer or flat filter or the like inserted in the cross-section of the tubing (although less preferred) could be used as the strainer component; however, it would be more preferred if the simple strainer, flat filter, or the like, were mounted in the cross-section of a tube with a larger cross-section than the pipes upstream and downstream to which it was connected. Stainer components like the one shown in FIG. 10 are commercially available from, for example, IPEX.

Two slurry supply containers 30A, 30B each containing undiluted concentrated slurry are shown in FIG. 1A as being connected to or at least in fluid communication with the slurry and/or chemical blend supply apparatus 20 via pipes 29A, 29B. Via valving (not shown), preferably only one slurry supply container is pumped at a time, although in alternative embodiments, with more than one slurry transfer pump or a strong slurry transfer pump, multiple containers could be pumped simultaneously. As shown, slurry transfer pump 31 via suction and piping 29A, 28, 27 transports slurry from the container 30A to a day tank (feed tank) 80. When the slurry transfer pump 31 is transporting slurry from slurry supply container 30A there is a valve (not shown) in line 29B that is closed and a valve (not shown) in line 29A that is open. The feed module may have optional circulation or return piping 32A back to the slurry supply container 30A to form a circulation loop for circulating the discharge from the slurry transfer pump 31 (that was drawn from slurry supply container 30A) back to the container 30A. The circulation loop comprises piping 29A, pump 31 and return piping. When a new container is brought on line, it is preferred to circulate/recirculate the slurry through the circulation loop for a set period of time to disperse the particles in the fluid of the slurry. After the set period of time, the circulation loop is closed via valves (not shown) in the return piping 32A and by opening optional valves (not shown) in pipe 27 and the slurry pumped from the slurry supply container is then transported to the day tank 80. Alternatively, by partially opening and closing the valves (not shown) in pipes 32A and 27, some slurry could be circulated in the circulation loop and some could be transported to the feed tank 80. Alternatively, although not shown, a separate pump and circulation loop could be provided that would circulate the slurry out of and back to the container in preparation of bringing it on-line for transport of the slurry to the day tank (feed tank) 80. Having a separate pump and circulation loop for circulating the slurry from the slurry supply container would make it possible, if desired, to simultaneously circulate the slurry in one or more slurry supply containers using a circulation pump and transfer slurry to the feed tank using the feed pump. Further, containers 30A and 30B could each optionally have mechanical stirrers 11A and 11B as shown, instead of or in addition to circulating lines 32A and 32B (or circulation loops) to keep the slurry in dispersed and suspended form prior to and/or during either or both of the processes of transferring the slurry from the slurry supply container(s) to the day tank(s) and/or pumping and circulating the slurry from and back to the slurry supply container(s).

The slurry transfer pump 31 may be any type of pump. Since access to the slurry in the slurry supply container 30 is typically from the top of the slurry supply container as just described, a diaphragm pump that has lifting power and which can run without cavitating when lifting slurry via suction out of the container all the way to the bottom of the slurry supply container 30 is preferred for the process. One benefit of using the diaphragm pump is that little, if any, slurry from the slurry supply container 30 is wasted. The apparatus (feed module) may comprise a flow sensor 33. The flow sensor 33 may be provided in the line preferably upstream of the slurry transfer pump 31 and is used to signal to the controller (not shown) an empty slurry supply container. The flow sensor may be a simple sensor for example, a light sensor or a capacitive sensor, such as a Balluff sensor, that detects the different capacitance of the liquid (slurry) compared to air. When there is no slurry present for a period of time, the valves (not shown) that are in lines 29A and 29B may under control of the controller automatically switch from open to closed and closed to open by electrical signals from the controller (not shown), so that suction via pump 31 is applied to the slurry supply container 30B, or alternatively, the pump 31 stops pumping and signals a technician to replace the empty slurry supply container. Alternatively, the apparatus may be manufactured to include (comprise) other types of sensors including weight sensors or level sensors for the slurry supply container that may be used to indicate when a slurry supply container is empty which may cause a switch from an empty slurry supply container to a full slurry supply container.

When a switch is made from one slurry supply container to another, for example from slurry supply container 30A to 30B, preferably the slurry is pumped through the recirculation loop for a period, typically from 1 to 120 minutes, 2 to 30 minutes, 2 minutes to 5 minutes before the slurry is transported via the slurry transfer pump 31 to the day tank (feed tank) 80 from the slurry supply container. While slurry supply container 30B is being pumped, empty slurry supply container 30A can be disconnected from line 29A and a slurry supply container with slurry therein can be attached to or otherwise put into fluid communication with line 29A.

The slurry transfer pump 31 is preferably sized so that it can pump 40 to 250 liters/minutes or 90 to 210 liters/minutes or about 140 liters/minutes of slurry thereby making it possible to empty a drum in less than 1 hour, or less than 30 minutes, or less than 15 minutes. Additionally the diaphragm pump typically has 10 to 30 or 15 to 21 feet of suction lift and/or approximately 125 psi of discharge pressure. Pump performance is limited by the air-pressure supplied. To obtain the maximum pump performance, the regulator supplying the pump could supply the maximum pressure that the pump is capable of handling; however, the impact on the slurry must be considered and a lower pump speed may be required for some slurries.

As shown in FIG. 1A when pump 31 draws the slurry from slurry supply container 30B, the slurry flows through line 29B, strainer 39B, flow sensor 33, slurry transfer pump 31, line 27 to day tank (feed tank) 80. If all or part of the slurry exiting the pump is to be circulated back to drum 30B, valves (not shown) in line 27 and 32B are closed and opened respectively.

The feed module 100 may optionally comprise a particle counter and/or particle size distribution analyzer 34 that analyzes slurry that flows into the slip stream 35. The slip stream 35 is sized so that a small portion of the slurry in line 27 that is being transported to the day tank (feed tank) 80 flows to the liquid particle counter and/or particle size distribution analyzer 34. The particle counter and/or particle size distribution analyzer 34 can be used continuously or intermittently to check the quality of the slurry. The particle counter and/or particle size distribution analyzer 34 may be used only at the beginning of the transfer of slurry from a recently attached slurry supply container for which the initial recirculation period has ended and transfer to the day tank (feed tank) 80 is just beginning. The particle counter and/or particle size distribution analyzer 34 checks the quality of the slurry by checking that the number of particles/volume of slurry present in the slurry and/or by determining if the size range and size distribution of these particles are within the desired ranges. To be useful some particle counters require that the slurry is diluted prior to analyzing the number and size of the particles present. It is also possible to use particle counters and/or particle size distribution analyzer that do not require dilution of the slurry before analyzing the number and sizes of particles. As shown the slurry that is transported to 34 is diluted and dumped alternately for particle counters that do not dilute the slurry, the slurry can be returned to line 27 and fed to the day tank 80.

Alternatively or additionally, one or more particle counters and/or one or more particle size distribution analyzers could be provided in recirculating lines 32A and 32B to determine when the slurry is sufficiently agitated and in suspension to begin pumping the slurry to the day tank (feed tank) 80. If particle counter and/or particle size distribution analyzer 34 indicates that the slurry is not within the desired range, the valves (not shown) in line 27 and either recirculating line 32A or 32B are switched from open to closed and closed to open respectively to cause the slurry to enter the recirculation loop instead of being transported to the day tank (feed tank) 80. If the particle counter and/or particle size distribution analyzer 34 indicates that the slurry in the drum is so far out of specification, the open and closed valves (not shown) in lines 29A and 29B to the supply drums 30A and 30B may be switched and an operator called to replace the drum containing the slurry that is out of specification and test its contents off-line.

Alternatively, if the one or more particle counters and/or one or more particle size distribution analyzers determines that the slurry (raw or blended) is out of specification, an algorithm provided in the one or more particle counters and/or one or more particle size distribution analyzers or in the controller for the apparatus using the information communicated to the controller for the apparatus could determine how the slurry is out of specification and if the apparatus can fix the out-of-specification slurry, and if yes, the controller could direct the slurry to an appropriate treatment. For example, if the one or more particle size distribution analyzers determines that there are too many large particles present in the slurry, then the apparatus via automatic controls provided by the apparatus could direct a portion or all of the slurry to a treatment means e.g. to a filter element, e.g. a filter or bank (that may be provided in its own filter loop to remove a portion or most of the particles above a certain size). Adjustable valves in the pipes could be provided to direct the desired portion of the slurry toward the treatment means depending upon the amount of out-of-specification particles present in the slurry. The apparatus could comprise different filter elements comprising different filters for filtering various size particles, especially if the apparatus blends and supplies more than one type of slurry. Additionally, if the slurry has too many small particles, as determined by the one or more particle size distribution analyzers, then all or a portion of the slurry could be directed into a treatment means to remove the small particles. One such means, could involve one or more streams (that many be split streams), one or more membranes, one or more filters and one or more return streams. For example, a slip stream could be provided, for example off of lines 32A and/or 32B with a check valve therein having a downstream membrane that allows only the small particles and a portion of the fluid in the slurry to pass through it to create a separate stream of the slurry having only small particles therein that could be directed to a separate filter for small particles. The portion of the slurry that did not pass through the membrane can be returned in a loop back to the feed module, for example, to the lines 32A and/or 32B or to the raw slurry containers 30A and/or 30B. To prevent the larger particles from plugging up the membrane, the membrane could be continuously or intermittently vibrated or intermittently the flow through the membrane could be reversed. For example, after filtering out the small particles the filtered slurry that previously passed through the membrane (having few if any particles therein) or banks of membranes, may be returned to the raw slurry by flowing it back through the membrane. Alternatively or additionally, two or more parallel membranes or banks of membranes, each having piping and valving associated with each membrane (or banks of membranes) could be provided and used. The flow of slurry through the membrane(s) could be directed away from a plugged membrane (as determined by an increase in pressure) to one that is not in use, at which time the flow of filtered slurry (without the small particles that were removed by the filter) could be reversed through the plugged membrane to clear the larger particles from the plugged membrane and thereby reconstitute the raw slurry with the larger particles that did not pass through the membrane. After a period when the membrane that is allowing the small particles to flow therethrough becomes plugged by the larger particles in the slurry, the operation of the parallel membranes would be switched again and the flow of the filtered slurry would be directed to flow back through the now plugged membrane, while the other membrane is used for allowing the small particles to flow therethrough to the downstream separation of the small particles from the slurry via a filter. It may be necessary after a period of use that the membrane be replaced or be cleared of large particles by a reverse flushing with water (DIW or UPW) and the resulting fluid comprising the water and the particles removed from the membrane could be discarded or recycled. (The mechanism for switching between parallel membranes would be similar to the mechanisms for switching between parallel filters described elsewhere herein.) The filter used to remove the small particles could also be parallel filters or banks of filters that are switched from one to another upon an increase in pressure through the filters or banks of filters as described elsewhere herein. (In alternative embodiments, a portion of or all of the raw slurry could be treated by a treatment means to remove small particles from the raw slurry before pumping the raw slurry into the feed tank or before flowing the raw slurry to the blend module. The treatment means could be incorporated into the feed module and used to treat the raw slurry as it circulates in the circulation loop, similar to the filter 230 shown in FIG. 2.)

Flow to the particle counter and/or particle size distribution analyzer of slurry or chemical blend and/or optional water for dilution (if dilution of the slurry or chemical blend sample is required by the analytical apparatus, e.g. particle counter and/or particle size distribution analyzer) is controlled by one or more: pressure sensors (not shown), flow controllers (not shown) and/or peristaltic pumps (not shown) and/or valves, (particularly needle valve(s)) in conjunction with the pressure from the diaphragm or other pump. Embodiments of the apparatus and method for the supply of slurry or chemical blend and/or ultra pure water (UPW) or DIW (deionized water) to an analytical apparatus (the UPW or DIW may be provided for the purpose of diluting the sample and/or rinsing the apparatus after the analysis of a sample is complete), are described below in conjunction with FIGS. 12, 13 and 14.

Samples may be taken from different parts of the feed module and transported via tubing to the liquid particle counter and/or particle size distribution analyzer 34. For example as shown in FIG. 2, ports 1000 and tubing may be provided before and after the filter 230 to check the particle sizes, numbers of particles and/or distribution of the particle sizes. (The tubing is not shown.) If the liquid particle counter dilutes the slurry prior to analyzing the sample, the slurry sample will be directed to a waste line after it is analyzed. If the liquid particle counter and/or particle size distribution analyzer does not dilute the sample, the slurry may be returned to the feed module at port 1001 via a sample loop (not shown). The sample taking is controlled by the controller (not shown), for example, a computer or PLC or the like. In alternative embodiments, ports 1000A, 1000B and 1001 and sample tubes and/or sample loops attached thereto, may be used to transport slurry to an analytical module that is part of the slurry supply (and chemical blend supply) apparatus. The liquid particle counter and/or particle size distribution analyzer 34 in the feed module 100 may be in addition to or instead of one or more analytical modules. In alternative embodiments, the liquid particle counter and/or particle size distribution analyzer 34 is one or more analytical apparatuses that are part of an analytical module (that may or may not comprise other analytical apparatuses) that may be located in the feed module 100 or elsewhere in the slurry and/or chemical blend supply apparatus. In those embodiments, a chemical blend may be diluted, and/or analyzed and discarded or returned to the apparatus.

Figure 2:
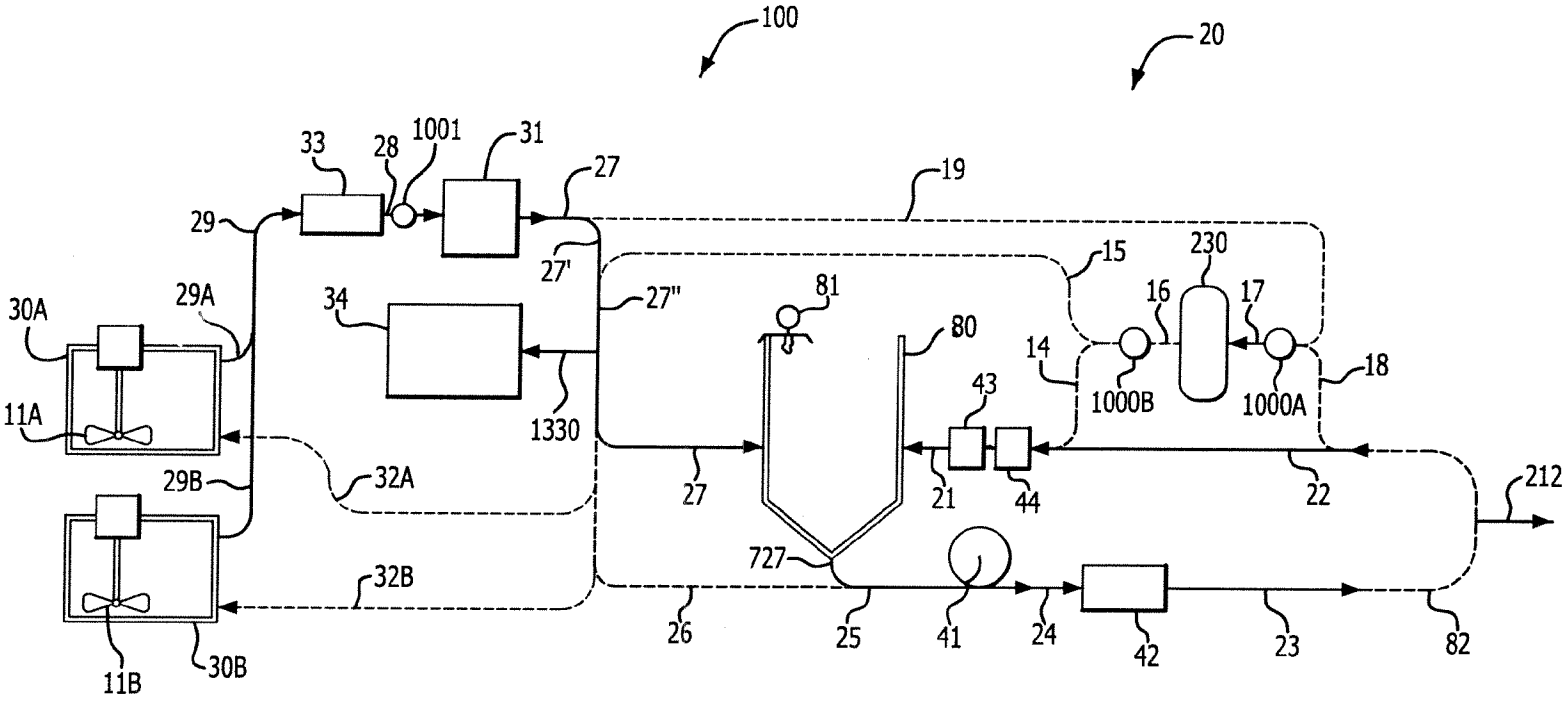
FIG. 2 is an alternative embodiment of a feed module useful in a slurry and/or chemical blend supply apparatus of this invention.

As shown in FIGS. 1A and 2, between slurry transfer pump 31 and day tank (feed tank) 80 is provided an optional tank bypass line 26. Tank bypass line 26 can be used when day tank 80 is taken off line, for example, for cleaning, or to address a contamination issue, or if the blend module is calling for an immediate supply of slurry, or for any reason that requires that the day tank 80 be by-passed. When the tank bypass line 26 is being used in a process (when the day tank 80 is not being used), it is preferred that a circulation line (not shown) is also in use to circulate the slurry back to the slurry supply container 30A (or 30B). The circulation line (that is not shown) would connect line 21 (upstream of the day tank (feed tank) 80) to the one or more slurry supply containers that slurry is being drawn from and bypass the tank 80. As shown in FIG. 1A, tank bypass line 26 is used by opening a valve (not shown) in the line 26 and closing a valve (not shown) in line 55 that is located between the connection with the bypass line 26 and before day tank 80. The bypass line can be used to directly and quickly deliver slurry to loop 82 and thereby to line 212 to the blend module if desired or needed.

Line 27 feeds slurry from the slurry supply containers 30A, 30B to day or feed tank 80 when the valves (not shown) in bypass line 26, and slurry supply container circulation loops 32A and 32B are closed or partially closed, typically fully closed.

In the embodiment shown in FIG. 2, the feed module 100 of the slurry feed apparatus 20 may comprise one or more filters (filter elements) 230 (one filter is shown) and connection lines therebetween to filter all or a portion of the raw slurry: (1) from the one or more slurry supply container(s) 30A, 30B and return the filtered raw slurry back to the one or more slurry supply container(s) 30A, 30B, (2) from the one or more slurry supply containers 30A, 30B and transport the filtered raw slurry to the day or feed tank 80, or (3) from the day or feed tank 80 and transport the filtered raw slurry back to the day or feed tank 80. In the process labeled (1) in the list above, the slurry transfer pump 31 causes the flow of raw slurry from slurry supply container 30A (for example) to flow through the pipes 29, 28, 27, a valve (not shown) in pipe 27' is closed and the raw slurry flows through pipe 19 to pipe 17 into the filter 230. (The flow of raw slurry does not enter pipe 18 due to a closed valve or check valve (not shown) in pipe 18.) After passing through filter 230 to line 16, the raw slurry may be returned via line 15 to line 27, in the section of the line labeled 27" in FIG. 2 when a valve (not shown) in line 14 is closed. From there, the slurry is returned to one of the slurry supply containers via line 32A or 32B. Alternatively, in the process steps just described, if after filtering the slurry, a valve (not shown) in line 15 or 27" were closed, then the flow of the filtered slurry and/or chemical blend from the filter 230 would go through line 14 and into day or feed tank 80.

Alternatively, the valve (not shown) in line 27' may be partially open to direct part of the stream in line 27 to the filter 230 and part of the stream to tank 80. One or more of the other valves (not shown) described in lines 18, 14 and 15 may be partially open, thereby splitting the flow between connected lines.

Note that in an alternative embodiment (not shown) the apparatus may be provided (manufactured) comprising separate filter loop comprising a pump in a separate piping loop having one or more filters (optionally the filters may have differing pore sizes and optionally the filters may be arranged in one or more filter banks) in the piping loop to filter the slurry from and provide it back to one or more of the slurry supply containers. Alternatively, an apparatus of this invention may be provided with one or more filter loops that may filter the slurry from one or more of the slurry supply containers and provide it to one or more day tanks and/or from one or more day tanks and provide it back to the one or more day tanks and/or from one or more of the other tanks (e.g. distribution or storage tanks) and provide it back to the one or more of those other tanks. Alternatively the filter loop may filter a portion or all of the slurry or chemical blend in any pipe (e.g. a loop) in the slurry and/or chemical blend supply apparatus and return the slurry or chemical blend to the same pipe from which it was drawn or to an alternative location in the slurry and/or chemical blend supply apparatus, which may include pipes or tanks in the same or different module(s). For example, slurry or chemical blend could be taken from the global loop, filtered, in a filter loop and returned to the global loop and/or returned to the distribution tank. In another embodiment blended slurry or chemical blend could be taken from the blend module, filtered in a filter loop and returned to the blend module and/or returned to the global loop.

One of the benefits of providing a separate filter loop (a separate filter loop is shown in FIG. 1C for the distribution module 400) with its own filter loop pump is that the loop could be designed so that the one or more filters in the loop could have very small pore sizes for example less than <0.5 micrometers. The pump in the separate filter loop could be a high pressure pump and the tubing and tubing connections used in the filter loop could be stronger to withstand the potentially higher pump pressure required for the filter having smaller pores. In contrast, using an in-line filter with small pores and a pump at higher pressure that is not in its own filter loop, for example between a slurry supply container and the day tank presents a higher risk of causing a feed module shut-down. If the filter is in-line and not in a separate filter loop and it gets plugged or the operating pressures are higher than the tubing can stand, a tube may burst and the flow will have to be stopped to, for example, the blend module. (Although the distribution module of the slurry and/or chemical blend supply apparatus of this invention could continue to function even if the blend module stopped blending slurry or chemical blend until the blended slurry or chemical blend in the distribution tank is depleted, it is still not desirable to stop the flow to the blend module due to filter problems/issues.) Alternatively, if the separate pump for the filter loop or the filter and/or the piping in the filter loop goes down for any reason, with the closing of one or two valves in the loop lines to and/or from the one or more filters, the filter loop could be isolated from the rest of the apparatus. Although the circulation of slurry or chemical blend in the filter loop may stop, the slurry or chemical blend can still flow past the piping to the filter loop isolated by a closed valve (not shown) through the apparatus and provide slurry or chemical blend to and through the distribution module to the tools or elsewhere in a manufacturing line. For example, although the circulation of slurry in a filter loop may stop in a feed module, the raw slurry can still flow to the day (feed) tank and thereon, such that the apparatus can continue to blend in the blend module and provide blended slurry to the distribution module and from the distribution module to the CMP or other tools.

If filtering the slurry (or chemical blend) is required and difficult to do because of the slurry (or chemical blend) characteristics, redundant filter loops or parts of the filter loop (e.g. the pump or the filter(s)) can be provided as backup. The filter loop(s) may comprise two or more filters or two or more banks of filters, each having pipes to and from the filters or bank of filters and valves in the pipes, so that the flow of slurry (or chemical blend) can be quickly switched from one filter to another or one bank to another when the flow through one filter or banks of filters decreases and the pressure in the tube leading to the filter begins to rise. This invention provides a slurry and/or chemical blend supply apparatus comprising one or more filter loops comprising a pump, piping and one or more filters or banks of filters. The filter loops may be used in one or more of the feed module, blend module, analytical module and distribution module or connected to any piping in any embodiment of this invention.

The pore sizes of the filters used in the apparatus 20 may range from 0.1 to 20 micrometers, or from 0.5 to 10 micrometers, or 1 to 5 micrometers. Useful filters are commercially available. Banks of filters may comprise filters that comprise decreasing pore sizes downstream of filters having larger pore sizes, for example, a first filter could have pore sizes between from 15-20 μm, a second filter could have pore sizes between from 10-15 μm and then a third filter could have pore sizes from 5-10 μm.

In FIG. 2 is shown, between the slurry supply container and the feed tank, located in line 27, a liquid particle counter and/or particle size analyzer 34. Liquid particle counter 34 may be an in-line liquid particle counter or one that measures continuously or intermittently the particles in a slip stream that flows to the liquid particle counter. (A slip stream 1330 in FIG. 2, 35 in FIG. 1A draws only a portion of the total slurry stream flowing in the line that the slip stream is connected to.) The slip stream may be diluted prior to entering the liquid particle counter and/or particle size distribution analyzer 34 in order to provide a slurry stream that is within the preferred detection range of the liquid particle counter and/or particle size distribution analyzer. The liquid particle counter and/or particle size distribution analyzer checks that the slurry (or in other embodiments, the chemical blend) has the desired and expected number of particles per volume. Typically the slurry particles in the slurry are 0.1 to 2 microns or 0.5 to 1 micron and have an expected mean particle size and size distribution. The flow of the slurry (or chemical blend) into the liquid particle counter and/or particle size distribution analyzer is typically about 40-80 ml/min. If the slurry (or chemical blend) was first diluted before the liquid particle counter analyzes the diluted slurry (or chemical blend), the amount of dilution is carefully controlled and the controller (not shown) or control system for the liquid particle counter takes into consideration the amount of dilution when analyzing the results. Embodiments of piping and related components to control the flow and dilution of the slurry (or chemical blend) for the liquid particle counter or other analytical apparatus, which are part of an analytical module will be described herein in conjunction with FIGS. 12, 13, 14. Typically, particle counters work by laser diffraction. Useful types of particle counters that can be used in the apparatus of this invention include Slurry Scope from Vantage Technology Corp. and a Liquidlaz S05 and S02 from PMS, and KS-71 from Rion Co., Ltd. Typical particle size analyzers work by dynamic light scattering utilizing laser light and flow though cell to measure mean particle size and size distribution of sub micron size particles. Useful types of particle size distribution analyzers that can be used in this invention include ZetaSizer Nano S, ZetaSizer Nano ZS, Malvern Instruments, Ltd. Such an instrument can measure the particle size distribution in a particle size range of 0.3 nm to 10 micron, or 3 nm to 100 nm. The measured solid particle concentration range may be from 10 mg/ml solid up to 40% (w/w) or from 0.01 to 20% w/w. Additional particle distribution parameters that can be measured by a particle size distribution analyzer and used to monitor and control the slurry (or chemical blend) include distribution width, polydispersity index, modality, bin distributions at specific % like d10, d50, and d99 of the measured CMP slurry (or chemical blend).

Regarding both FIGS. 1 and 2, when the slurry and/or chemical blend supply apparatus 20 is operating (after the optional initial recirculation loop out of and back to the slurry supply container), the pump 31 pumps for a period of time drawing slurry from at least one slurry supply container (30A or 30B) to fill the day or feed tank 80 with raw slurry. When the day tank 80 is filled to a preset level (a minimum fill level) as detected by level sensor 81, which may be an ultrasonic level sensor, pump 41 begins to pump raw slurry around a circulation loop or raw slurry loop 82. In normal operation, as long as slurry is present in the day tank 80 above a minimum fill level, the pump 41 pumps the slurry from the day tank 80 through the raw slurry loop 82 that returns via return 21 the slurry or at least part of the slurry to the day tank 80. The slurry loop 82 is shown attached to the exit opening 727 (see FIGS. 7 and 8) of tank 80 comprising lines 25, 24, 23, 22, and return 21, pump 41, and/or flow sensor 42, and/or pressure sensor 44, and/or back pressure controller 43 and tank 80. The pump 41, flow sensor 42, pressure sensor 44 and the back pressure controller 43 may work together to maintain a steady flow of slurry through the loop 82. The pump is preferably a smooth running magnetically levitated centrifugal pump that is run at a constant or near constant speed or in closed loop control mode, constant or near constant pressure or flow rate. The flow sensor 42 measures the flow rate (which may be a mass or volumetric flow rate, preferably volumetric flow rate) of the slurry in the loop downstream of the pump which may be compared with a set point by a controller (not shown) such as a computer or the like for the apparatus and/or a controller associated with the pump for the flow rate and that information can be used, using feedback controls via the controller (not shown), to adjust the speed of pump 41. The pressure sensor 44 measures the pressure in the line and transmits that value to the controller which compares it to a pressure setpoint and using a proportional-integral-derivative (PID) calculation in the controller, the valve in the back pressure controller 43 is adjusted which results in an adjusted pressure in the line. The pressure is set so that it is always kept above a minimum pressure, so that the slurry always fills the loop 82, but below the pressure that would cause a break in the line. Maintaining the pressure in the line 22 above the minimum pressure prevents the development of air pockets in the line and the intermittent flow of the slurry. The exposure to air is undesirable and causes compositional degradation of many slurries. Additionally, an uneven or non-continuous flow rate (and pressure) of the slurry in the loop will be detrimental to the accurate measurement of the amount of slurry flowing through the flow meter(s) for the raw slurry used in the blend module 200. If the pressure and the resulting flow rate in the loop 82 are not controlled and not continuous and not smooth, then the flow rate of raw slurry and/or chemical blend into the blend module via line 212 that is in fluid communication with the loop 82 will be intermittent and varied resulting in a blended slurry and/or chemical blend with varying amounts of raw slurry and/or chemical blend added to it. That is not desired.

Typical pump speeds for pump 41 in the feed module may be from 20 L/minute (LPM)+/−5 LPM and the speeds can vary between 1000 to 8000 RPM. For each pump there is provided a flow sensor/transmitter that controls the speed of the pump. This control can be accomplished by direct communication between the flow sensor/transmitter and the pump or via the controller for the apparatus. Examples of useful pumps include Levitronix BPS-4 and BPS-2000 and BPS-600 and others. It is not preferred to use a diaphragm or pulsing pump in the feed module downstream of the day or feed tank 80, because the resulting discharge flow from those pumps is not without variance in flow and pressure, that causes the blending accuracy in the blend module to be degraded. The flow rate sensed by the flow sensor is typically between from 10 to 30 LPM or from 15 to 25 LPM or from 18 to 22 LPM. The pressure may be between from 5 to 50 psi or 18 to 32 psi or 20 to 30 psi or 24 to 26 psi, in the circulation loop 82.

It is desirable that the flow sensor 42 and pressure sensor 44 and all or most of the sensing devices and analytical apparatuses used in the apparatus can extract measured values as an electrical signal, such as an ultrasonic, vortex, electromagnetic, paddle wheel mechanical-type or differential pressure flow meter, a wet and dry pressure meter and the like. The outputs are sent through signal lines (not shown) to a data logger for storage and to a controller (control device) that comprises a computer (not shown) that controls the entire slurry and/or chemical blend supply apparatus 20. Similarly it is preferred that the majority of the valves such as pneumatic valves present in the apparatus can be controlled by the controller that controls the entire slurry and/or chemical blend supply apparatus 20.

Line 212 in FIG. 1A and FIG. 2 transports the slurry from the feed module 100 to the blend module 200. Line 212 connects the raw slurry loop 82 to the blend module 200. Line 212 has a solenoid 2-way valve (not shown) that is opened when the blend module is ready to start blending slurry. The valve is not in line 82. When the valve (not shown) in line 212 is opened, it is opened such that only a portion of the raw slurry from the raw slurry loop 82 flows into line 212. When a portion of the slurry in loop 82 flows into line 212 to the blend module 200, the drop in the pressure in line 22 is sensed and/or measured by the pressure meter 44, which measures the decrease in pressure in line 22, communicates the decreased pressure measurement to the controller (not shown) and the controller in response to decrease in pressure in line 22 communicates to the back pressure controller 43 to restrict the flow therethrough by adjusting the proportional valve in the back pressure controller 43, thereby causing an increase in the pressure upstream of the back pressure controller 43 in the line (in line 22). In the preferred embodiment the back pressure control in the blend module comprises the back pressure controller 43 and the pressure sensor 44. Additionally or alternatively the controller (not shown) may, by using the measurement from the pressure sensor, send a signal to the pump 41, to tell the pump 41 to increase its speed and thereby supply more raw slurry to the loop 82. Alternatively, or additionally the pump can be controlled separately using the measurement from the flow sensor.

Note in the description of the feed module, the use of the term "day tank" is not meant to be limiting in any way. The day tank holds a sufficient amount of unblended or raw slurry, such that volumes of slurry can be drawn from the day tank 80 for a period of time, (which may be a fraction of, 1, 2, or 3 or more hours, or a fraction of, 1, 2, 3 or more days or weeks) and used to make the blended slurry in the blend module and then used by the CMP or other tool(s) for a period of time, such that raw slurry does not have to be continuously pumped from the slurry supply containers and can be added to the day tank(s) on an intermittent basis which may be the result of a controller that directs the slurry transfer pump 31 to only operate based on the readings from the level sensor 81. Unblended slurry is not typically sensitive to degradation over time as compared to blended slurry, so the raw slurry can be stored in the day or feed tank(s) for days or weeks if necessary prior to its use.

By opening a valve (not shown) in line 212, that connects and is between the circulation loop 82 and the blend module 200, raw slurry is provided to or flows to the blend module 200. In one embodiment of the blend module 200, it comprises one or two or more static mixers in one or two or more lines. The static mixers may be located, such that upstream of at least one of the static mixers two or more lines are combined into a single line, and wherein flowing through each line is at least one component of the blended slurry or chemical blend. In an alternative embodiment of the blend module 200, it comprises one or more pumps with at least one pump located at or downstream of one or more junctions where two lines merge together into a single line in which one or more components of the slurry or chemical blend in each line are blended into a single line of blended slurry or blended chemical blend or partially blended slurry or partially blended chemical blend. (A partially blended slurry or partially blended chemical blend stream is the resulting stream from the combination of at least two component streams that are combined into a single stream in one or more steps or stage in the blend module. A partially blended slurry stream may or may not comprise raw slurry. The raw slurry may be combined with the partially blended slurry stream in a later step or stage in the blend module. In an alternative embodiment, in which a chemical blend is made in the blend module, a partially blended chemical blend stream may be combined with a chemical stream or a water stream to form the blended chemical blend stream in the blend module.) In alternative embodiments of the blend module 200, the blend module comprises one or more pumps and one or more static mixers. The blend module preferably does not comprise one or more mixing tanks, or separate containers or scales to measure the volume or weight of the components of the slurry or chemical blend prior to, during or after blending. The amounts of the individual components that are blended are controlled by controlling the flow rates of the components through the blend module 200 of the apparatus 20. In normal operation, the flow and combination of the individual components in the blended slurry or chemical blend is continuous while the slurry or chemical blend is blended. The flow and combination of the individual components occurs in parallel continuous flowing and optionally one or more combining stages in the blend module when the controller (not shown) calls for slurry or chemical blend to be blended.

Blending raw slurry, water and the one or more chemicals, may cause the slurry and the particles therein to undergo a chemical change and the particles in the suspension may become agglomerated, that is, they stick to each other, forming larger particles that may fall out of suspension or create a slurry with particles that are too large and therefore not desired in the slurry. (Large slurry particles have the potential to scratch the surface of the wafer when used in a slurry formulated to have smaller particle sizes to planarize the wafer.) Although not wishing to be bound by theory it is believed that pH shock is responsible for the agglomeration of particles when the blended slurry is formed. The number and size of the particles in solution in the slurry is at least partially due to the charges on the particles, which are affected by the pH of the suspension. Upon the addition of chemical additives that have a low or high pH, for example, acids or bases, the charges on the slurry particles will be impacted. Changes to the charges on the particles will cause weaker charged particles (near the isoelectric point) to attract and stick to each other and potentially form larger particles that will upset the desired particle size distribution, and/or the number of particles suspended in the slurry, and/or create particles that are above the maximum desired particle size in the slurry. The inventors believe that the pH shock to the slurry is reduced: (1) when the components to make the blended slurry are combined while flowing them simultaneously and continuously or semi-continuously into a single tube and then to a distribution tank that is used to supply one or more tools simultaneously and/or continuously or semi-continuously as compared to the combination of components in a batch process in a tank, and/or (2) when liquid component stream at or near the desired pH (e.g. the pH of already blended slurry) is combined with one or more components of the slurry to be blended that are not at the desired pH, and/or (3) when blended slurry components are quickly mixed using a pump, and/or (4) when the slurry components are combined in stages, and/or (5) when the raw slurry is last to be combined with the already combined rest of components of the slurry, and/or (6) when using a split mixer in the blend module, and/or (7) any combination of the (1), (2), (3), (4), (5) and/or (6). Also, the inventors believe that due to the potential for pH shock anytime the components of a blended slurry are combined, it is beneficial to follow the combination of the components of a blended slurry with a filtering step to remove any agglomerated particles formed during the blending steps before providing the blended slurry to the distribution module.

Although typically the components used to make a chemical blend (non-slurry containing chemical blend) do not have any particles present in the feed streams, there is always a potential that particles will form in the partially blended chemical blend streams or in the fully blended chemical blend or there may be adverse chemical reactions between the components when combined; therefore, it is beneficial to combine the component streams: (1) while flowing them simultaneously and continuously or semi-continuously into a single tube and then flowing the chemical blend to a distribution tank that is used to supply one or more tools simultaneously and/or continuously or semi-continuously as compared to the combination of components in a batch process in a tank, and/or (2) such that a component stream at or near the desired pH (e.g. the pH of finally blended chemical blend) is combined with one or more components of the chemical blend to be blended that are not at the desired pH before combination with other components that are also not at the desired pH, and/or (3) by combining them into a single pipe and quickly mixing them by flowing them through a pump, and/or (4) in stages, and/or (5) when the highest pH component is combined in the last stage with the already combined other components of the chemical blend, and/or (6) by using a split mixer in the blend module, and/or (7) any combination of the (1), (2), (3), (4), (5) and/or (6). Also, the inventors believe that due to the potential for pH shock anytime the components of a chemical blend are combined, it is beneficial to follow the combination of the components of a chemical blend with a filtering step.

Integrated chip manufacturers are very particular about the particle size and the particle size distribution in their CMP slurries, especially that the slurry must not contain any particles larger than a maximum allowed particle size. If the agglomeration is severe, the resulting blended slurry will not be within the CMP slurry specification and the slurry will have to be dumped and new slurry will have to be blended. The same problem may arise with the blending of chemical components in a chemical blend. One way to avoid agglomeration is to slowly and carefully blend the components of the blended slurry (or chemical blend) one at a time in a tank with mechanical stirring; however, that is a time consuming and inefficient process and a process that may still be subject to pH shock.

The inventors have come up with a way to make a blended slurry and/or chemical blend while maintaining the chemical characteristics of the blended slurry or chemical blend. The method and apparatus quickly combines the components of a blended slurry or chemical blend while limiting and/or preventing the potential negative impact of any agglomeration due to the blending method or apparatus.

One way to avoid a fluctuation in the chemical characteristics of a slurry or chemical blend when mixing the components of a blended slurry or chemical blend and thereby minimize or substantially prevent agglomeration or other negative effects is to provide a blending apparatus in which components of the blended slurry or chemical blend are combined by flowing at least 2 streams comprising different compositions, typically at least one component in each stream, a short distance upstream of a pump and then flowing the combined stream into that pump. Two or more streams are combined into a single stream upstream of the pump. The two or more streams are selected from the group consisting of raw slurry streams, water, chemical streams comprising one or more chemicals or one or more chemicals and water, partially blended slurry streams, fully blended slurry or chemical blend streams, or recycled slurry or chemical blend streams. The term component or component stream will be used to refer to any of the just-listed streams that are blended together to make a fully blended slurry or fully blended chemical blend.

The raw slurry streams means a fresh raw slurry such as Semi-Sperse, PLANERLITE and CoppeReady as supplied by a raw slurry supplier, such as Air Products and Chemicals, Inc., Cabot Microelectronics and Fujimi. Raw slurry is frequently available for purchase from the manufacturers in various containers and sizes of containers, such as, for example, 20 liters, 55 gallon drums (~200 liters) and 300 gallon totes.

The water stream is typically ultra high purity deionized water. (UPW or DIW). Any reference to water added or used by the apparatus of this invention means either UPW or DIW.

The chemical component streams may comprise one or more chemical components, for example, acids, such as, citric acid, HCl, or bases such as NH4OH, KOH or other chemical components such as surfactant (polyacrylic acid), oxidizer (H2O2), inhibitor (benzotriozole) or mixtures of any two or more chemical components in a stream. Additional chemical component streams, particularly when making a chemical blend include potassium periodate, potassium persulfate, ammonium cerium nitrate, and sulfuric acid.

A partially blended slurry stream is a stream that comprises one or more components into which one or more additional components will be blended to create a fully blended slurry stream. The partially blended slurry stream may or may not comprise slurry. For example, a partially blended slurry stream may comprise raw slurry and water, or one or more chemicals and water, or raw slurry and fully blended slurry.

A recycled slurry is a slurry that has been recovered from a CMP polishing tool or otherwise directed through one or more steps that may return the slurry to its original or substantially to its original raw slurry composition. Substantially means to within a few weight percent or a few tenths or hundredths of a weight percent of the original composition. Examples of steps for recovering the slurry include a filtering step to remove the metal and other particles that were cleaned off the wafer and a second filtering or the same filtering step to remove all or a portion of the water content therein. Sometimes just the slurry particles are recovered and new solution is added to reconstitute the raw slurry. The use of the term raw slurry may include all or part of a recycled slurry or it may not include any portion of recycled slurry. Recycled slurry may be fully or partially used as the raw slurry or not anywhere the term raw slurry is used herein. Note the steps to recover and recycle slurry are not part of this invention except that recycled slurry can be used in the apparatus as the raw slurry.

A fully blended slurry means the slurry in its final desirable and useable composition, meaning that the raw slurry has already been combined with the required components in the required amounts to make the fully blended slurry and the resulting fully blended slurry has the desired pH and the desired particle size distribution and density. For example, a fully blended slurry may comprise from 0.1 to 99.9% or 0.1 to 99% or 20 to 80% by weight raw slurry (comprising slurry particles and water), and/or from 1 to 99.9% or 20 to 99% by weight water, and/or from 0.1 to 10% or 0.1 to 2% by weight hydrogen peroxide. For example, another fully blended slurry may comprise from 1 to 25% by weight raw slurry (comprising slurry particles and water), from 65 to 98.9% by weight water, and from 0.1 to 10% by weight potassium hydroxide and/or other additives. When a fully blended slurry is combined with other slurry components to make more of the same fully blended slurry (which may be referred to as "additional fully blended slurry"), the fully blended slurry is made by combining the same slurry components, in the same proportions, that were used to make the fully blended slurry that is being added thereto. The fully blended slurry that is used for combining with the slurry components to make additional fully blended slurry having the same composition as the fully blended slurry may be fully blended slurry that comes from one or more of the following: (1) a circulation loop to/from the distribution tank, (2) the blend module after the slurry is blended, (3) a filtration loop in the blend module, (4) a filtration loop in the distribution module, (5) a global supply loop, (6) the distribution tank, or (7) via a return loop from an analytical module to the blend module. One or more optional pipes connecting the blended slurry sources to the blend module are not shown in the figures except for those described as (5) and (6) in the list. It is preferred that the blended slurry combined in the blend module does not come from the global loop. It is preferred that it is from (2), (3), (4), (6) or (7).

In one embodiment of the methods and apparatuses of this invention, the components are at least partially blended by flowing multiple component streams into fewer and fewer pipes, until there is a single pipe containing all the component streams that are used to make a blended slurry or chemical blend. In one embodiment of the invention, shown in FIG. 1B, the blend module comprises one or more static mixers that are used in those lines. The flow is controlled in the component feed lines using flow controllers. As shown in FIG. 1, for one embodiment of a slurry supply and/or chemical blend supply apparatus the blend module 200 comprises raw slurry feed line 212 from the feed module, that may flow into either or both of lines 212A, 212B and two additional component feed lines 210 and 211 that, for example, may be water and chemical(s) lines, respectively. Component feed line 210 is in fluid communication with lines 210A and 210B. Component feed line 211 is in fluid communication with lines 211A and 211B respectively. Lines 212A, 210A and 211A each have flow controllers therein, respectively 262A, 260A and 261A. As shown, in FIG. 1B, the blend module 200 that is part of apparatus 20 comprises redundant lines 210B, 211B and 212B having separate flow controllers 260B, 261B and 262B respectively therein, in case there is a problem with one or more of the lines 212A, 210A and 211A and/or one or more of the flow controllers 262A, 260A and 261A. The parts of the blend module 200 labeled with the B following the number in the blend module are parts of an optional backup (redundant) blend module. The embodiment shown in FIG. 1B will be described for flow through the parts identified with an A, however, it is understood that the back up B parts of the blend module work the same way and can be used alternatively or simultaneously with A parts in the embodiments. Valving (not shown) in the A and B lines would be opened and closed or partially opened or partially closed to direct the flow of the components to the A-labeled parts and/or the B-labeled parts. It is preferred that the valves are either open or closed.

Flow controllers 261A, 260A and 262A are each preset to control the flow of each component to provide the blended slurry and/or chemical blend with the desired composition. Each flow controller comprises a flow sensor and a proportional valve, for example, a pneumatic valve and control software. The flow sensor measures the flow rate and the control software performs a calculation for example a PID calculation to determine whether or not to adjust the opening of the valve and then communicates with the necessary component(s) (pneumatic controls to open or close the valve). All communications and measurements are also communicated with an overall controller (not shown) for the apparatus 20. In the embodiment shown lines 210A and 211A after exiting the flow controllers in each line are combined into line 214A and line 214A flows into an optional static mixer 240 to completely mix the components that originally were in lines 210A and 211A and form a (first) mixed fluid also referred to as partially blended slurry in line 217, then the mixed fluid (partially blended slurry) in line 217 is combined with the raw slurry flowing in line 212A and flows into an optional static mixer 241 and exits the static mixer 241 in line 218 to form another (a second) mixed fluid (fully blended slurry). In this embodiment, Line 218 comprises the blended slurry that flows to the distribution module 400 and may flow through (or a portion or a sample thereof may flow through) an optional analytical module 300 too, as shown in FIG. 1B, prior to flowing to the distribution module 400. When at least 2 components in 2 separate lines come together (are connected at a junction) to form a first combined line comprising a first combined composition and then a third line (which may comprise one or more additional or the same components) is added to the first combined line to form a second combined line, that may be referred to as staged blending. Each time at least two (typically two) component lines are combined, it is a stage. The just-described first combined line is formed in a first stage; the second combined line is formed in a second stage. (Note the opposite numbering may be used wherein the first junction refers to the junction closest to the formation of the final blended slurry and/or chemical blend which may be near the pump or in other embodiments a static mixer.) Staged blending may occur for any number of components flowing in any number of separate lines combining by junctions in the lines and eventually preferably resulting in a single and final combined line comprising all or the majority of the components in a desired blended slurry and/or chemical blend. Staged blending may further comprise one or more static mixers that are present at or near the junction between the lines with components flowing therein that come together (are connected) into a single line at that junction. For each two or more lines that come together (are connected) into a single junction, the component lines each have flow controllers to control the flow rate of each fluid in each line, that is called parallel blending. In parallel blending, the components in the blend module are all flowing simultaneously through the flow controllers and combining via junctions between converging tubes and the components blend in the tubes and directly or eventually flow to the distribution module. This invention provides parallel blending that is done in one or more stages.

In the embodiment of the blend module 200 shown in FIG. 1B, it is preferred that the water is supplied in line 211 (211A) and the one or more chemicals are supplied in line 210 (210A) and the raw slurry is supplied in line 212 (212A). In the preferred embodiment, line 214A is a mixture of water and the chemical component. By combining the water and chemical component of the slurry together, a high or low pH component of the slurry can be diluted prior to combination with the raw slurry, and produces a chemical and water mixture that has a pH that is typically closer to the pH of the raw slurry as compared to the pH of the undiluted chemical. By combining the water and one or more chemicals first and then combining the mixture of the water and one or more chemicals in a subsequent step with the raw slurry, this two or more step process (stages), helps to prevent pH shock, and helps to prevents the formation of agglomerates in the slurry. If there are additional chemicals to add to the slurry, depending upon the pH of those chemicals, it may be beneficial to add them one at a time in separate stages to the water stream before adding the combined one or more chemicals and water stream to the one or more raw slurry streams. In alternative embodiments, it may be desirable to combine the water stream and the raw slurry to provide a partially blended slurry stream and then to combine one or more chemical components to the partially blended slurry stream, or to combine more than two streams in one junction.

It is presently preferred to space the junctions between the first two combined component streams (at least a slight distance e.g. an inch) away from the next junction adding another component stream and not to bring more than two streams of components together at each junction. The space between the junctions combining the streams provides some time and distance for the component streams to mix before another component is introduced into the mixed stream, although, other embodiments are contemplated by this invention where multiple steams are combined in a single junction. In an alternate embodiment, a chemical blend is made in the blend module shown in FIG. 1B, the only difference being that line 212 either temporarily or permanently does not supply raw slurry to the blend module while the chemical blend is blended. In an alternative embodiment that is used for chemical blending only line 212 is not in fluid communication with the feed module (the apparatus may not comprise a feed module) and instead line 212 may be connected to a bulk chemical supply.

Figure 3:
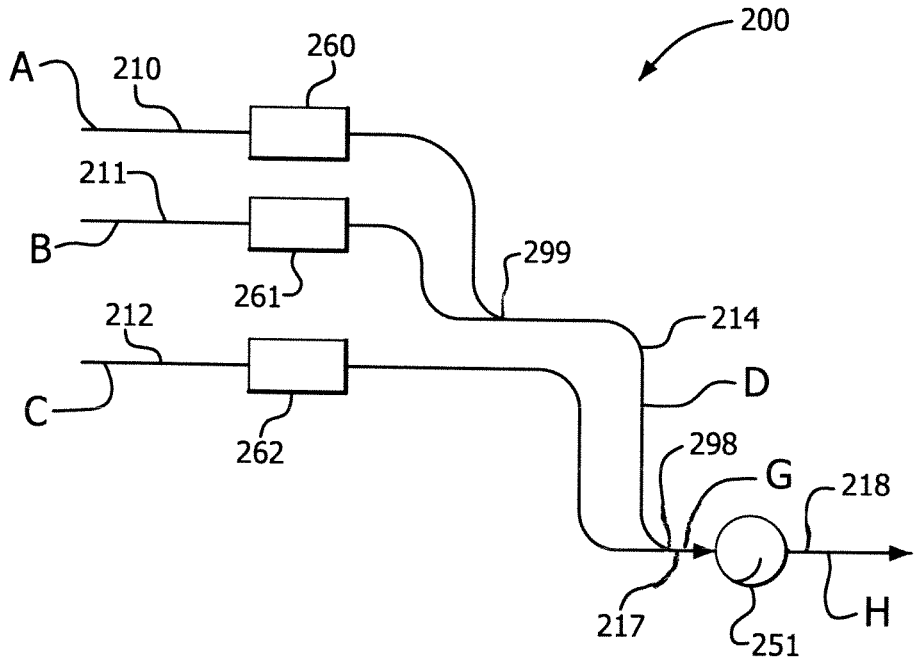
FIG. 3 is an alternative embodiment of a blend module useful in a slurry and/or chemical blend supply apparatus of this invention.
Figure 4:
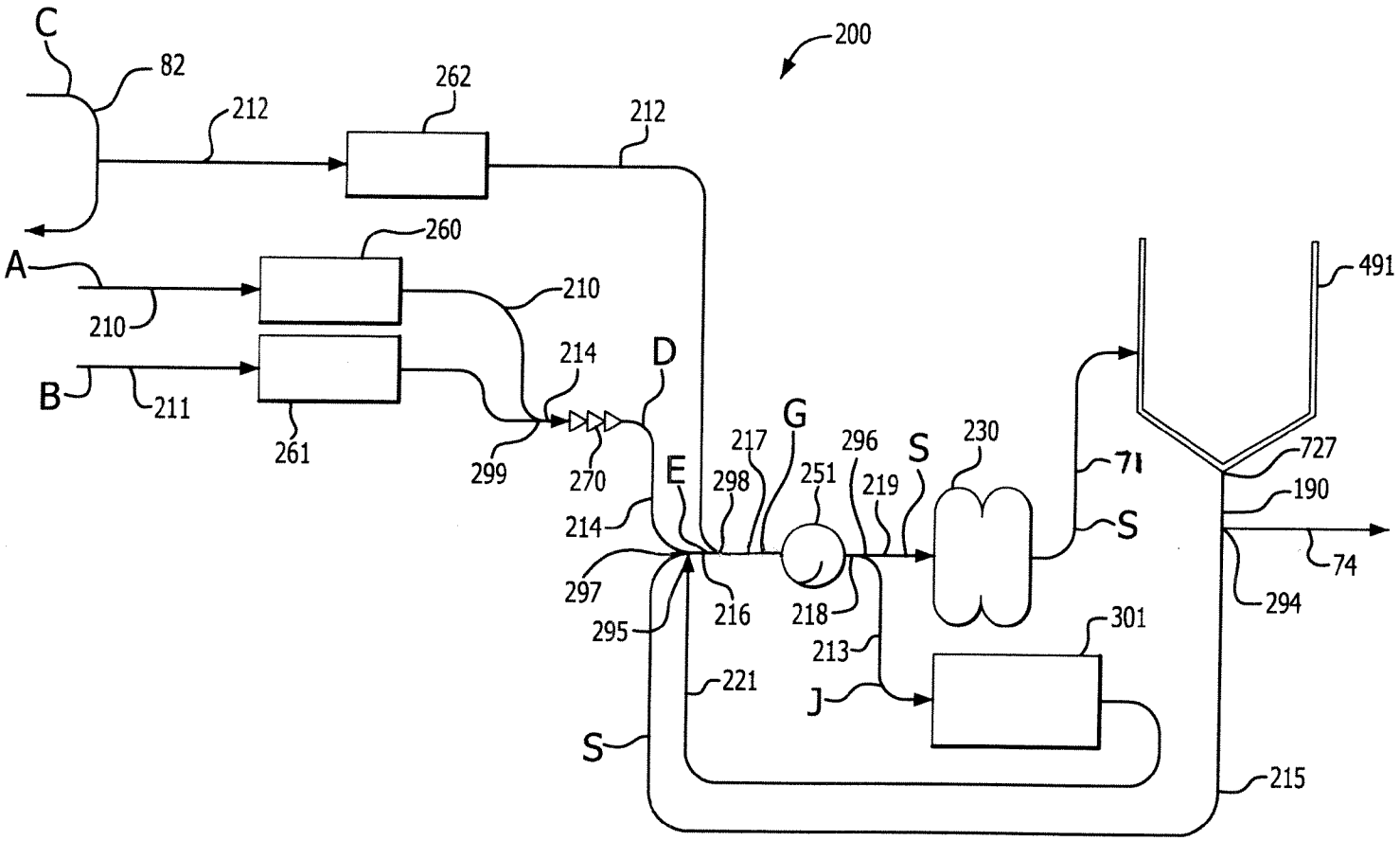
FIG. 4 is an alternative embodiment of a blend module useful in a slurry and/or chemical blend supply apparatus of this invention, also showing an analytical module and part of a distribution module useful in a slurry and/or chemical blend supply apparatus of this invention.

In another embodiment of the method and apparatus of this invention as shown in FIGS. 3, 4, the components of a blended slurry or chemical blend are at least partially blended by flowing multiple component streams into fewer and fewer pipes, or combining all the component streams via a single junction that combines more than two streams, for example, a junction that brings three streams together until there is a single pipe containing all the component streams that are used to make a blended slurry or chemical blend and then drawing that stream into a pump, the discharge of which is a fully blended slurry or chemical blend. The last junction of the pipes forming the single pipe that contains all of the components of the blended slurry or chemical blend stream that enters the pump (and/or a static mixer in the alternate embodiment) is within less than 12 feet or less than 10 feet or less than 8 feet or less than 5 feet or less than 3 feet or less than 2 feet or less than 1 foot or less than 6 inches or less than 2 inches upstream of the pump (and/or the static mixer, for example, for the embodiment shown in FIG. 1B). Further, preferably two or more or all of the component streams, for example streams, A, B, and C in the embodiments shown, are combined within less than 12 feet or less than 10 feet or less than 8 feet or less than 5 feet or less than 3 feet or less than 2 feet or less than 1 foot or less than 6 inches or less than 4 inches upstream of the pump (and/or the static mixer, for example, for the embodiment shown in FIG. 1B). In this invention, a majority of the components of the blended slurry or chemical blend are combined by flowing at least 2 component streams in at least 2 pipes (each stream flowing in its own pipe) through a junction connecting the at least 2 pipes to a single pipe downstream of the junction and into a pump. The pump accomplishes the blending of the components of the slurry or chemical blend such that fully blended slurry or chemical blend exits the pump. The blend module 200 may also comprise one or more static mixers upstream of the pump. Surprisingly the rapid combination and thorough mixing of the components via a pump prevents agglomeration.

The flow controllers are selected from commercially available flow controllers that are well rated for controlling the flow rates in the desired ranges for the individual components combined to make the blended slurry or chemical blend, for example, from Entegris. The chemical component(s) and DIW are provided to the blend module under fairly consistent pressures and flow rates from their sources (not shown). Due to the feed module and particularly the recirculation loop in the feed module for embodiments that blend slurry and having a feed module, the raw slurry is provided to the blend module having a consistent composition and under a fairly consistent pressure and flow rate. The consistent flow rates of the component supply streams makes it easier for the flow controllers in the blend module to maintain a steady and consistent flow of the raw slurry and/or the other slurry components or chemical components through them. The components other than the raw slurry are typically provided to the flow controllers in the blend module at a consistent pressure by commercially available delivery supply systems, for example bulk chemical delivery systems.

FIG. 3 shows an alternative blend module 200 that is useful in making slurry and/or chemical blend compositions. As described for the blend module 200 shown in FIG. 1B, the slurry and/or chemical blend compositions in the form that they are used are called blended slurries or fully blended slurries or chemical blends or fully blended chemical blends, respectively, and they each comprise two or more, typically three or more components that are blended together. The apparatus shown in FIG. 3 is used to blend one or two or more component streams, such as, water, chemical (containing) streams, and/or raw slurry streams, partially blended streams, fully blended streams and/or recycled slurry streams. The apparatus comprises one or more pipes and a pump that are connected to each other and in fluid communication with each other. Each pipe preferably comprises a flow controller therein. As shown, third stream A, second stream B and first stream C travel in third pipe 210, second pipe 211 and first pipe 212 respectively, that may be any kind of pipes, e.g. tubes or the like. Pipes 210, 211 and 212 have third, second and first flow controllers 260, 261 and 262, respectively. The flow controllers in this embodiment, to supply optional raw slurry (for slurry compositions), chemical(s) and DIW operate as described above for the blend module 200 described in conjunction with FIG. 1. Third line 210 and second line 211 carrying stream A and B respectively meet and combine at junction 299 to form a second (single) combined stream in pipe 214 that comprises a blended mixture (partially blended slurry and/or partially blended chemical blend stream) of streams A and B. (The amount of fluid (components, water, and/or slurry, etc) in each stream to be combined is taken into consideration when sizing the pipes that carry component streams and the combined streams after the junctions. Note, the pipes as shown in all of the figures including FIG. 3 do not reflect the actual size or relative size of the pipes.

The conduits are sized between from ⅛ inch to 1.5 inch outside diameter tubing. The tubing is sized to accommodate the expected flows of the slurry or other components therethrough and not to restrict the flow of the slurry or slurry components, chemical blend components or blended mixtures (i.e. partially blended slurry or partially blended chemical blend). The flow rate through the conduits is controlled by the pumps and flow controllers; therefore, the tubing size should be such that it does not interfere with those controls.

The blend module 200 further comprises another component stream, stream C. Stream C flows in first pipe 212 and is combined at junction 298 with the stream D (comprising the components of streams A and B) that is flowing in pipe (the second single combined stream) 214 to form first single combined stream, stream G in pipe 217. Downstream of junction 298 is pump 251. In this embodiment, stream G that travels via pipe 217 into pump 251 preferably comprises all of the components of the raw slurry or chemical blend that are to be combined to make the blended slurry or chemical blend. Stream G in pipe 217 is injected into or otherwise flows into pump 251 that mechanically mixes all of components of the stream G. Stream G comprises the component streams A, B, and C. By using this method and apparatus of combining the components, the speed of combining the parallel flowing streams A, B and C in the joining pipes and the proximity to and blending via the pump 251, the slurry or chemical blend quickly reaches the desired equilibrium and substantially avoids the pH shock problem described above. The component streams are combined by continuously flowing them together into fewer conduits (combined streams) and then flowing the combined (components) streams into the suction side of a pump. The fully blended slurry or chemical blend exits the pump on the discharge side into a pipe 218. Pipe 218, transports stream H, which is preferably the fully blended slurry or chemical blend to a distribution tank, and/or filter, and/or analytical module, and/or a tool and/or to a global loop. The pump 251 is preferably a centrifugal pump as described earlier. The pump 251 may be referred to as the blend module pump 251.

Another embodiment of the blend apparatus or module 200 of the invention is shown in FIG. 4 that is useful in making slurry and/or chemical blend compositions. FIG. 4 is similar to FIG. 3; however, it shows additional equipment and process steps that may be used in the apparatus and method of the invention. (In some of the figures, the same or similar numbers are used to label similar elements in the figures.) The apparatus shown in FIG. 4 is used to blend one or more component streams, such as, one or more chemical component streams, raw slurry streams, partially blended streams, fully blended streams and/or blended slurry and/or chemical blend streams. The sources of these streams are not shown in the figure, except, as shown, in embodiments that make blended slurry line 212 may be the raw slurry feed from the feed module 100, although in an alternative embodiment line 212 could be located elsewhere, i.e. swapped with the locations of line 210 or line 211 in the blend module. In alternating embodiments such as those that make chemical blends, line 212 could be a chemical component or water stream. The method or apparatus of this embodiment is one in which one of the component streams being combined with another stream comprises already blended slurry and/or chemical blend. Like the embodiment shown in FIG. 3, the apparatus of FIG. 4 comprises one or more pipes and a pump. Component streams A, B and C travel in pipes 210, 211 and 212 respectively. Pipes 210 and 211, carrying component streams A and B respectively meet, and combine at junction 299 to form a fourth single combined stream in pipe 214 that comprises a mixture of streams A and B (a partially blended slurry or partially blended chemical blend), referred to as stream D. The pipe 214, comprises an optional static mixer 270 which helps to blend the components in streams A and B of pipes 210 and 211, respectively. Streams A and B blend together in pipe 214 and static mixer 270 to form stream D. Note the term "partially blended slurry or partially blended chemical blend" is used to refer to an intermediate stream in the formation of the "fully blended slurry or fully blended chemical blend" or in this embodiment "additional fully blended slurry or fully blended chemical blend". The partially blended slurry may be with or without (raw) slurry therein.

Another component stream C in pipe 212 is combined with the fourth single combined stream in pipe 214; however, in the embodiment shown in FIG. 4, the stream D in pipe 214 is first combined with the stream S in pipe 215 to form third single combined stream E in pipe 216. Pipes 214 and 215 join via junction 297 into a single pipe 216. Stream E in pipe 216 and stream C in pipe 212 then combine via junction 298 to form first single combined stream G in pipe 217. Downstream of junction 298 is pump 251. Stream G travels via pipe 217 into pump 251. Stream G comprises all of the components of the slurry or chemical blend and (optionally) in this embodiment any fully blended slurry or chemical blend that are to be combined to make additional quantities of fully blended slurry or chemical blend. Pump 251 rapidly mixes all of the streams. Because of the optional individual steps of combining the component streams in stages, the optional use of the static mixer (5), and because of the optimized ratio of the already blended slurry or chemical blend (that is a component of the slurry or chemical blend to be made) to the other component streams, and blending the streams in the pump, this blending method substantially decreases the possibility of the pH shock problem described above. Further, the order of combining the streams in this embodiment decreases the chances of any negative impact due to pH shock on the slurry or chemical blend, although other orders of combining the stream are possible and would also decrease the chances of pH shock. The distances between the junctions are similar to those described for the embodiments described above.

If any agglomerated particles do form, however, in the embodiment shown in FIG. 4, pipe 219 which is in fluid communication with and receives the blended stream S of the blend module 200 is connected to an optional filter element, filter, or a bank of more than one filter, for example, a pair of filters 230 that removes any agglomerated particles from the blended slurry or chemical blend stream S. Filters 230 remove agglomerated particles prior to transfer of the blended slurry or chemical blend to the distribution tank 491. Although not shown, it is preferred that the filter comprises two separate sets of banks of one or more filters in each bank, each having pipes to and from the filters and further comprising valves and optional check valves on the pipes that are in fluid communication with the filters and pipes 219 and 71. Two separate banks of filter(s) are preferred that are arranged in parallel with valves upstream and downstream of each so that the first can be on-line and the second can be off-line during filter changes or for other maintenance, etc. as described earlier. Preferably the second filter or bank that is not filtering is pre-wet by leaving the valve on the upstream ride of the filter(s) open. In this embodiment, the filters 230 remove any agglomerated particles from the blended slurry or chemical blend stream S before the blended slurry or chemical blend stream S is transported to a distribution tank 491. In an alternative embodiment, a filter loop could be connected after the pump 251. In alternative embodiments the blended slurry or chemical blend could be transported to a global loop, or CMP tool, or distribution, holding or other tank without filtering or with filtering provided by filters connected in modules later in the process, for example, in the distribution module or in the global loop or just prior to the CMP tool or other tool. As shown, a portion of the slurry or chemical blend S is fed (transported) via pipe 215 from the distribution tank 491 to be combined in the blend module 200 with one or more other component streams and then mixed by and in the pump 251 in the blend module (apparatus) 200 to make additional blended slurry or chemical blend S. (In alternative embodiments the blended slurry or chemical blend to be combined with the slurry or chemical blend components to form additional blended slurry or chemical blend could be provided from the global loop or elsewhere in the distribution module or from a separate holding or other blended slurry or chemical blend supply tank if desired.) As shown in FIG. 4, stream S (the blended slurry or chemical blend stream from the distribution tank) via pipe 215 is combined with stream D (the mixed component stream of streams A and B) via the junction 297 of lines 215 and 214 and then component stream C is combined via the junction 298 of lines 216 and 212.

In the embodiment shown in FIG. 4, component A is preferably a chemical component, component B is DIW and component C is raw slurry when a slurry blend is prepared or another chemical component when a chemical blend is prepared. In one embodiment, the flow of component A is about 0.5 liters/min (lpm), the flow of water is about 10 lpm and the flow of the raw slurry or another chemical component is about 5 lpm. In some embodiments 10-90% or 25-80% or 50-70% of the total blended slurry or chemical blend discharged by the pump 251 consists of the already blended slurry or already blended chemical blend (stream S and if present stream J) that is blended with the slurry or chemical blend components to form additional blended slurry or additional blended chemical blend. In one embodiment the already blended slurry or already blended chemical blend stream (stream S and optional stream J) is 56-64%, the chemical component B and the water is 26-34% and the raw slurry or other chemical component is 2-18% of the total blended slurry or total blended chemical blend discharged from the pump 251 into line 218. The use of already blended slurry or already blended chemical blend in the blend module decreases the possibility of pH shock of the slurry or chemical blend, and is a method that can be used to successfully combine slurry or chemical components that are sensitive or otherwise reactive.

FIG. 4 shows the distribution tank 491 that is part of the distribution module 400 that will be further described below. The distribution tank 491 has an exiting pipe 190 (connected to the exit opening 727 of the tank) that feeds pipes 74 and 215. Pipe 74 provides blended slurry or chemical blend S to the global loop (not shown but will be described further with reference to FIG. 1C below) or directly to a CMP or other tool (not shown). Pipe 215 provides a portion of the blended slurry or chemical blend S from the distribution tank back to the blending apparatus. Valves (not shown) in one or more of pipe 190, pipe 74 and pipe 215 that are preset by an operator or controlled by the controller (not shown) for the apparatus 20 control the amount of blended slurry or chemical blend that flows into pipe 74 and 215. Additionally the amount of flow to 74 and 215 may be modified or controlled by demand and downstream pump 101 and pumps, flow sensors and valves (not shown in FIG. 4) for the global loop downstream of pipe 74 and/or one or more optional filter loops in the blend and/or distribution module. Alternatively, a flow controller can be provided to control the flow of the already blended slurry or chemical blend in pipe 74, especially if the components require already blended slurry or chemical blend to achieve satisfactory blending results.

In one embodiment shown in FIG. 4, line 212 carrying the raw slurry or chemical component may be a 0.5 inch outside diameter tube line, line 214 carrying the chemical/water blend may be a 0.75 inch outside diameter tube line and lines 215, 217, 219, 71 may each be 1 inch outside diameter tube lines, and line 213 may be 0.5 outside diameter tube line.

The velocity of the fluid is kept low, but above the minimum velocity needed to keep the slurry particles suspended. For example, the minimum velocity for certain alumina and ceria containing slurries is 2.5 ft/sec. It is beneficial to keep the velocity of the slurry near but above the minimum velocity to avoid moving the slurry too fast that may cause slurry particles to slam together and form agglomerates. For this reason and for the embodiments making blended slurry, the speed of the centrifugal pump may be kept near 6000 rpm and the flow rate of the slurry or chemical blend may be greater than 20 liters/minute and less than 25 liters/min.

Pump 251 may be any pump such as a diaphragm, centrifugal, bellows or peristaltic. In one embodiment it is a centrifugal pump, for example a low shear magnetically levitated centrifugal pump, containing a rare earth magnet wrapped in a fluropolymer shell magnetically levitated such that there is no contact with a motor/bearing stator. Such pumps are available from Levitronix. The pump 251 preferable operates at a high rotations per minute (rpm), that is, an rpm of greater than 1000 rpm, typically between 100 to 20,000 rpm, or 1000 to 8000 rpm or 2000 to 7000 rpm. Feedback, closed loop control, may be used to adjust the pump speed based on pressure sensor and/or flow sensor feedback. (Pressure sensors and/or flow sensors that adjust the pump speed are not shown in FIG. 4, but could be similar to those shown in FIG. 2 and described with reference to pump 41). Generally, diaphragm pumps are not preferred for pumping slurry, because the pump causes shear which strips the solvent away from the slurry particles which causes aggregation. (The diaphragm pump may be used in the feed module as the slurry transfer pump, because of its ability to lift the slurry out of the slurry supply container.) Additionally, pumps having mechanical work surfaces are not preferred because the particles in the slurry can build up on the surfaces of the pump. A magnetic levitated centrifugal pump, in contrast, has no mechanical surface for particles to build up on and has limited shear. Other pumps used in the slurry and/or chemical blend supply apparatus of this invention may be the same as the just-described centrifugal pump, operating at the same speeds and providing the same or similar or greater (when required) slurry or chemical blend flow rates in the other modules in the slurry and/or chemical blend supply apparatus of this invention.

As shown in FIG. 4, the blending apparatus may comprise an optional analytical module 301 that is used to analyze a portion of stream S downstream of the pump 251. Stream S is a fully (or additional fully) blended slurry or chemical blend stream. A slip stream J in pipe 213 flows from pipe 218 via junction 296 that connects pipe 213 to pipe 218. The analytical package or module may contain one or more types of analytical equipment (also referred to as analytical apparatuses) and connecting pipes that allow for the slurry or chemical blend flow to and/or from the analytical equipment. The analytical package may contain one or more particle counters, one or more particle size distribution analyzers, one or more pH meters, one or more conductivity sensors, one or more density sensors, and/or any other measuring devices in any combination as needed. After the portion of stream J that is sent through the optional analytical module 301 is analyzed, stream J, a fully (or additional fully) blended slurry or chemical blend stream, in pipe 221 may be combined as shown via junction 295 to stream S in pipe 215. (Alternatively, all or a portion of stream J could be disposed of via a waste stream in a separate pipe (not shown) after going through the analytical module 301, especially if any analysis required dilution or reaction with other chemicals for analysis.) The pipe 213 and valving (not shown) that directs the slip stream into pipe 213 and through the analytical module 301 may be sized such that between from 3-6 liters/minute which is typically 15-30% by flow (volume/time) of the stream S in line 218 is directed to the optional analytical module 301. The slip stream may be larger or smaller and/or provide a larger or smaller sample to the analytical apparatuses, if desired. Additionally, one or more valves (not shown) in pipe 213 may be closed to prevent slip stream J from entering the analytical package when analysis is not necessary or the analytical package is taken off line, is measuring samples from elsewhere in the apparatus or is shut down for maintenance or repair.

Figure 11:
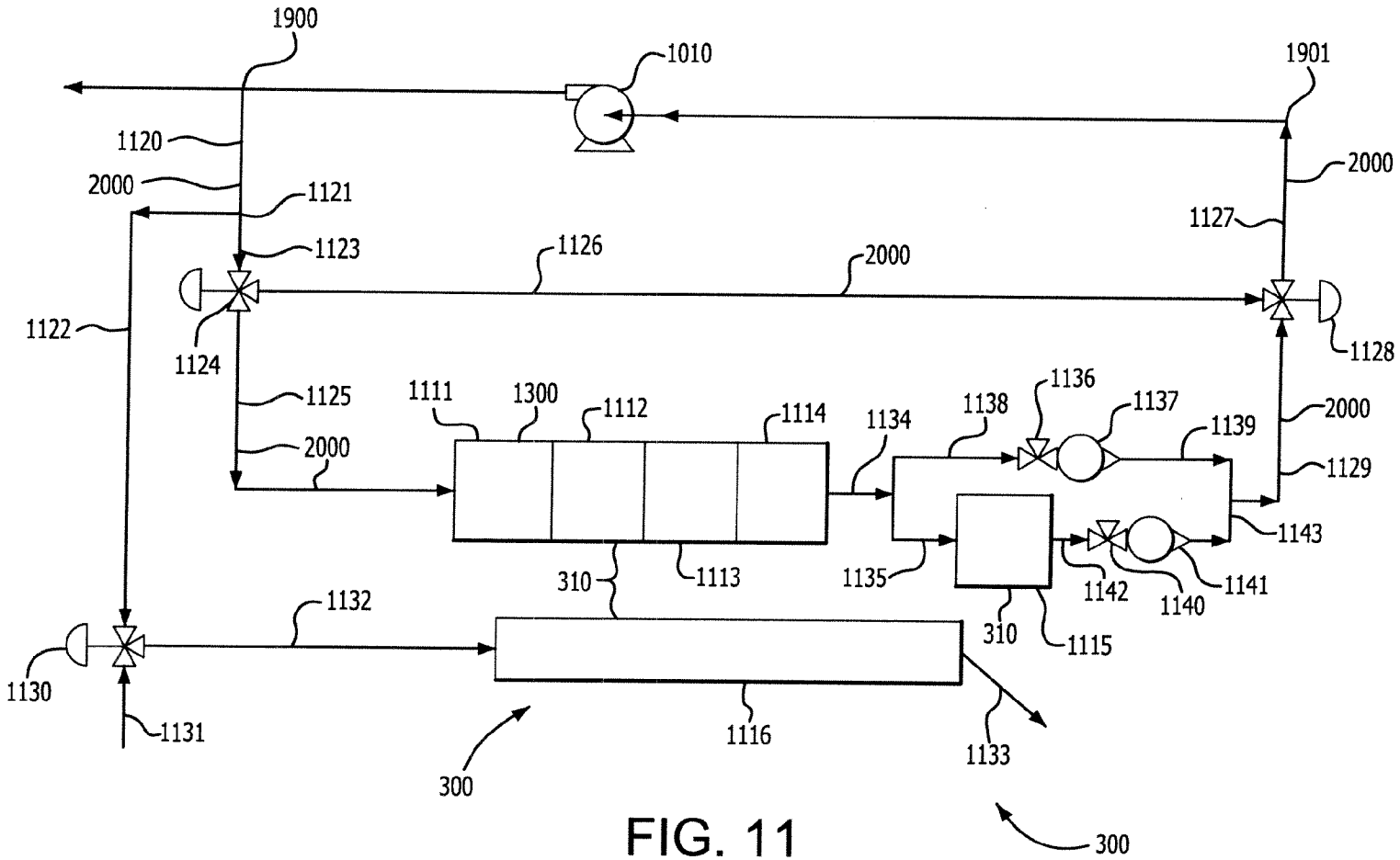
FIG. 11 shows an in-line analytical module comprising an analytical package and a sample loop to the analytical module.

Analytical module 301 may be the same or different from the analytical module 300 described below and the slurry and/or chemical blend supply apparatus 20 may comprise one or more than one separate analytical modules. In the embodiment shown in FIG. 4, analytical module 301 is preferably the same as analytical module 300 (as shown in FIG. 11), and may be the only analytical module in the apparatus and optionally the feed module may comprise an analytical module comprising only a liquid particle counter and/or particle size distribution analyzer for analyzing the raw slurry. The slurry and/or chemical blend supply apparatus may further comprise the blend module shown in FIG. 4. The stream 213 connected after the pump in the blend module (as shown) is for the purpose of transporting a portion of the slurry or chemical blend (depending upon what is being made by the apparatus) to the analytical module 301 to check if the freshly blended slurry or chemical blend is within the required and expected compositional ranges for the various components by checking, for example, one or more of the following characteristics of the blended slurry or chemical blend: pH, density, conductivity, % peroxide, and the number and distribution of particles in the blended slurry. If any of those sensors detects a blended slurry or chemical blend that is out of range (specification), feedback (via the controller for the apparatus) to the flow controllers and valves in the blend module can automatically (via the controller) adjust one or more the flow controllers and/or valves to adjust the flow rates of the components or otherwise alert a technician. If the sensor readings are very far off, the controller (not shown) will alert a technician so that the problem can be addressed before a large quantity of the blended slurry or chemical blend is blended and/or flows into the distribution tank. In extreme cases the blended slurry or chemical blend the controller or a technician may cause the emptying of all or part of the distribution tank to a waste stream followed by blending fresh slurry until the out-of-specification blended slurry or chemical blend is either fully replaced or mixed with enough in-specification blended slurry or chemical blend that the out-of-specification blended slurry or chemical blend becomes in-specification blended slurry or chemical blend. Alternatively, the sensors may need to be checked by a technician and a defective sensor may have to be repaired or replaced. In the preferred embodiment, the controller does not use feedback to automatically adjust any valves or flow controllers in the blend module. Once set for a defined blend the flow controllers and valves for a given blend in the blend module are preferably not modified by the controller and are instead maintained at a steady-state. Only if a technician determines that something has gone wrong, or if there is a part failure in the blend module will the blend module be interrupted or modified. In alternative embodiments, if any of those sensors detects a blended slurry or chemical blend that is out of range (specification), feedback (via the controller for the apparatus) may cause taking a blend train offline, which will either stop blending (if no other blend train is in standby) or it will swap to the standby train which becomes the new online train.

If the liquid particle counter or particle size distribution analyzer indicates that the number or distribution of particles are out of specification, in addition to the just-described reactions to the out-of-specification slurry or chemical blend, the blended slurry or chemical blend can be directed to the appropriate treatment means (for examples, one or more filter elements to remove large particles or membranes and filter elements) as described earlier to remove either small particles and/or large particles, if they are present in the slurry or chemical blend. In one embodiment shown in FIG. 4, pipe 219 leads to a filter bank so all of the slurry or chemical blend is filtered to remove large particles. In alternative embodiments separate valves or pipes may be provided to redirect the slurry and/or chemical blend through a filter element when the particle size distribution analyzer indicates that the particle size distribution is out of specification and larger particles need to be removed from the slurry or chemical blend, and/or the controller may trigger pump 101D in separate filter loop 700 in the distribution module to push a larger percentage of the slurry or chemical blend through the filter loop 700 to remove the larger particles. In the same way, although not shown, a treatment means (described earlier) to remove the small particles may be provided and the controller may be programmed to direct out of specification slurry or chemical blend through the treatment means when the particle size distribution analyzer indicates that the slurry or chemical blend has too many small particles therein. In other embodiments if the liquid particle counter or particle size distribution analyzer indicates that the number or distribution of particles are out of specification, the online filter bank(s) will be placed offline, and the standby filter bank(s) will be placed online.

The analytical module 301 shown in FIG. 4 may be used to analyze other streams from other parts of the apparatus 20, for example, the distribution module 400 as will be described below. The location of the analytical module 301 as shown in FIG. 4 is for illustration purposes only. The analytical module 301 may be mounted in the apparatus in any convenient location and slurry or chemical blend sample loops that draw slurry or chemical blend from locations (sample ports) within the apparatus and optionally return the slurry or chemical blend or a portion of the slurry or chemical blend back (to other return sample ports) may be provided in multiple locations within the apparatus as will be explained below, and provide the added benefit of not having to duplicate the analytical equipment in each of the modules, thereby saving analytical equipment costs. The slurry or chemical blend sample loop shown in FIG. 4 consists of slip stream 213 located downstream of blend module pump 251 into which slurry or chemical blend flows and is returned via tube 221 located upstream of the blend module pump 251, and optionally one or both of the junctions 297 and 298. The junctions 296 and 295 are ports, for transporting slurry or chemical blend to and from the analytical module 301.

Additionally although not shown in FIG. 4 or any of the figures, the apparatus and/or the modules may comprise check valves wherever there are junctions in the pipes to prevent the back flow of any of the streams. There are check valves (not shown) after each of the flow controllers in the blend modules and may be used elsewhere in the apparatus if desired. The blend module shown in FIG. 4 may also comprise an additional (redundant backup) blend train (pipes, flow controllers, static mixers, etc.) like the embodiment shown in FIG. 1B with the parts labeled A and B. Additionally, although only one static mixer and pump are shown in the blend module shown in FIG. 4, one or more static mixers and/or one or more pumps can be used if desired.

The junctions 299, 298, 297 and 295 shown in FIG. 4, combine two streams and thereby decrease the number of streams from two to one by each junction, and junctions 296 and 294 split 1 pipe into 2 pipes. The junctions may not match the shapes in the drawings and can be T-shaped or Y-shaped junctions or any shape instead.

As shown, the pipes comprise flow controllers, e.g. volumetric flow controllers 260, 261 and 262 that control the flow of each of the streams A, B and C in pipes 210, 211 and 212 respectively. Alternatively, the flow controllers in those pipes could be controlled by mass flow meters, including (Coriolis) mass flow meters. In some embodiments, it may be desirable to use weight measurements to measure the weight of some of the components of the slurry or chemical blend and to check the weight of the blended slurry or chemical blend in the tanks if desired; however, the preferred blend module controls the combination of at least two and in some embodiments all of the components of the slurry or chemical blend using flow controllers, that may be volumetric flow controllers.

In the embodiments shown in FIGS. 1B, 3 and 4, streams A, B, and C can independently comprise individual components of the blended slurry or chemical blend that may include, as mentioned above, raw slurry, chemical component streams (comprising one or more chemicals, neat or in a solution), and ultra-pure water (UPW) or deionized water (DIW) (UPW and DIW are used interchangeably herein), partially blended slurry or partially blended chemical blend (that is raw slurry or a chemical component blended with one or more additional components), recycled slurry or fully blended slurry or fully blended chemical blend. In the preferred embodiment, stream A is a chemical component in solution, stream B is water and stream C is raw slurry when making blended slurry or an optional chemical component when making a chemical blend (when making blended slurry, Stream C is typically the raw slurry provided via pipe 212 from the feed module 100 as described above for the embodiments shown in FIGS. 1B, 3 and 4). In some embodiments, it is beneficial to combine a chemical component stream (stream A) with water (stream B) (prior to combining it with the raw slurry and/or another chemical component) to neutralize and dilute what is oftentimes a high or low pH chemical component stream, such as, an acid or a base. In the embodiment shown in FIG. 4, the mixed water and chemical stream is combined with the fully blended slurry or fully blended chemical blend stream S to further dilute the mixed chemical and water stream (stream D) in the fully blended slurry or fully blended chemical blend stream S. By combining the fully blended slurry stream or fully blended chemical blend stream (Stream S) with the mixed chemicals and water stream (stream D) to form the partially blended slurry stream or partially blended chemical blend stream (Stream E), the pH of the raw slurry stream or chemical component stream (Stream C) will not be as greatly impacted when combined with the partially blended slurry or partially blended chemical blend in Stream E as compared to combining Stream C with Stream D directly, thereby reducing the effects of or avoiding pH shock as compared to combining the chemical stream and either the raw slurry stream when blended slurry is made or second chemical component stream first when a chemical blend is made.

When stream A comprises the chemical stream and it is hydrogen peroxide or another peroxide, it may be beneficial to provide a peroxide sensor 345 as shown in FIG. 1B. The peroxide sensor can be an index of refraction or an autotitrator type sensor and it can be such that it sends an electronic signal to the controller (not shown). The flow rate of the hydrogen peroxide in stream A may be increased or decreased via the flow controller 260A depending upon the measurement made by the peroxide sensor and communicated to the controller (not shown) or information may just be maintained in a data logger and used to alert a technician if it is out of an acceptable range.

If present the hydrogen peroxide concentration in blended slurry or chemical streams may degrade over time (that is, the measured concentration may decrease over time), so if low hydrogen peroxide concentration (out of specification) is detected by sensor 345, an alarm may be generated to indicate to a technician to change out the hydrogen peroxide supply and already blended slurry or already blended chemical blend may be dumped and replaced, or the already blended slurry or chemical blend may be dosed with fresh or additional hydrogen peroxide to compensate for the degraded H2O2. A method and the embodiment that provides for dosing by the blend module into the distribution tank is shown and described below with reference to FIG. 17.

In the embodiment shown in FIG. 4 or in other embodiments of the blend module comprising an already blended slurry or an already blended chemical blend stream that is combined with one or more other component streams to make a blended slurry or chemical blend, the already blended slurry or chemical blend stream S that is combined with the other component streams, for example the raw slurry, water and chemical component streams, can be from 2 to 80%, or 10 to 70%, or 20 to 60% or 25 to 55% of the total volume per unit time (flow rate) of the streams that are combined and mixed to form the additional blended slurry or additional blended chemical blend stream (Stream 217). In the embodiment shown, those streams are mixed in the pump 251 to form additional blended slurry or additional blended chemical blend of which part is the already blended slurry or already blended chemical blend stream, which as shown, is from the distribution tank 491. In other embodiments, the already blended slurry or already blended chemical blend can be from other sources, for example, the analytical module, blend module or other parts of the distribution module, e.g. the global loop. Although shown and described as the preferred embodiments, in alternative embodiments the streams A, B and C may comprise any of the possible components described as useful for making blended slurry or chemical blend or the same feed streams could be rearranged in the pipes so that they are combined in a different order (any order) in the embodiments shown. Note also that the embodiments shown, typically blend 3 components, but could be used for 4 or more components to make a blended slurry or chemical blend or could be modified to blend 4 or more components. For those embodiments, blending 4 or more additional components to make a blended slurry or chemical blend, it may be desirable, for each additional component, to add an additional feed line for the component, a flow controller (to regulate the flow rate by volume or by mass per time) in that line and a junction between the added line and another component line or line carrying an already mixed component stream, and an optional static mixer downstream of the added junction. In an alternative embodiment, if desired, additional feed lines could be added before or after the pump or static mixers in the embodiments shown. Alternatively if the blended slurry or chemical blend comprises only 2 components, only 2 feed lines, for example A and C may be used in each of the embodiments shown above and those embodiments may be simplified if desired by removing one of the feed lines, line B for example. In embodiments in which the apparatus is used to blend slurry and chemical blends intermittently, a valve in the pipes for the raw slurry may be closed when the apparatus is used to blend a chemical blend.

Although the preferred order of combining the streams was described, this invention provides the benefit that the agglomeration will be reduced if the components of the blended slurry or chemical blend are combined using this invention even if the streams are combined in a different order.

As stated earlier the sources of the components (other than the raw slurry and the already blended slurry or chemical blend) are not shown in the figures. The sources of the chemicals and water may be drums or tanks or other vessels. The streams may be fed into the respective pipes by pumps or gravity or from a higher pressure source to the lower pressure pipes. This concept is understood by those in the art. It is preferred for the reliability of the flow controllers in the blend module 200 that the components are provided to the blend module 200 in a substantially constant flow rate and at a substantially constant pressure. For example the flow rate should be maintained upstream of the flow controllers in the blend module such that it varies less than 5%, less than 2% or less than 1% of full scale (typical total flow rate) at the flow controllers. For example the pressure preferably varies less than 5% or less than 2% or less than 1% of full scale (typical total flow rate) for each line. The flow rates or pressures for the individual component lines are determined considering the line diameters and the quantity of each component to be added to make the blended slurry or chemical blend and will vary if the size of the pipe diameters varies. Typically water is provided at a pressure between from greater than 0 to 100 psi or 12 to 100 psi, and a flow rate between from greater than 0 to 20 Liters/min (lpm). Typically the one or more chemical streams are provided at a pressure between from 7 to 17 psi (for the differential pressure flow controllers) or from 10 to 14 psi or about 12 psi, and flow rate between from 0.05 to 5 lpm, or between from 0.08 to 4 lpm, or between from 0.1 to 2 lpm. Typically the raw slurry or chemical blend is provided at a pressure between from 20 to 30 psi or from 22 to 28 psi, and flow rate between from 15 to 25 lpm, or between from 18 to 22 lpm. Typically the blended slurry or chemical blend is provided at a pressure between from 20 to 30 psi or from 22 to 28 psi, and flow rate between from 15 to 25 lpm, or between from 18 to 22 lpm.

In the embodiment shown in FIG. 1B, there is a by-pass line (not shown) between the pipe 218 exiting the blend module connecting it to pipe 71 connected to the distribution module. The by-pass line (not shown) is used when the analytical package is off-line or when the operator or automatic controller (computer) determines that it is not necessary to direct the blended slurry or chemical blend from the blend module 200 to and through the analytical module 300. In one embodiment, the analytical package 300 may be the only analytical module provided for the apparatus and it may be desirable to provide pipes and valves to direct slurry or chemical blend from one or more points in and/or more than one point in one or more of the modules to the analytical module 300 for testing. In such embodiments, the one or more lines and associated valves connecting the various slurry or chemical blend test points to the analytical module may operate in a continuous cycle to draw samples from and test the slurry or chemical blend from the various points (sample ports) in the apparatus serially and then repeat the testing continuously or semi-continuously. The testing may be in a set or random pattern or in a pattern directed by the operator. Alternatively a controller (not shown) may control the sampling based on an algorithm that determines based on the operation of the apparatus, when it is necessary to draw samples from the various sample ports provided. Sample ports are pipe or tube connections in a pipe or tube. They can be sized to allow for only a portion of the slurry or chemical blend to flow into the connected tube to the analytical module. Additionally the sample port or connected tube may comprise valves therein, if desired, to control the flow to the analytical module. As shown in FIG. 1C, the circles labeled 1900, 1900A and 1900B indicate ports at which piping (not shown) and valves (not shown) are connected to the analytical package 300 (shown in FIG. 1B) from the distribution module 400. Connected to each of ports 1900, 1900A and 1900B are sample tubes (not shown) to the analytical package 300 and return tubes to form a loop. The sample loops via return tubes (not shown) return the analyzed slurry or chemical blend from the analytical module 300 to return ports 1901 or 1901A or 1901B, respectively. At one or more of the ports 1900, 1900A, 1900B, or any of the ports, a hand valve (not shown) may be provided for an operator to draw a sample for off-line testing in equipment (not shown). As shown in FIG. 2, ports 1000A and 1001B are used to form a sample loop (not shown) that takes slurry from port 1000A or 1000B for analysis by the liquid particle counter 34 in FIG. 2 and returns it to port 1001 after analysis or alternatively the sample could be sent via the sample loop or tube to analytical module 300 for analysis if a single analytical module is provided for the apparatus. If there is dilution of the slurry before analysis of the slurry in the analytical module 300, then the slurry is not returned to port 1001 after analysis. Diluted slurry may be directed to a waste line (not shown).

Figure 5:
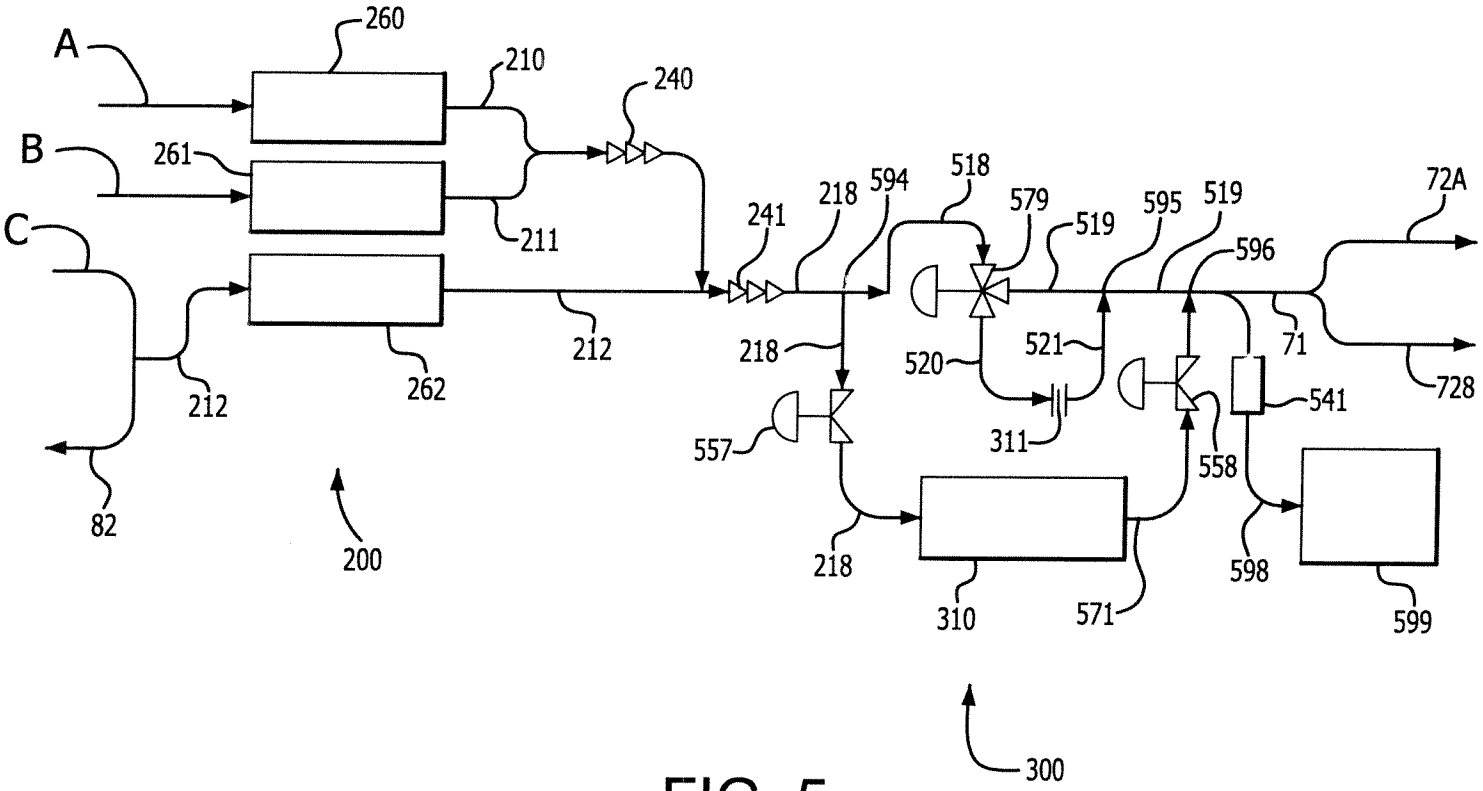
FIG. 5 shows an alternative embodiment of the blend module and analytical module and related piping.

FIG. 5 shows one embodiment of the piping between the blend module 200 and the analytical module 300 and the piping 72A, 72B to the distribution module that can be used continuously or intermittently to direct all or a portion of the flow of blended slurry or chemical blend from the blend module 200 as shown (or any blend module) to and through the analytical module 300 or alternatively to direct all or a portion of the blended slurry or chemical blend to the distribution module via pipes 72A, 72B. The blend module 200 can be any blend module. The analytical module 300 can be any analytical module 300. The piping to the distribution module and the distribution module 400 can be any piping and/or any distribution module. For example a single pipe to the distribution module may be used. In fact, the means to redirect all or a portion of the stream 218 shown in FIG. 5 comprising a 3-way valve 579, a restriction orifice 311 and the associated piping having one or more junctions and optional additional valves can be used anywhere in the slurry and/or chemical blend supply apparatus 20 to reliably direct at least a portion of the flow in a first pipe to a second pipe when desired, or to direct the flow only into a first pipe or only into a second pipe. The means can be used to split the flow simultaneously between the first and second pipe so that each pipe delivers slurry or chemical blend to different modules and/or to direct flow within any module simultaneously into a first pipe and/or second pipe as desired.

FIG. 5 shows a simplified blend module 200 similar to the one shown in FIG. 1B. (The blend module 200 in FIG. 5 does not comprise a backup blend train having back up flow controllers and associated piping like the one shown in FIG. 1B.) The same or similar numbers used in FIG. 5 represent the same or similar parts as those shown in FIG. 1B. Also shown in FIG. 5 is the analytical module 300 comprising an analytical package comprising one or more sensors and related piping that provides for the flow of slurry or chemical blend to the analytical package after blending the slurry or chemical blend in the blend module 200.

To by-pass the analytical package, 3-way valve 579 is open such that the blended slurry or chemical blend flowing in pipe 218 from the blend module 200 flows through pipe 518, through 3-way valve 579 through pipe 519 to pipe 71 and thereby to the distribution module (not shown in FIG. 5). At the same time valve 557 in line 218 can be closed to prevent blended slurry or chemical blend from entering the analytical package 310. Alternatively, to partially or fully direct the blended slurry or chemical blend from the blend module 200 to the analytical module 300, the 3-way valve 579 could be changed from one open position to a second open position such that the blended slurry or chemical blend flowing in pipe 218 from the blend module 200 flows through pipe 518, through 3-way valve 579 through pipe 520 to the restriction orifice 311 which allows either none or only a portion of the blended slurry or chemical blend to flow into pipe 521, to junction 595, to pipe 519, to and through pipe 71 and thereby to the distribution module 400 (for example as shown in FIG. 1C) via lines 72A and/or 72B. (Note optional valve 558 in line 571 may be closed to prevent the flow of slurry or chemical blend from the by-pass line 519 into the analytical module return line 571, but is open when slurry or chemical blend is flowing through the one or more analytical apparatuses 310.) In conjunction with changing the 3-way valve 579 from a first position to a second position, the optional valve 557 in line 218 is switched from a closed to open position. Because of the restriction orifice 311, the restricted flow of the blended slurry or chemical blend in pipes 520 and 518 causes the blended slurry or chemical blend upstream of pipes 520 and 518 to flow through pipe 218 toward the analytical apparatus(es) of analytical package 310. Line 218 may have a check valve to prevent the flow of slurry or chemical blend upstream into the blend module 200. The restriction orifice 311 creates a back pressure that causes the flow of at least a portion of the slurry or chemical blend to the analytical apparatus(es) of analytical package 310 of the analytical module 300. The blended slurry or chemical blend in pipe 218 flows through open valve 557 to the analytical apparatus(es) of analytical package 310 and through valve 558 from the analytical apparatus(es) of analytical package 310. After exiting the analytical apparatus(es) of analytical package 310, as shown in FIG. 5, the blended slurry or chemical blend flows through pipe 571 through open valve 558 (alternatively a check valve) in pipe 571 to line 71 to the distribution module. (If the slurry or chemical blend flows into pipe 519 at the junction 596, it will not flow past closed valve 579 nor the restriction orifice 311. Additionally, preferably a portion of the flow in pipe 520 passes through the restriction orifice 311, and via junction 595 will flow through pipe 519 and meet up with the analyzed slurry or chemical blend from the analytical apparatus(es) of analytical package 310 and is transported to the distribution module via pipes 71 and 72A and/or 72B. The distribution module may comprise a distribution tank and/or a global loop. The controller can control the intermittent or continuous flow of a portion of or all of the slurry or chemical blend to the analytical module by opening and closing the valves as described.

FIG. 5 shows the apparatus may comprise an optional sample line 598 and sample compartment 599 that in this embodiment is located between the analytical module 300 and the distribution module 400 (as shown in FIG. 1C), but in alternative embodiments could be provided any where it may be desirable to take a sample of the blended slurry or chemical blend for testing off-line or to collect a larger quantity of the raw slurry, or blended slurry or chemical blend. For example, although not shown, it may be desired to collect a sample of blended slurry or chemical blend returning from the global loop (part of the distribution module 400 described below) to analyze it off-line. Compartment 599 is a sample compartment into which a container (not shown) may be received. The sample compartment 599 may comprise a housing and a door and piping and valves for filling a container that is placed within the (carboy) compartment 599. The container could be used to collect a large quantity of blended slurry or chemical blend that was not made for the distribution loop but was made for the purpose of, for example, bench testing and/or further analysis. For example, the container can be a 5-gallon container or larger. If blended slurry or chemical blend is to be collected in the container, valves (not shown) in line 71 and line 598 are switched from open to partially or fully closed and closed to partially or fully open, respectively to direct a controlled or discrete amount of the flow of blended slurry or chemical blend into the container. After the container has received the desired amount of slurry or chemical blend, as indicated by a level indicator (not shown), weight sensor (not shown), or as measured by the flow controller 541 in line 598, or other sensor or manual control, the valves (not shown) in line 71 and line 598 are switched from partially or fully closed to open and partially or fully open to closed, respectively. (The flow controller 541 can work in conjunction with totaling software that is part of the controller (not shown) to determine when the desired amount of slurry or chemical blend has flowed into the container. When the desired amount of slurry or chemical blend is in the container, the software automatically closes a valve in line 598 to stop the flow of the blended slurry or chemical blend to the container. Alternatively or additionally, manual valves can be provided.) The container then is removable from line 598 and the compartment 599. The compartment 599 may be provided with a door that is safety interlocked to prevent access to the container while it is being filled or otherwise access controlled. The container can be transported to a test bench or elsewhere.

Additionally the apparatus may comprise optional filter element and filtering step if desired after the blend module 200 although not shown in FIG. 5 or 1B (similar to the filter element and filtering shown in embodiment shown in FIG. 4 or any filter embodiments shown and described herein) prior to the flow of the blended slurry or chemical blend into the distribution module 400 (as shown, for example, in FIG. 1C) and/or prior to the flow of the blended slurry or chemical blend into the optional analytical module 300. Although filter 230 in FIG. 4 is shown as a single filter bank comprising 2 filters, it is just representative of any type of the filter elements, e.g. filter loop, parallel filters or filter banks, etc.)

The embodiments of the slurry and/or chemical blend supply apparatus shown in FIGS. 1B and 5 comprise analytical modules 300. The analytical module is employed for sampling for at least one and in some embodiments multiple slurry or chemical blend streams. The blended slurry or chemical blend stream 218 is sent to the analytical module 300 comprising analytical package 310 as shown in FIG. 5. As discussed above, when 3-way valve 579 is actuated to cause flow through line 520 through restriction orifice 311, this causes a backpressure. This backpressure causes flow through the analytical package 310 when valves 557 and 558 are open.

The analytical package 310 typically comprises one or more analytical apparatuses or equipment, such as one or more pH sensors, one or more density sensors, one or more conductivity sensors, one or more hydrogen peroxide sensors and one or more liquid particle counters and/or one or more particle size distribution analyzers. The purpose of using two or more sensors (two or more of the same analytical apparatuses) to measure and monitor one characteristic of the slurry or chemical blend is to check for variations in the measurements by two or more apparatuses measuring the same characteristics. A variation between measurements by the sensors of the analytical apparatuses that are measuring the same characteristics of the slurry or chemical blend may indicate that the slurry or chemical blend is out of specification or that one of the sensors is failing. Sensors age and fail. When one sensor fails it can be replaced while the second sensor (analytical apparatus) is relied upon to monitor the characteristic of the slurry or chemical blend while the slurry and/or chemical blend supply apparatus continues to blend and distribute slurry or chemical blend.

Examples of densitometers useful in the apparatus include vibrating U-tube densitometers, such as those commercially available from Analytical Flow Technologies, and Anton Paar. Examples of conductivity sensors are those that are commercially available from Horiba and Georg Fisher. Examples of hydrogen peroxide sensor are Jetalon index of refraction or an auto-titrator type. Examples of a pH sensor are liquid or solid electrolyte types commercially available from ABB.

Additional streams (not shown in FIG. 4 or 5) may be directed separately through analytical package 310 of analytical module 300. The slurry and/or chemical blend supply apparatus may be equipped with a single analytical package 310 having redundant analytical apparatuses (that is more than 1 apparatus (sensor) measuring the same slurry or chemical blend characteristic) and piping that is part of the analytical module 300 that may be used to allow sample streams from various sample ports in the slurry and/or chemical blend supply apparatus to flow into the analytical package 310.

One way to provide for the flow of sample streams to the analytical package (also referred to as analytical module) is to provide 1-way sample tubes or 2-way tubes, referred to as sample loops located such that when one or more centrifugal pumps are operating sample streams flow to the analytical module 300. The line the pump operates in may be equipped with a tee (sample port) in the line on the discharge side of the pump to provide for a sample tube to the analytical package. Alternatively, the line the pump operates in may be equipped with a tee (return sample port) in the line on the suction side of the pump, and a second tee (sample port) in the line on the discharge side of the pump to provide for a sample loop. There will be a pressure differential between the discharge and suction side, and there can be flow from the tee on the discharge side to the tee on the suction side, through the analytical package. One such embodiment is shown in FIG. 11. The flow described passes through the discharge tee (sample port) 1900 on the discharge side of the pump to pipe 1120 to a 3-way valve 1124 which is normally open to a pipe (sample tube) 1126 to another 3-way-valve 1128, which is normally open to pipe 1127 to the other discharge side tee (sample port) 1901. Sample pipe 1127 is the return sample tube which is part of a sample loop. The normally closed port on the discharge 3-way valve 1124 is connected to the inlet pipe 1125 to the analytical package 1300, and the normally closed port on the suction 3-way valve 1128 is connected to the outlet pipe 1129 from the analytical package. When both 3-way valves are actuated, flow is diverted to the normally closed ports on the 3-way valves 1124, 1128, and slurry or chemical blend flows through pipe 1125 to and through the analytical package 1300. The flow rate through the analytical package 1300 is controlled by a rotameter 1137 or more than one rotameters 1137, 1140 in the analytical package typically with a 3-6 lpm flow rate range. The rotameters are equipped with a needle valve which can be adjusted to reduce or increase flow. The pump speed also determines how much flow through the analytical package occurs.

The sample tube described in the above paragraph can be connected to (and is fed slurry or chemical blend from) the pipes at or near one or multiple pumps. In a preferred embodiment, the slurry or chemical blend flowing through at least one pump may be sampled by the analytical module 300. In one embodiment, one sample line that supplies samples to the analytical package after (downstream of) a pump is connected to the line that supplies the global loop. In another embodiment, another sample line is after pump 251 connected to (in fluid communication with) the line that supplies the distribution tank 491 and optionally supplies the filtration package (element) and is used for dynamic blending meaning blending with a pump as shown in FIG. 4. The sample loop in FIG. 4 is line 213 to analytical package 301 and return line 221. In the distribution loop shown in FIG. 1C, the sampling ports are labeled 1900A, 1900B and 1900 and the return ports are 1901A, 1901B, and 1901 respectively for the sample loops. Two sample loops for the slurry or chemical blend global loops A and B and the other draws the sample after the filter 430 or 431 and the return is before the filter 430 or 431 in the filter loop.

The slurry and/or chemical blend supply apparatus of this invention may comprise an analytical module comprising one or more tubes that are each connected to one or more sample ports, the sample ports are located in (connected to) the piping in the apparatus in a module (feed and/or blend and/or distribution) other than the analytical module. The sample ports are where the samples are drawn from and transported to the analytical module via the one or more tubes for analysis in the analytical module. The slurry and/or chemical blend supply apparatus may comprise an analytical module comprising one or more sample loops, each loop is connected by at least two tubes to at least two sample ports located in the piping in the apparatus in a module other than the analytical module (that is, feed and/or blend and/or distribution). One sample port and connected tube for each loop is where the samples are drawn from and transported to the analytical module, the second tube and second sample port is through which at least a portion of the slurry or chemical blend sample is returned typically to the module from which it was drawn. The slurry and/or chemical blend supply apparatus of this invention may comprise one or more sample port(s) and tube(s), and/or sample loops in one or more or all of any of the feed and/or blend and/or distribution modules.

FIG. 11 shows the analytical module 300 having a sample loop 2000, sample ports 1900 and 1901, and a pump 101D in fluid communication with it. (Sample ports 1900 and 1901 and pump 101D coincide with those found on the filter loop 700 shown in FIG. 1C.) Sample port 1900 is the sample port to the analytical package 1300, 1116 and the sample port 1901 is the return sample port from the sample loop 2000 from the analytical package. Sample loop 2000 comprises pipe 1120 to the analytical package 1300 and pipe 1127 from the analytical module 300 and optional by-pass line 1126 and the optional valves (as shown) and other pipes (for example 1125, 1122, 1132) that transport the fluid to the analytical package of the analytical module 300 and pipes 1129 (and others) that return the slurry or chemical blend to the return sample port 1901. The analytical module 300 comprises the sample loop and analytical packages (multiple analytical apparatuses and sensors) with pipes to the analytical apparatuses of the analytical module 300 and valves and rotometers to control the flow through the analytical module. As shown, the analytical module comprises pH sensors 1111, 1112, densitometer 1113, conductivity sensor 1114, hydrogen peroxide sensor 1115, and optional liquid particle counter and/or optional particle size distribution analyzer 1116; however, alternative embodiments may comprise fewer or more sensors and/or fewer or more types of sensors. Alternative embodiments of the analytical module could comprise at least one type of sensor selected from the group consisting of pH sensors, densitometers, conductivity sensors, hydrogen peroxide sensors, and liquid particle counters and/or particle size distribution analyzers or at least two types of sensors in any combination of sensors. In alternative embodiments, the analytical module may comprise one or two or more of pH sensors, and/or one or two or more densitometers, and/or one or two or more conductivity sensors, and/or one or two or more hydrogen peroxide sensors, and/or one or two or more liquid particle counter sensors and/or one or two or more particle size distribution analyzers and/or one or two or more other types of sensors in any combination. In one embodiment for an apparatus that supplies chemical blend only, the analytical module may not require liquid particle counters or particle size distribution analyzers. For a chemical blend the analytical module may comprise one or two pH sensors, conductivity and peroxide sensors. In preferred embodiments, redundant sensors are provided so the accuracy of the sensors can be checked. Sensors that measure the same quantity+/−an allowable range indicate that the sensors are both accurate and working properly. If one of the sensors begins to sense a value that is not near and possibly drifting away from the expected value, then that indicates that the sensor may have begun to age and that it should be replaced. If one sensor continues to generate readings that are within an expected range, then the process will continue and a technician will be alerted to replace the sensor (or the sensor probe or other analytical equipment) or run diagnostic tests, or check the connections between the slurry or chemical blend sample supply and/or electrical supply and/or replace the sensor with a new sensor. If the sensor is fixed or replaced by the technician and it still does not read within the specification and/or all the sensors are out of range, then something is not right with the slurry or chemical blend and the slurry or chemical blend supply components and/or the functioning of the flow controllers in the blend module should be checked. Action will need to be taken if the blended slurry or chemical blend is out of the specification. If the slurry or chemical blend is out of specification and the sensors are functioning, the controller (computer) could be programmed to automatically perform or a technician could perform one or all of the following steps: terminate blending, adjust the flow controllers in the blend train (blend module) to alter the composition of the blended slurry or chemical blend being made, redirect (more of) the raw or blended slurry or chemical blend to a filter or other treatment means, and/or dump all or a portion of the slurry or chemical blend in the one or more distribution or feed or other tanks, or direct the slurry or chemical blend to a filter element or small particle removal means (treatment means) (e.g. one or more membranes and one or more filters) or to a waste stream.

As shown in FIG. 11 a slip stream of slurry or chemical blend from sample port 1900 enters the slurry or chemical blend sample tube 1120 (part of the sample loop 2000) that splits at junction 1121 into tubes 1123 and 1122. When 3-way valve 1124 is open such that tube 1123 is in fluid communication with tube 1125, the slurry or chemical blend in tube 1123 flows towards the portion 1300 of the analytical package 310 of the analytical module 300 comprising sensors 1111, 1112, 1113, 1114, 1115. The portion 1300 of the analytical package 310 does not include the liquid particle counter and/or particle distribution analyzer 1116. In alternative embodiments, the liquid particle counter could be a particle size distribution analyzer and/or both sensors could be present in series. When valve 1130 is open such that tube 1122 is in fluid communication with tube 1132, then the slurry or chemical blend in tube 1122 flows to the liquid particle counter 1116. Alternatively, when 3-way valve 1124 is closed to tube 1125 and open to tube 1126, and valve 1128 is such that tube 1126 is in fluid communication with tube 1127, the slurry or chemical blend flows from connection point 1900 through tubes 1120, 1123, through valves 1124 to tube 1126 through valve 1128 to tube 1127 and via sample port 1901 back to the filter loop in the distribution module 400. (In alternative embodiments the slurry or chemical blend could be taken from and returned to the blend module (preferably after the blended slurry or chemical blend has been made) or taken from and returned to the global loop in the distribution module as shown in FIG. 1C at sample ports 1900A and 1900B with return sample ports 1901A and 1901B respectively. (In the blend module, shown in FIG. 4, junction 296 may be similar to or equivalent to port 1900 and junction (sample port) 295 is equivalent to port 1901 in FIG. 11.)

When valve 1124 is such that slurry or chemical blend flows into the portion 1300 of the analytical package 300, the pH, density, and conductivity are measured and communicated to the controller (computer, not shown) for the apparatus 20. The slurry or chemical blend exiting the portion 1300 of the analytical package in tube 1134 splits between tubes 1135 and 1138 based on the valves 1136, 1140. In the embodiment shown in FIG. 11, the analytical module further comprises flow meter 1137 in line 1138 and flow meter 1141 in line 1135. Flow meters may be rotometers. The valves (may be needle valves) 1136 and 1140 can be manually adjusted by a technician based on the reading on the flow meters. In alternative embodiments flow meters can communicate with the controller and the valves 1136 and 1140 can be adjusted via computer control. Valve 1140 controls the amount of flow through the hydrogen peroxide sensor 1115 because the hydrogen peroxide sensor in the embodiment shown requires a small amount of sample flowing through the sensor. Typically the flow rate through the entire analytical package is 3-6 liters/min (that is the flow in tube 1120 is 3-6 liters/min). Only a small portion (for example 40 to 80 ml/min) of the slurry or chemical blend flowing to the analytical package 310 flows to the liquid particle counter and/or particle size distribution analyzer 1116 and only a small portion (for example 35-400 ml/min) flows through the hydrogen peroxide sensor 1115. By reading the flow meters 1137, 1141, the flow in the valves 1136, 1140 can be adjusted to achieve the desired flow rates through the hydrogen peroxide sensor.

When valve 1130 is open to the fluid in tube 1122, the fluid in tube 1122 flows into the liquid particle counter and/or particle size distribution analyzer 1116. In the embodiment shown in FIG. 11, if the slurry or chemical blend is diluted for analysis by the liquid particle counter and/or particle size distribution analyzer 1116, then the slurry and/or chemical blend is dumped to drain via line 1133. Typically a chemical blend is not diluted, before a liquid particle counter or a particle size distribution analyzer.

Figure 12:
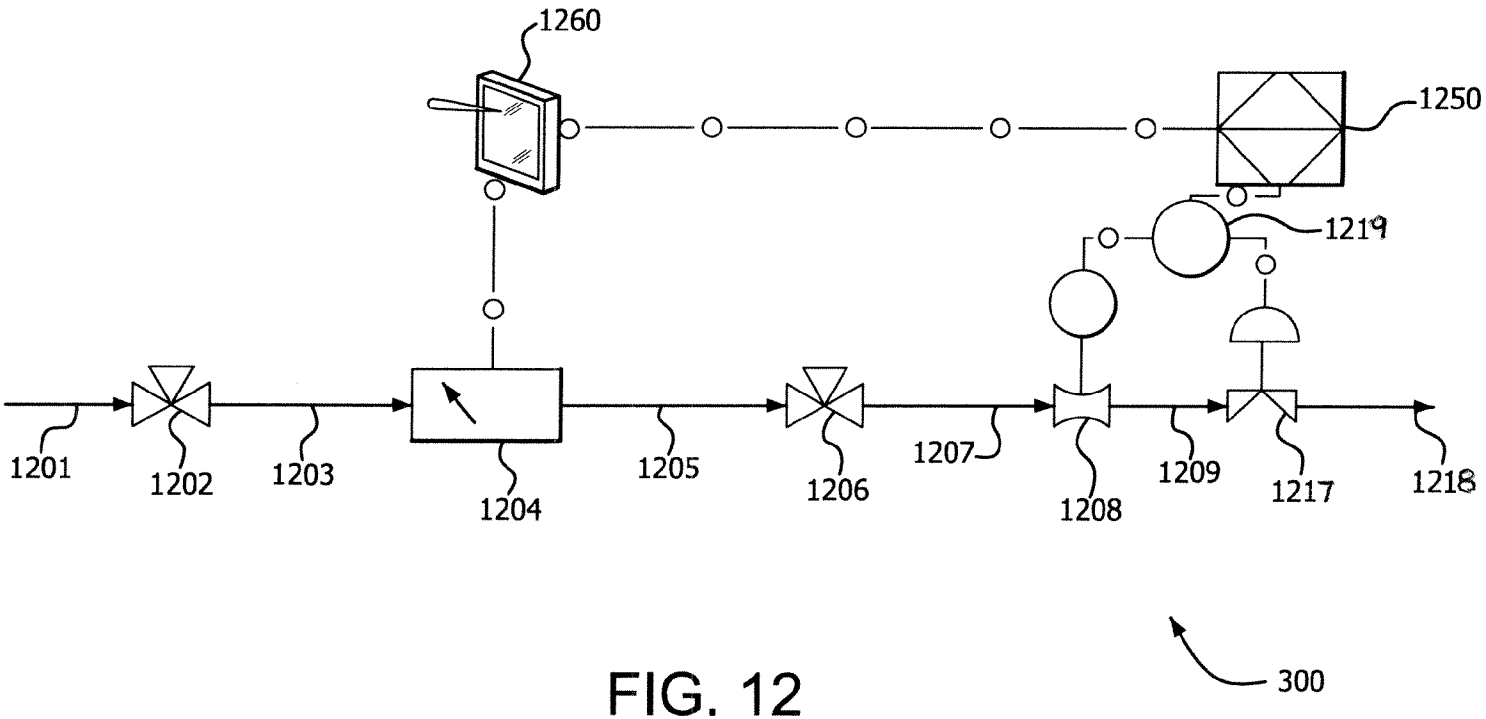
FIG. 12 shows an in-line analytical module comprising an analytical apparatus.

FIG. 12 shows one embodiment of an analytical module 300 comprising a sensor and related flow controls and valves with no dilution of the slurry or chemical blend. In the FIG. 12 is shown a liquid particle counter and/or particle size distribution analyzer 1204, although it can be any sensor that requires that the flow of slurry or chemical blend through the sensor be controlled, but not diluted. Slurry or chemical blend flows through sample pipe 1201 (from one of the modules in the apparatus) through valve 1202 which may be a needle valve, through pipe 1203, through sensor 1204 to pipe 1205 through (needle) valve 1206 to pipe 1207 to flow sensor 1208 through pipe 1209 through pneumatically controlled valve 1217 and through pipe 1218 which returns the slurry or chemical blend back to the apparatus. To control the flow through the sensor (analytical apparatus) 1204 the flow sensor 1208 measures the flow rate of the slurry or chemical blend in pipe 1207 and communicates that flow rate to the controller 1250 and an internal controller 1219. A PID calculation is performed using an already determined set point and the internal controller 1219 communicates with the controller (PLC, computer or otherwise) 1250 and the controller 1250 communicates with the solenoid manifold (not shown) to adjust the air pressure to the pneumatically-controlled proportional valve 1217 which causes the valve 1217 to open or close as directed by the controller 1250. The needle valves 1202 and 1206 that are shown may be three-way valves that may be connected to a DIW supply (not shown) that may be used for a separate flushing step when needed. Additionally, the sensor 1204 communicates electrically with the human machine interface 1260 to show the value that it measured or sensed and it is also electrically communicated to the controller 1250 (PLC or the like) for the apparatus 20 as already stated.

Figure 13:
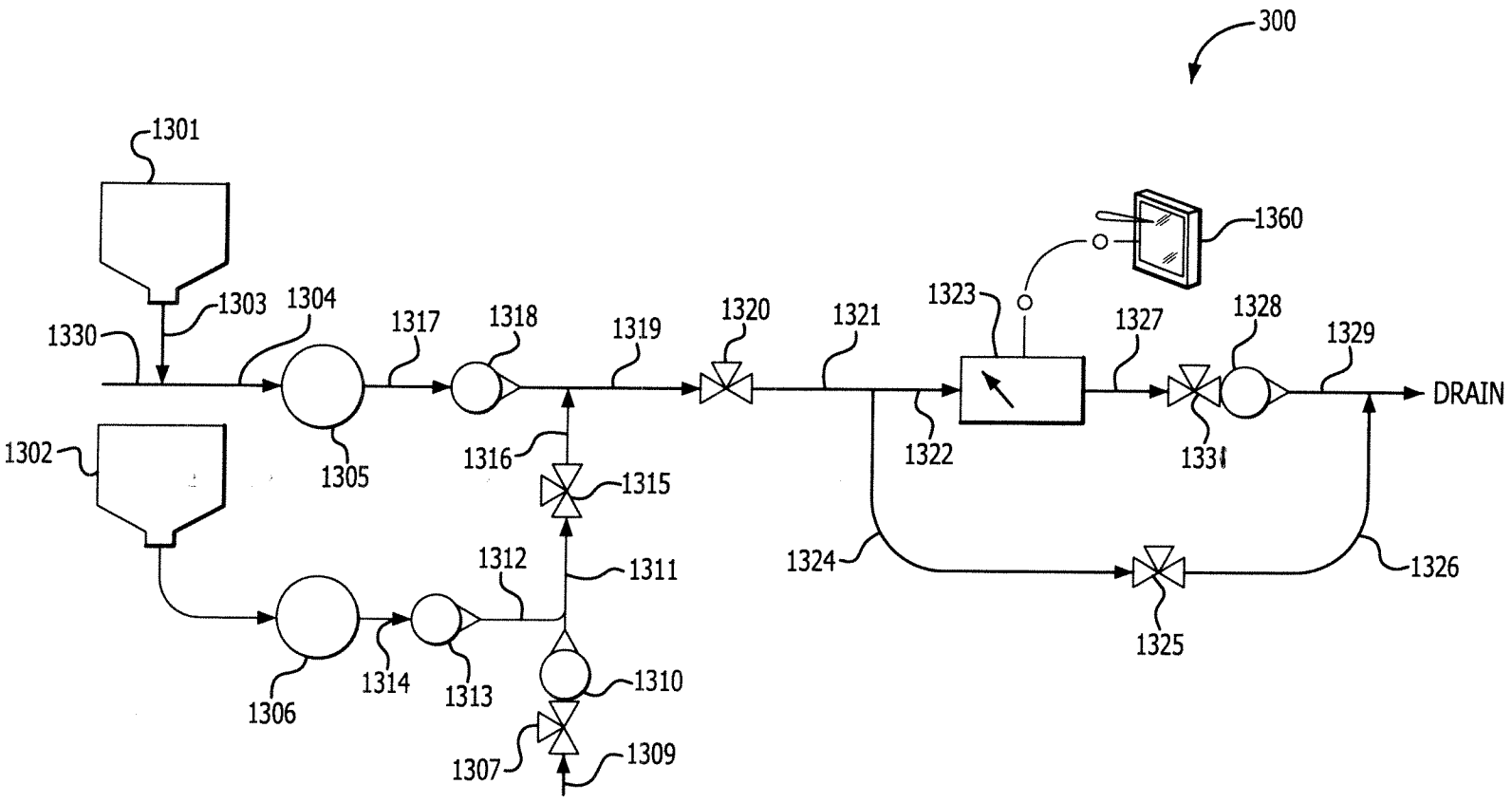
FIG. 13 shows an in-line analytical module comprising an analytical apparatus and a single dilution of a slurry and/or chemical blend sample.

FIG. 13 shows an alternative embodiment of an analytical module that may be part of a slurry and/or chemical blend supply apparatus of the invention. The analytical module 300 (and/or the slurry and/or chemical blend supply apparatus) comprises dilution equipment that is used to dilute a slurry or chemical blend sample prior to the analysis of the sample by a sensor (analytical apparatus) 1323. Shown in FIG. 13 is a sensor (analytical apparatus) 1323, such as, a liquid particle counter or particle size distribution analyzer upstream of which is located dilution equipment to perform a dilution step to provide the slurry or chemical blend, typically slurry, within an expected particle concentration, that is within the optimum or appropriate range for measurement by the liquid particle counter or other analytical apparatus 1323. The dilution equipment comprises an ultra-pure water source, piping, and/or one or more of each of the following: pump (e.g. a peristaltic pump), valves (e.g. needle valve), rotometer and optionally a dilution fixture. The analytical module is in-line, and/or the dilution equipment is in-line and part of the analytical module. The dilution equipment may comprise a single or double dilution. The analytical module may also or alternatively comprise one or more sample loops and by pass lines (described above) from any one or a plurality of modules, for example the feed and/or blend and/or distribution modules. The raw or blended slurry or chemical blend to be measured is supplied via line 1330 (which may be line 1330 in FIG. 2) and ultra pure water is supplied via line 1309 from a deionized water (DIW) source (not shown). There are also optional containers or bottles, 1301 and 1302, and associated with container 1302 an optional pump 1306, piping 1314 and rotometer 1313 (flow meter) which may be used to supply additional components to be added to the slurry or chemical blend or solutions to be measured. The flow meters 1318, 1313 may be used in a feed back control loop to control the speed of the respective pump 1305, 1306. Container 1301, which is connected via line 1303 to the slurry or chemical blend supply line 1330, is a container, or bottle, to be used to supply slurry or chemical blend samples which may or may not be different from the slurry or chemical blend supplied via 1330. Alternatively, container 1301 may comprise a sample of known particle concentration, size and distribution and is used for the purpose of calibrating or verifying that the liquid particle counter or particle size distribution analyzer is still operating as desired and expected.

Container 1302, which is connected via line 1312 to the ultra pure water supply line 1311, is a container, or bottle that may be used to supply additional fluid to adjust the properties, typically pH, of the ultra pure water used to dilute the slurry or the chemical blend. It may be desirable to adjust the pH to test the effect of changing the pH of a raw slurry or chemical blend sample, for example. The flow of the fluid in container 1302 is controlled by pump 1306 typically a peristaltic pump and flow meter 1313 which may be capable of controlling the pump via feedback or used to manually adjust the pump. If no fluid is flowing from container 1302 a check valve (not shown) or a closed valve (not shown) in line 1312 prevents any flow from or into line 1312.

The slurry or chemical blend or the slurry or chemical blend sample contained in 1301 is delivered to the liquid particle counter or particle size distribution analyzer 1323, by optional pump 1305, (a flow controller may alternatively be used if the sample is already flowing under pressure from another source) typically a peristaltic pump, via line 1304. The flow rate of the slurry or chemical blend that discharges from the pump 1305 into line 1317 is measured by flow indicator 1318, which may be used by a technician to adjust the flow of the pump 1305 (or the flow controller if used instead of the pump). Alternatively a controller could be used to control the pump 1305 using the flow rate measured by the flow indicator 1318. Ultra pure water supplied via line 1309 is delivered by the pressure from the facilities to the liquid particle counter and/or particle size distribution analyzer 1323. The rotometer 1310 displays and the needle valve 1307 provides adjustability of the flow rate of the supplied ultrapure water in line 1309. The fluid in the optional container 1302 is optionally delivered by the pump 1306, typically peristaltic pump, and connected to the ultra pure water stream, line 1311, via line 1314 and line 1312, and the flow rate is displayed by the flow indicator 1313. The manual valve 1315, typically needle valve, is used to adjust or shut off the flow of the ultrapure water optionally combined with the fluid from the container 1302, or just the UPW in line 1311, and also provides the effect of mixing the two, ultrapure water and the fluid from container 1302, if present. The manual valve 1320, typically a needle valve, is used to adjust or shut off the flow of the mixture of slurry or chemical blend and ultrapure water and optional compositions from containers 1302 and 1301, via line 1319, which is delivered to the liquid particle counter and/or particle size distribution analyzer (or other analytical apparatus) 1323 via line 1321 and line 1322, and also provides the effect of mixing the two or three or four streams. The liquid particle counter and/or particle size distribution analyzer 1323 is controlled by the controller (not shown) and communicates with the human-machine interface 1360 which is electrically connected to sensor 1323. There is bypass connection, via line 1324, manual valve 1325, typically needle valve 1325, and line 1326, which allows the fluid to go to the drain directly without going through the liquid particle counter and/or particle size distribution analyzer 1323. The flow through the bypass line 1324 can be adjusted or shut off by the manual valve 1325.

The fluid after going through the particle counter and/or particle size distribution analyzer 1323 flows to the drain via line 1327, rotometer 1328, valve 1331 and line 1329. The flow rate through the sensor 1323 is measured and displayed by the rotometer 1328 and can be adjusted by (manually) adjusting the needle valve 1331.

Figure 14:
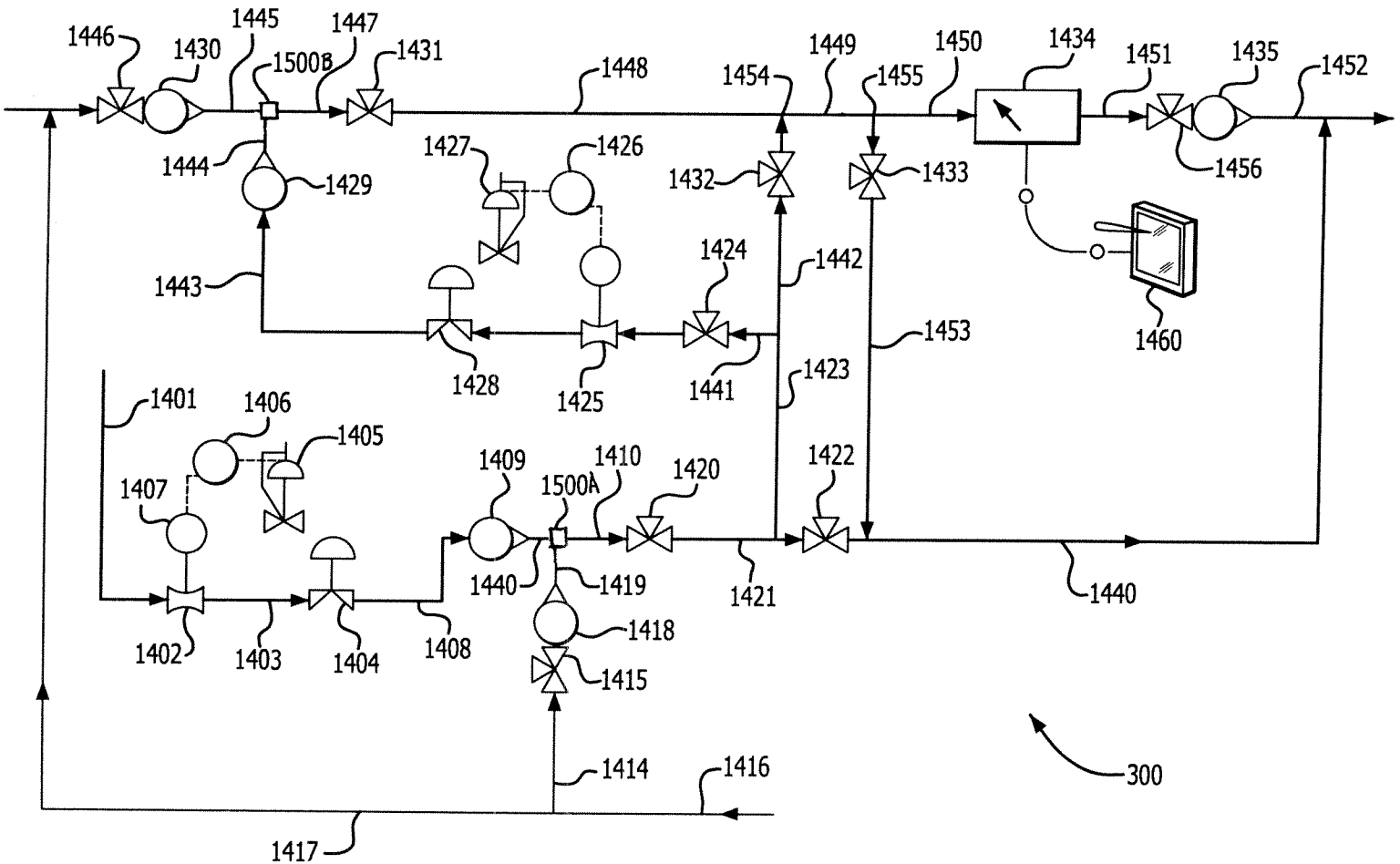
FIG. 14 shows an in-line analytical module comprising an analytical apparatus and two dilutions of a slurry and/or chemical blend sample.
Figure 15:
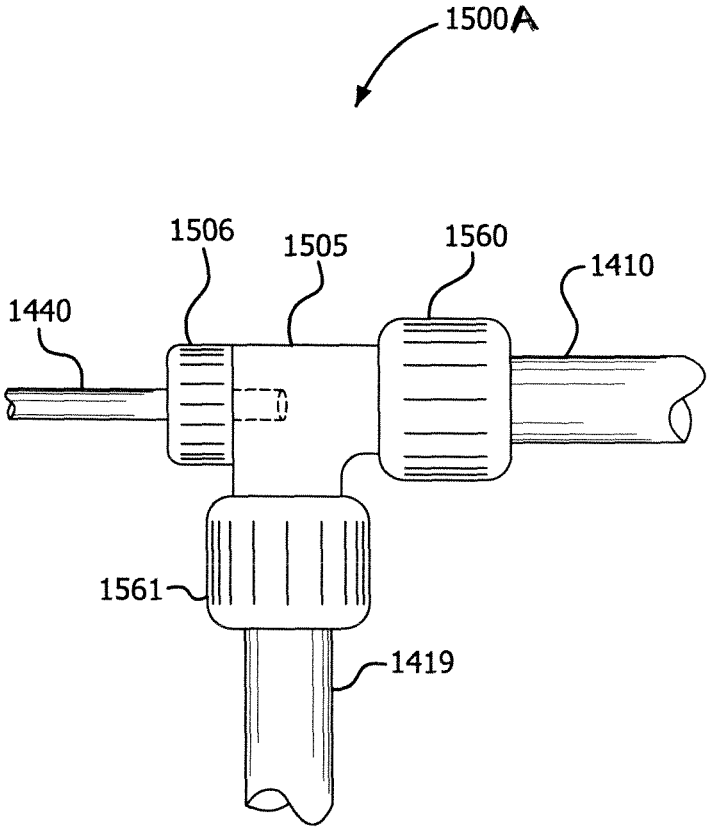
FIG. 15 shows a dilution fixture useful in an in-line analytical module having dilution of the slurry and/or chemical blend.

FIG. 14 shows an in-line analytical module comprising a sensor 1434 and piping and valves to provide for the dilution of the slurry or chemical blend in two steps before the sensor measures a characteristic of the slurry or chemical blend. UPW is supplied via pipe 1416 to the analytical module shown and splits into pipes 1417 and 1414. UPW flows through valve 1415 and rotometer 1418 through pipe 1419 to pipe 1410. Pipe 1410 has slurry or chemical blend flowing therein. Slurry or chemical blend is supplied to the analytical module shown via pipe 1401. The flow of the water through valve 1415 is as described above, either manually or by using feedback controls to the valve using the measurement by the flow meter 1418. The flow of the slurry or chemical blend in pipe 1401 is controlled by a flow controller comprising a flow sensor 1402, a pneumatically controlled valve 1404 having an internal valve controller 1406 and the pneumatic control valve 1405. Such valves are commercially available from for example SMC Electronic. The measurement from the flow sensor 1402 is used by the internal valve controller 1406 to modify the flow of air pressure to the valve 1405 to open or close the valve 1404. The slurry or chemical blend flows through the pneumatically controlled valve 1404 through a visual sensor flow meter 1409 through a dilution fixture 1500A which is used to mix the slurry or chemical blend into the UPW from pipe 1419. (The dilution fixture 1500A is shown in FIG. 15 and will be described below.) The diluted slurry or diluted chemical blend stream in pipe 1410 is then transported through needle valve 1420 which helps to regulate the flow and to mix the diluted slurry or diluted chemical blend stream. The valve 1422 in line 1421 determines whether the diluted slurry or diluted chemical blend stream is directed to the drain via line 1440, or undergoes further processing via line 1423. The diluted slurry or chemical blend in line 1423 either flows to a second dilution step via line 1441 which is connected to line 1423 or flows in line 1442 toward line 1449 and the sensor skipping the second dilution step. Open valve 1424 in line 1441 and closed valve 1432 in line 1442 causes the diluted slurry or diluted chemical blend from the first dilution step to flow in line 1441 to the second dilution step. Closed valve 1424 in line 1441 and open valve 1432 in line 1442 causes the diluted slurry or diluted chemical blend from the first dilution step to flow in line 1442 toward the sensor 1434 after a single dilution step. If valve 1424 is open, the slurry or diluted chemical blend flows through a pneumatically controlled valve 1428 comprising flow sensor 1425, internal controller 1426, pneumatic control valve 1427 and the valve 1428. Valve 1428 controls the flow rate of the diluted slurry or diluted chemical blend from the first dilution step in line 1443. The diluted slurry or diluted chemical blend flows through line 1443, visual flow sensor 1429 and line 1444 to dilution fixture 1500B that is at the junction between the UPW line 1445 and the diluted slurry or diluted chemical blend line 1444. The flow of UPW into the dilution fixture 1500B is controlled in the UPW line via a rotometer 1430 and adjustable needle valve 1446. After the dilution fixture 1500B, the twice diluted slurry or diluted chemical blend flows in line 1447 through needle valve 1431 which helps to blend the twice diluted slurry or diluted chemical blend as it flows to line 1448, past junction 1454 through line 1449, past junction 1455, through line 1450 to the sensor 1434 through line 1451 and through the needle valve 1456 and rotometer 1435 to the drain via line 1452. The needle valve 1456 and rotometer provide for the final adjustment of the flow rate through sensor 1434. Also provided is a by-pass line 1453 at junction 1455 into line 1449. The bypass consists of valve 1433 that must be open to cause the twice diluted slurry or diluted chemical blend to flow into the bypass from line 1449. From there the twice diluted slurry or diluted chemical blend flows to line 1453, to line 1440 and to the drain via line 1452.

Note even though the dilution apparatuses and steps have been described for slurries and chemical blends, a slurry is more likely to be diluted for the purpose of subsequent analysis by a particle counter or particle distribution analyzer.

The rotometers, as described before, also referred to as flow meters or flow indicators may be the type of flow meters or flow indicators that display a flow rate and the adjacent or built in needle valves may be adjusted manually to provide the desired flow rate. The flow rate through the sensors may be any flow rate or from 1 ml/min to 25 liters/min, or from 1 to 200 ml/minute or from 6-8 ml/minute. For particle counters, the control of the volume of fluid analyzed is very important, and too the dilution of starting slurry or chemical blend. For this reason, the use of precise and high quality flow sensors and valves is important. In alternative embodiments, instead of manual valves and visual readers, the dilution process may be fully automated with machine readable sensors and electrical signal controlled valves, such as pneumatic valves.

The dilution fixture 1500A which may be used in one or more dilution steps as shown in FIG. 14 is shown in more detail in FIG. 15. The dilution fixture 1500A comprises a tube 1440 that is connected to a T-shaped pipe connector 1505. The pipe connector 1505 has a cap 1506 over one of the openings into which the tube 1440 is pushed into and held in place by compression. (Because of the low flow rates and pressures, the connection does not leak.) The other two openings of the T-shaped pipe connector are attached via tube fittings 1561 and 1560 to tubes 1419 and 1410, respectively. UPW flows into the T-shaped pipe connector from tube 1419. The slurry or chemical blend or diluted slurry or diluted chemical blend (depending upon the embodiment) is introduced via the tube 1440 into the UPW. The slurry or chemical blend or diluted slurry or diluted chemical blend drips into the UPW from the tube. The diluted slurry or chemical blend flows out of the T-shaped pipe connector via pipe 1410. The tubes can be any size depending upon the desired flow. In the present embodiment, that requires low flows, the tube 1440 that introduces the slurry or chemical blend is ⅛ inch and tubes 1419 and 1410 are ¼ inch tubes. The flow of the slurry or chemical blend to be diluted is typically from 1 to 100 ml/min or from 2 to 50 ml/min or from 5 to 10 ml/min and the flow of the UPW is from 10 to 500 ml/min or from 20 to 150 ml/min or from 40 to 100 ml/min.

The analytical modules shown in the figures can be provided with slurry or chemical blend samples from various sample ports and sample loops in the apparatus as described above. It is preferred that at least one analytical module in an apparatus is continuously used to monitor the slurry or chemical blend and has slurry or chemical blend or UPW flowing through it on a continuous basis from the one or more sample ports in the apparatus. The UPW flowing alone through the sensor is for the purpose of performing a rinse of the analytical module. The order of sampling from the sample ports if there are more than one sample ports, may simply be in succession such as from a first sample port, then a second sample port and then a third sample port and then a fourth sample port and so on (for whatever number of sample ports exists and has slurry or chemical blend flowing through them), etc. and then the process may repeat for each of the sample ports beginning with the first sample port again. In alternative embodiments, the sampling from the sample ports may follow a different pattern and can be in any pattern or no pattern at all. A UPW rinse may be provided between each sample or between every other sample or daily or at any desired interval. The software in the controller for the apparatus 20 can control the taking of samples from the sample ports and the order and the timing of the sampling from each port, which may be overridden by a technician, if needed.

In one embodiment of this invention, the apparatus of this invention comprises at least two liquid particle counters and/or particle distribution analyzers. In that embodiment, a first liquid particle counter and/or second particle size distribution analyzer is used in the feed module for analyzing the raw slurry and a second liquid particle counter and/or second distribution analyzer is used for analyzing the blended slurry sampled from the blend module and/or the distribution module. By having separate liquid particle counters and/or particle size distribution analyzers for those separate modules, the dilution step or steps (flow rates, valve openings, pump speeds, rotometer readings, etc) upstream of those sensors can be carefully established separately and then not changed for the raw slurry and the blended slurry to improve the reliability of the dilution and therefore the reliability of the sensor readings.

Figure 6:
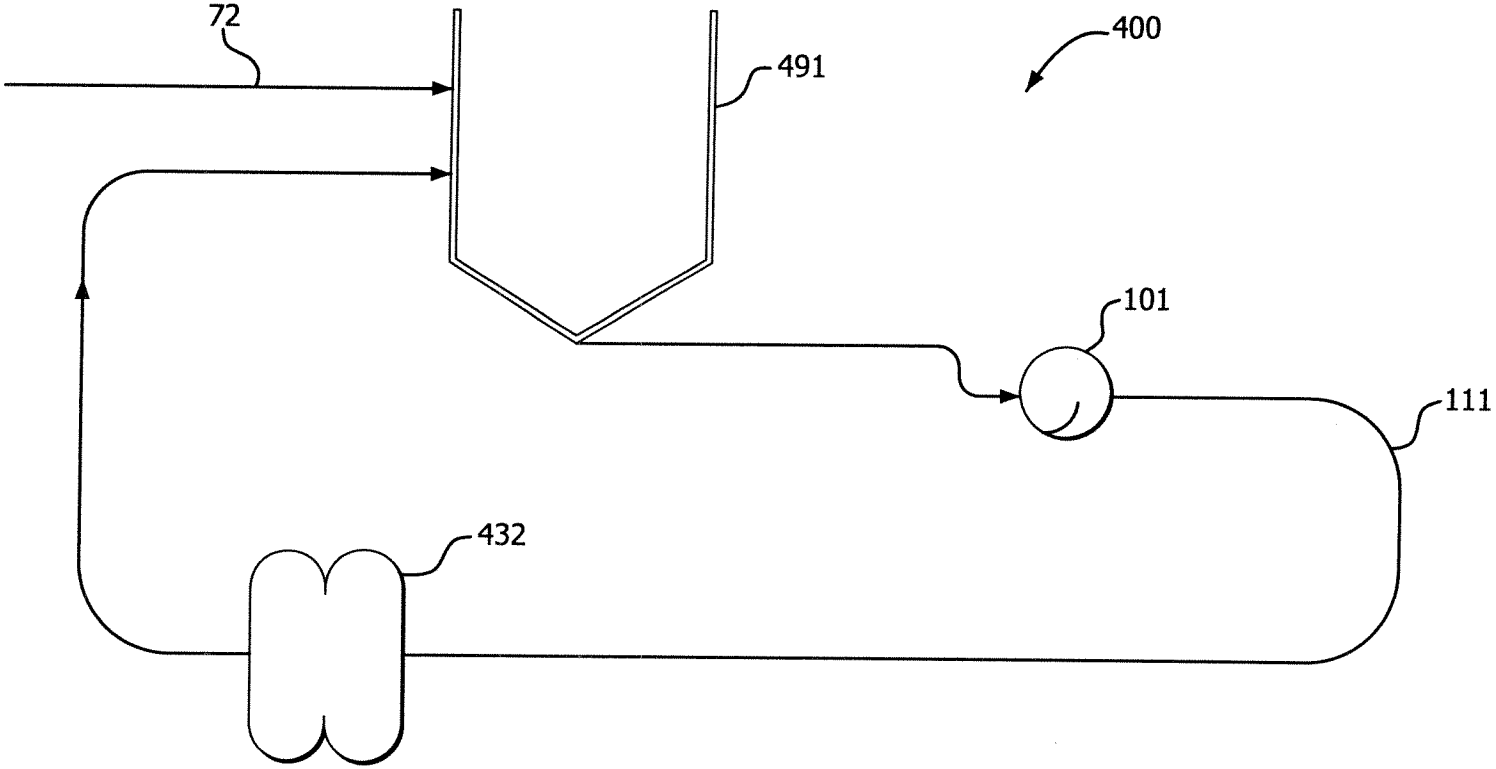
FIG. 6 shows an alternative embodiment of the distribution module useful in the slurry and/or chemical blend supply apparatus of this invention.
Figure 19:
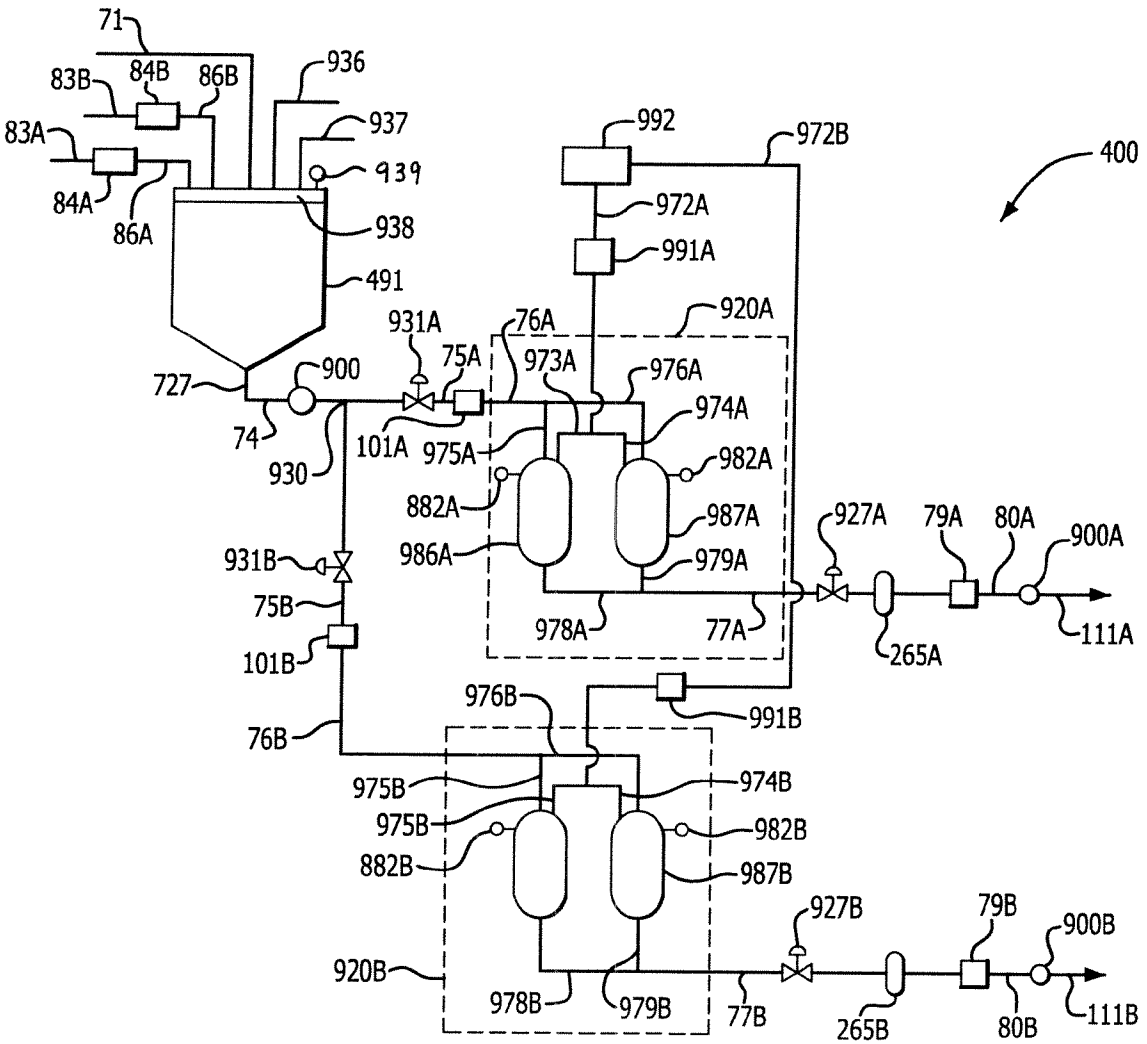
FIG. 19 shows an alternative embodiment of a part of a distribution module useful in the slurry and/or chemical blend supply apparatus of this invention.

Following the blend module 200 and optional analytical module 300, the slurry or chemical blend is transported to the distribution module 400 which can comprise one or more distribution tanks and pumps and global loops as shown in FIGS. 1C and 6 or one or more pumps and one or more pressurized vessels and one or more global loops as shown in FIG. 19 and one or more pumps and one or more pressure vessels and one or more global loops.

In the embodiment of the apparatus 20 shown in FIGS. 1B and 1C the blended slurry or (blended) chemical blend or a portion of the blended slurry or (blended) chemical blend flows through the analytical module 300 or a by-pass (not shown in FIG. 1B, but shown in the embodiment in FIG. 5) of the analytical module prior to flowing to one or more distribution tanks. As shown in FIGS. 1B and 1C, the slurry or chemical blend is transported via line 71 from the analytical module or the by-pass to either or both of lines 72A and 72B to either or both of distribution tanks 491A and 491B. The distribution module 400 may comprise one or more distribution tanks. More than one distribution tank may be provided for large fabs having high demand for blended slurry or (blended) chemical blend and the more than one distribution tanks may supply one or more global loops. Alternatively, one distribution tank may be provided as a backup to the other distribution tank in case the first distribution tank fails or the slurry or chemical blend in one distribution tank is somehow contaminated and must be dumped and the tank cleaned. The redundant distribution tank, pump and global loop could be idle until needed. In some embodiments having more than one distribution tank, although not preferred, the second distribution tank can be filled with the same slurry or chemical blend from the first distribution tank and the first distribution tank can be used to supply slurry or chemical blend through a global loop and distributed to the tools until a switch-over from the first distribution tank and loop to the second distribution tank and loop is needed and provided by the controller. Alternatively, the apparatus 20 comprising the feed module, the blend module, optional analytical module and a distribution module comprising the more than one distribution tanks and distribution loop lines (which may also be referred to as global loop lines, distribution loop or the global loop) could blend different slurries and/or chemical blends (in the simplest embodiment having the same components but having different slurry and/or chemical concentration(s)) to each distribution tank in series and supply the blended slurry and/or blended chemical blend from each (first and second) distribution tank to the same global loop in series or to two different (a first and second) global loops simultaneously. The first and second global loops then could be used to provide slurry or chemical blend to the same tools in series or to different tools that are in fluid communication with each global loop. This invention provides an apparatus that can simultaneously blend to and supply the blended slurry or chemical blend (to one or more global loops and/or one or more CMP or other tools) from a single or more than one distribution tanks. The blend module using flow controllers, (staged) parallel static and/or (staged) parallel dynamic blending (using a pump) makes that possible. The apparatus and method (of using it) does not require batch blending processes using load cells or the like to measure the components before or during the blending process. If the global loop requires continuous blending of slurry or chemical blend, the apparatus 20 can continuously blend and supply blended slurry and/or chemical blend to the global loop. Embodiments of this invention can provide a continuous supply of 10 liters per minute or more or 14 liters per minute or more or 18 liters per minute or more of blended slurry or chemical blend to a plurality of tools, for example 8 or more tools, or 10 or more, or 12 or more tools or 16 or more tools or 20 or more or 26 or more tools (via a global loop).

In yet another embodiment, one distribution tank may be used for slurry and the second tank may be used for a separately blended chemical blend (not containing slurry particles) that may be circulated in a separate global loop and used for example as a rinse stream in for example the same or different CMP tools. In one embodiment the first distribution tank and second distribution tank and first and second global loops in fluid communication therewith respectively can alternate the supply of slurry from the first distribution tank and first global loop and the supply of a chemical blend (for example post-CMP cleans) from the second distribution tank and second global loop to the same tools in fluid communication with the distribution module comprising first and second distribution tanks and first and second global loops. In embodiments in which a chemical blend (without slurry particles) is blended, the blend module is used the same way in the process described above except no raw slurry flows into the blend module. Part or all of the downstream filtering and analysis of the chemical blend in the analytical module may be bypassed if desired. These steps maybe accomplished by closing the appropriate one or more valves.

FIG. 1C shows that the flow of the blended slurry or chemical blend in the distribution module 400 may be directed into line 72A or line 72B by open and closed valves (not shown) in line 72A and line 72B to one of the first and second distribution tanks 491A, 491B. If the valve (not shown) in line 72B is closed, and the valve (not shown) in line 72A is open, the blended slurry or chemical blend will flow through line 72A to tank 491A only. First distribution tank 491A will fill to a previously defined minimum level as measured by the level sensor 82A which communicates with a controller (not shown) and at that time the controller will send a signal to pump 101A to begin pumping the slurry or chemical blend through the distribution loop 111A. The pump 101A will draw (with the help of gravity) the slurry or chemical blend out of the distribution tank 491A via the tank's exit opening 727 connected to line 74A to line 75A through pump 101A to and through the distribution loop 111A which includes line 76A to line 77A through optional pressure sensor 78A through optional flow sensor 79A to line 80A which are all part of the global or distribution loop 111A. The distribution loop 111A, line 80A, delivers the slurry or chemical blend to individual branched lines (not shown) that are in fluid communication between the global loop and CMP or other tools (not shown). The individual lines connected to the global loop 111A have individual valves (also not shown) that may be closed to the slurry or chemical blend or the individual lines or the global loop may have bypass loops that connect with each tool and return the slurry or chemical blend to the global loop when the CMP or other tools are not in operation. If the blended slurry or chemical blend by-passes the CMP or other tools or otherwise is unused by the CMP tools, the global loop(s) return(s) the unused blended slurry or chemical blend via the global loop return pipe 86A, 86B to the distribution module, e.g., one or more distribution tank(s) 491A, 491B. In operation there is preferably always some unused blended slurry or chemical blend in all parts of the global loop that is returned to the distribution tank 491A. The complete distribution loop 111A is not shown in FIG. 1C. It is understood that there is piping not shown connecting pipe 80A and 83A which transports the blended slurry or chemical blend away from the distribution tank(s) to the CMP or other tools and transports (returns) a portion of it back to the distribution tanks. The global loop 111A also comprises one or more back pressure controllers in the loop. As shown in FIG. 1C, located relatively near the distribution tank 491A, as part of the global loop 111A, the global loop 111A comprises back pressure controller 84A. The back pressure controller 84A is located downstream of the junctions (not shown) to the CMP or other tools (not shown) in the global loop 111A in line 83A that is near the return line 86A that is part of the global loop 111A. The one or more back pressure controller(s) 84A in the global loop work in conjunction with the pump 101A and pressure sensor 78A. The pressure sensor 78A measures the pressure, it is communicated to the controller (computer, LPC or the like) (not shown) for the apparatus which compares it to a set point. A PID calculation is performed and the back pressure controller valve is adjusted based upon the controller's electrical signal sent to the back pressure controller 84A. The flow sensor 79A measures the flow rate and via the controller (computer, LPC) determines if the pump speed should be modified and if so communicates with the pump 101A to speed up or slow down the pump speed. These feedback control loops that adjust the pump speed and the back pressure controller repeat the measuring, calculating and adjusting steps continuously or every minute or for any pre-set desired time period which may be longer or shorter than every minute. The back pressure controller and pump speed are adjusted continuously or at set intervals to maintain slurry or chemical blend everywhere in the distribution loop at all times including a sufficient amount to supply the CMP or other tools that are in operation and using the blended slurry and/or chemical blend, but limiting the maximum pressure so that the pipes do not rupture.

In a preferred mode the maximum level in the distribution tank will rarely be reached and the amount of blended slurry or chemical blend present in a tank will for the majority of the time that the apparatus 20 is in operation be between from 20% to 80% or between from 30% to 70% of the volume of the tank and the controller (not shown) for the apparatus 20 will use feedback from the various level sensors and pressure and flow rate sensors in the modules to adjust the feed rates in the feed module 100, if present, and the flow rates in the blend module 200 such that blended slurry or chemical blend is made and provided to the distribution module 400 at a volumetric rate that is similar and preferably nearly equivalent (within +/−20% or within +/−15% or within +/−10%) to the rate (volume/time or mass/time) that the blended slurry or chemical blend from the distribution tank is consumed by the CMP or other tools and not returned to the distribution tank via the global loop. If the consumption of the slurry and chemical blend from the distribution module decreases and the tank reaches a high level, then a level sensor will via the controller stop the blending of the slurry or chemical blend in the blend module. The raw slurry in the feed module will continue to circulate around the feed module loop, but the valve between the feed module and the blend module will close. The blended slurry or chemical blend will continue to circulate around the global loop. When the level in the distribution tank reaches a certain level which may be a relatively low level, which may be established based on the rate of blending versus the typical rate of consumption, the blend module will be activated again.

Similarly, after the blend module 200 and/or the analytical module 300, the flow of blended slurry or chemical blend may be directed into line 72B via a closed valve (not shown) in line 72A and an open valve (not shown) in line 72B to the second distribution tank 491B. Note anything described above for the first distribution tank and first distribution (or global) loop may be part of the second distribution tank and the second distribution (or global) loop and vice versa. Distribution tank 491B will initially fill to a previously defined minimum level as measured by the level sensor 82A at which time pump 101A, if called for by the controller (not shown), will begin pumping the slurry or chemical blend through the distribution loop 111A. The distribution tank will continue to be filled via line 72B from the blend module 200 until a predefined maximum level is reached as determined by the level sensor 82B at which time the flow of blended slurry or chemical blend from the blend module 200 will stop. If a large increase in demand is expected, additional blended slurry or chemical blend can be made and directed to distribution tank 491B to at least partially fill tank 491B with blended slurry or chemical blend as a back up supply to distribution tank 491A. The slurry or chemical blend in distribution tank 491B can be circulated in global loop 111A or 111B and used when needed.

The pump 101B will draw (with the help of gravity) the slurry or chemical blend out of the distribution tank 491B via line 74B to line 75B through pump 101B to and through the distribution loop 101B which includes line 76B to line 77B through optional pressure sensor 78B through optional flow sensor 79B to line 80B which are part of the global or distribution loop 111B. The distribution loop 111B, line 80B, delivers the slurry or chemical blend to individual branched lines (not shown) that are in fluid communication between the global loop and CMP tools (not shown). The individual lines connected to the global loop 111B have individual valves (also not shown) that may be closed to the slurry or chemical blend or the individual lines, or the global loop may have bypass loops off the global loop that cause the slurry or chemical blend to return to the global loop when the CMP or other tools are not in operation. After by-passing or returning from the CMP or other tools or by-passing the lines or branched lines to the CMP or other tools, each global loop returns unused blended slurry or chemical blend to one or more distribution tank(s). The global loop 111B also comprises one or more back pressure controllers in the loop. As shown in FIG. 1C, located relatively near the distribution tank 491B, as part of the global loop 111B, the global loop 111B comprises back pressure controller 84B. The one or more back pressure controller(s) in the global loop 111B work in conjunction with the flow sensor 79B and the pump 101B and the pressure sensor 78B as described above.

As shown in FIG. 1C, there are provided multiple lines in fluid communication with and between the various distribution tanks 491A, 491B, pumps 101A, 101B, 101C, and global loops 111A, 111B that make it possible to divert the incoming blended slurry and/or chemical blend from the blend module to either distribution tank, from one distribution tank to one of a plurality of pumps provided in the distribution module 400 (as shown one or more, such as two or three different pumps 101A, 101B or 101C) and as shown from any of those pumps to either global loop 111A and 111B. The redundancy of distribution tanks and global loops can be used as backup systems when only one distribution tank is necessary for the amount of blended slurry or chemical blend needed in a fabrication plant or the multiple distribution tanks and global loops can be used simultaneously to supply many CMP tools. As shown, if one of the distribution tanks and one global loop is in use, in the embodiment shown, then there are two backup pumps. For example if distribution tank 491A, pump 101A and global loop 111A are being used, then pump 101B is a backup and so is optional pump 101C. If both distribution tanks 491A and 491B, pumps 101A and 101B, and global loops 111A and 111B are in operation, then pump 101C is a backup pump for both pumps 101A and 101B. In other embodiments only pump 101C can backup pumps 101A and 101B meaning that piping may be provided from distribution loop 111A including pump 101A and pump 101C and piping may be provided for distribution loop 111B including pump 101B to pump 101C but no piping from pump 101A in distribution loop 111A to pump 101B in distribution loop 111B may be provided.

Preferably the apparatus 20 is run so that the amount of blended slurry and/or chemical blend being made in the blend module 200 is about equivalent to the amount of blended slurry and/or chemical blend being consumed in the one or more global loops so that a somewhat continuous steady flow of blended slurry and/or chemical blend from the blend module to the distribution module is established and additionally that there is at least a small portion of the slurry and/or chemical blend in the feed module 100, blend module 200 (while it is blending), distribution module 400 and optional analytical module 300 flowing and recirculating continuously. It is preferable that there are no stagnant modules where slurry and/or chemical blend (especially slurry) is not in motion. If lines, tanks, sensors, etc. are not in use, it is preferred to flush them with DIW after the slurry or chemical blend exits the lines and discard the flush water via a waste stream.

It is possible and beneficial to add one or more filter elements (for example, filters or banks of filters) to filter the slurry or chemical blend or a portion of the slurry or chemical blend at one or multiple locations within the apparatus to remove large particles from the slurry or chemical blend that are either present in the raw slurry or chemical component(s) or are formed in the slurry or chemical blend as a result of the blending or moving of the slurry or chemical components within the apparatus. The filter elements with lines to and from the filters may be inserted into the lines of the apparatus to filter 100% of the slurry or chemical blend moving through a line (no bypass of the filter). Since the filters may become blocked by large particles when in use causing the flow through the filter elements to be restricted, in some embodiments, it is preferable to provide a bypass line to bypass the filter element so that the flow of the slurry or chemical blend can continue while a filter is being changed, and it is even more preferable to provide at least 2 filters (or banks of filters) each in parallel so that when one filter or filter bank comprising one or more filters is being changed, the flow can be directed to and through the other filter or filter bank. The parallel filters may be located in a filter loop. It is preferred to have at least one filter or banks of filters or parallel filters or banks of filters in each of the feed, blending and distribution modules. It is preferred to have at least one filter, bank of filters or parallel filters or banks of filters in the global loop, that may be located in a filter loop, preferably upstream of the tools.

Preferably that filter element will filter a majority of or all of the blended slurry or chemical blend flowing in the global loop upstream of the tools.

Pressure sensors can be used to measure the pressure upstream or downstream of the filter (element, e.g. filter bank) to determine when the flow should be directed away from a first filter (or other filter element, e.g. bank of one or more filters) and associated pipes and valves to a second filter (or other filter element, e.g. bank of one or more filters) and its associated pipes and valves or through a bypass pipe, if parallel filters are not provided. For parallel filters, the pressure sensor can communicate with the controller for the apparatus to cause a change in valves to direct the slurry or chemical blend away from the first filter (first filter element, e.g. bank of one or more filters) to the second filter (or second filter element, e.g. bank of one or more filters). When the flow of slurry and/or chemical blend is stopped to the first filter (or bank of one or more filters), the controller can signal a technician to change the filter(s) and the process can be repeated until the flow to the second filter(s) or the second filter element becomes restricted. The location of the filter(s) or other one or more filter elements in fluid communication with at least one global loop provides constant filtration to one or both global loops (or wherever the filter element, e.g. filters or filter banks are located).

FIG. 1C shows one embodiment of distribution module 400 comprising one or more filters, specifically parallel banks of one or more filters 430 and 431. In the embodiment shown the distribution tank comprises a separate filter loop comprising a filter piping loop that flows slurry or chemical blend from a source, in this embodiment, the distribution tank through one or more filters and returns the slurry or chemical blend to the source, in this embodiment, the distribution tank. The pipes in the filter loop may be independent of any other loop or piping in the apparatus. The filter loop preferably comprises a pump that causes the slurry or chemical blend to flow from the distribution tank (source) through one or more filters or banks of filters and return to the distribution tank (source). The filter loop comprises pipes that connect the distribution tank (source) to the pump to the one or more filters or filter banks. The pump is preferably independent of the rest of the apparatus 20 and only pumps slurry or chemical blend from a source and through the filter loop and back to the source or near the source via a return pipe. In this embodiment the slurry is drawn from the distribution module and is returned to the distribution module. It could be from the distribution tank and back to the same or to the global loop, or from the global loop and back to the global loop or to the distribution tank. The filter loop preferably comprises more than one filter or banks of more than one filter and appropriate valving, sensors and piping to switch from a first filter or bank of filters to a second filter or bank of filters when it is time for a filter change.

When it is desired to filter the slurry or chemical blend in the distribution tank 491A, it is done so through filter loop 700. Filter loop 700 comprises a slurry or chemical blend source (in this embodiment the distribution tank 491A), pump 101D, and one or more filters 430, 431 and piping, optional valves and optional pressure sensors. To filter slurry or chemical blend in the filter loop 700, pump 101D is activated and an optional valve (not shown) in line 91A and/or optional valve (not shown) in line 75A may be adjusted so that the slurry or chemical blend flows into line 91A, through pump 101D, through line 92, through line 93, through the first filter bank 430, through line 94, through line 97 and through tank return line 98 to distribution tank 491A.

In the embodiment shown, the flow of slurry or chemical blend through filter 430 in the filter loop 700 will continue as described until one or more of the following occurs: (a) the filter age limits have been exceeded causing a filter bank swap, (b) the global loop needs more slurry or chemical blend fed to it from the distribution tank and there is not enough slurry or chemical blend in the distribution tank to continue to direct slurry or chemical blend through the filter loop and the global loop, or (c) a pressure sensor (not shown) senses an increase in the pressure in the line 93 and the controller switches the flow of slurry or chemical blend from first filter bank 430 to second filter bank 431 or (d) the liquid particle counter is out of specification triggering a filter change. Flow is switched from line 93 to line 95 by switching valves (not shown) in lines 93 and 95 from open to closed and closed to open respectively. The action of pump 101D then causes the slurry or chemical blend to flow through line 95 through second filter bank 431 through line 96 and returns to distribution tank 491A via return line 98. Filtration will continue in the filter loop 700 via second filter bank 431 until at least one or more of the events (a), (b), and (d) described above occur or (e) a pressure sensor in line 95 detects that the filters in second filter bank 431 are getting blocked up and need changing, then the valves (not shown) in lines 93 and 95 will switch from closed to open and open to closed respectively and the flow of slurry or chemical blend will switch to first filter bank 430. The valve changes described above may be performed manually or automatically by a controller (not shown) for the slurry or chemical blend supply apparatus.

The filter loop 700 was described above with the source of the slurry or chemical blend being distribution tank 491A. The filter loop 700 will operate the same if the source of the slurry or chemical blend is second distribution tank 491B shown in FIG. 1C, except that the pump 101D would draw the slurry or chemical blend from second distribution tank 491B via line 91B. (Valves (not shown) in lines 91A and 91B would have to be switched from open to closed and closed to open respectively to cause the slurry or chemical blend to flow from second distribution tank 491B through pump 101D and through the rest of the filter loop 700. The filter loop would operate as described above with the slurry or chemical blend from distribution tank 491B except that the return line 99 (instead of return line 98) would return the slurry or chemical blend to distribution tank 491B. In an alternate embodiment if both distribution tanks are to be used simultaneously, a second filter loop could be provided for the second distribution tank 491B similar to filter loop 700 shown in FIG. 1C. The second filter loop would be used by the second distribution tank 491B.

When either or both of the distribution tanks are operating, either or both distribution tanks can supply slurry and/or chemical blend to the filter loop 700, and/or the global loops 111A, 111B. Either or both of the distribution tanks can simultaneously supply slurry (the same or two different slurries), a slurry and a chemical blend or two different chemical blends or the same chemical blend to the filter loop and either or both global loops. For distribution tank 491A valves (not shown) in lines 91A and 75A can be set or controlled so that some of the slurry or chemical blend in line 74A will flow (continuously or semi-continuously or at whatever interval is desired) through the filter loop 700 by action of pump 101D and the rest of the slurry or chemical blend in line 74A will flow continuously through the global loop 111A by action of pump 101A. Alternatively, either or both of the distribution tanks can alternatively supply slurry or chemical blend to the filter loop. For distribution tank 491A valves (not shown) in lines 91A and 75A can be set or controlled so that all of the slurry or chemical blend in line 74A will flow through the filter loop 700 by action of pump 101D or all of the slurry or chemical blend in line 74A will flow through the global loop 111A by action of pump 101A. In some embodiments only some of the slurry or chemical blend will be filtered prior to flowing it through the global loop. Alternatively, in other embodiments, all of the slurry or chemical blend will be filtered prior to sending it to the global loop. In the preferred embodiment the blended slurry or chemical blend is provided to the distribution tank which is providing slurry or chemical blend to the global loop and simultaneously supplying a portion of the slurry or chemical blend to the filter loop. When simultaneous filtering is happening to a portion of the slurry or chemical blend from the distribution tank, at the same time the global loop is supplied, then only a statistical amount of slurry or chemical blend will be filtered prior to being pumped into and through the global loop. The statistical amount can be increased or decreased based on the portion of the slurry or chemical blend directed to the filters.

The flow of the slurry or chemical blend through the filter loop 700 may be continuous so the slurry or chemical blend or a portion thereof in the distribution tank is continuously having large particles or agglomerates, if present therein, removed therefrom.

In alternative embodiments pipe 97 that are not shown, could be returned to the global loop preferably on the suction side of the pump 101 or another pipe could be provided to provide the option of sending the flow from the filter loop to the global loop preferably connecting pipe 97 to the global loop before pump 101. Valves in pipe 97 and the added pipe could be used to direct the flow either to the distribution tank and/or the global loop as desired.

The filter loop 700 has been described where the source is the distribution tank; however, it would be beneficial to provide a filter loop using an alternative source for the slurry or chemical blend to be filtered elsewhere in the apparatus. For example, a filter loop would be beneficial using the slurry supply container or day tank as the source (parts of the feed module). Because slurry or chemical blend has the potential to degrade over time and/or degrade upon movement, (mixing, blending, and air contact) through the apparatus, it is preferred to provide filtering in more than one module, for examples, in the feed and distribution modules, the blend and distribution modules, or the feed and the blend modules, or the feed, blend and distribution modules. Further, the analytical module may have a filter loop too in combination with any of the embodiments just described. Providing an independent filter loop comprising at least one filter, a pump, valving and piping is preferred in the feed module and the distribution module, and optionally the blend module too or in the blend and the distribution module or in any of the combination of modules just described.

FIG. 6 shows an alternative embodiment of a distribution module 400 comprising a global loop, pump, one or more filters and a slurry or chemical blend supply line. The distribution tank 491 is supplied blended slurry or chemical blend via supply line 72 (that may be from a blend module 300). Distribution tank 491 supplies blended slurry or chemical blend to a global loop 111 by the action of pump 101. The global loop 111 supplies one or more CMP or other tools (not shown) and within the global loop is a filter bank 432, that filters the blended slurry and/or chemical blend before it is returned to the distribution tank 491. Adding a filter element or filter banks into the global loop provides the benefit, especially if the filter or filter banks are provided upstream of CMP or other tools, that all of the slurry or chemical blend will be filtered prior to use in the CMP or other tools and filtered in close proximity to the CMP or other tools. Preferably a pair of filters or filter banks that may be in a filter loop are provided, that are preferably in a parallel arrangement and may switch from a first filter or filter bank to a second filter or filter bank when needed as described above. This switch from a first filter or filter bank to a second filter or filter bank is sometimes referred to as a filter swap.

Figure 17:
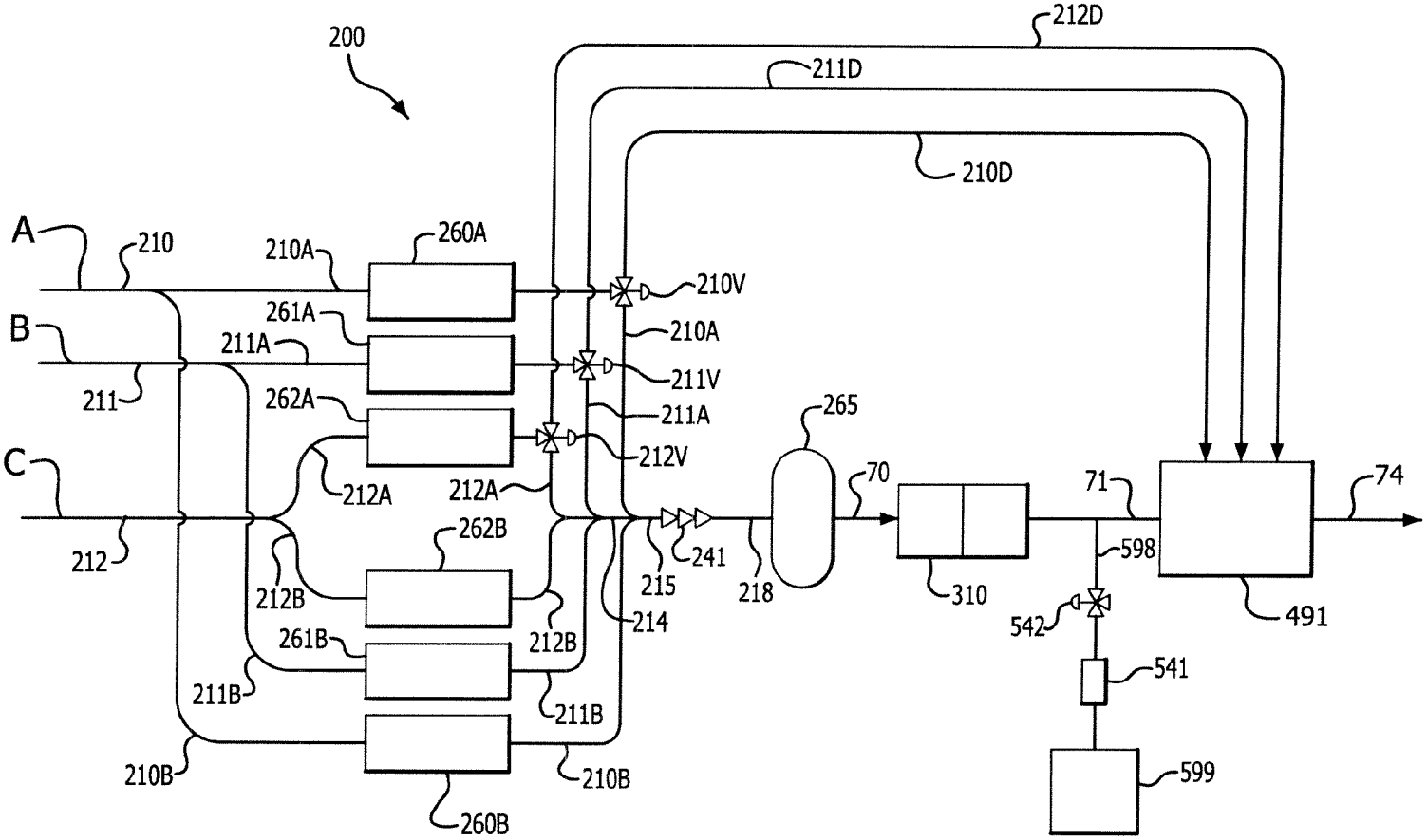
FIG. 17 shows an alternative embodiment of the blend module, analytical module and part of the distribution module useful in the slurry and/or chemical blend supply apparatus of this invention.

FIG. 17 shows another embodiment of a slurry and/or chemical blend apparatus of this invention comprising a blend module and a distribution module. Only part of the distribution module is shown in FIG. 17. As shown, the distribution module comprises a distribution tank 491. In most cases, the same or similar numbers as used in the alternative embodiments were used in FIG. 17. In another embodiment of the methods and apparatuses of this invention, the components are at least partially blended by flowing multiple component streams into fewer and fewer pipes until there is a single pipe containing all the component streams that are used to make a blended chemical blend. So for example, for a blend module having first, second and third components flowing in first, second and third component pipes, first and second component pipes can flow into a first combined pipe and then the first combined pipe and the third component pipe can flow into a second combined pipe. For an example with 4 components flowing in first, second, third and fourth component pipes, first and second component pipes can flow into a first combined pipe, and 2 pipes which may be selected from the first combined pipe, the third component pipe and the fourth component pipe flow into a second combined pipe, and the second combined pipe and the remaining pipe may be combined. For five or more components, the same process may be repeated, just another component pipe is added to the blend module, and there may be one more combined pipe too, if all the component streams are combined with just one other stream in series.

As shown in FIG. 17, the blend module (any of the blend modules) may comprise one or more static mixers (only one is shown) in the lines comprising partially or fully blended slurry or chemical blend. The flow is controlled in the component feed lines using flow controllers. As shown in FIG. 17, the blend module 200 comprises lines for three components used to form the slurry or chemical blend. The components A, B and C flow respectively into the blend module 200 via lines 210, 211 and 212, typically from a Bulk Chemical Supply portion of a manufacturing facility, or from a feed module if a blended slurry is to be made. Alternatively, chemical or other components could be supplied from drums. The water or chemicals can be pumped or supplied via another high pressure source or via gravity. Each of the lines 210, 211 and 212 for chemicals A, B, and C respectively may flow into either or both of the lines labeled A and B that are in fluid communication with the component feed lines as follows: component feed line 210 is in fluid communication with lines 210A and 210B; component feed line 211 is in fluid communication with lines 211A and 211B; and component feed line 212 is in fluid communication with lines 212A and 212B. Lines 212A, 210A and 211A each have flow controllers therein, respectively 262A, 260A and 261A. As shown, in FIG. 17, the blend module 200 that is part of apparatus 20 comprises optional redundant lines 210B, 211B and 212B having separate flow controllers 260B, 261B and 262B respectively. The pipes and flow controllers therein labeled B may be used when there is a problem with one or more of the lines 212A, 210A and 211A and/or one or more of the flow controllers 262A, 260A and 261A. The A parts and the B parts in the blend module may be referred to as separate blend trains, that is blend train A and blend train B. In one embodiment, the parts of the blend module 200 labeled with the B following the number in the blend module are parts of a backup (redundant) blend train B in the blend module. The embodiment shown in FIG. 17 will be described for flow through the parts identified with an A, blend train A, however, it is understood that the B parts of the blend module work the same way and can be used simultaneously or as a back-up as described for the A parts in the embodiments. Valving (not shown) in the A and B lines would be opened and closed or partially opened or partially closed to direct the flow of the components to the A-labeled parts and/or the B-labeled parts. It is preferred that the valves are either open or closed and that the A-labeled blend train or the B-labeled blend train is used to blend a slurry or chemical blend.

Flow controllers 261A, 260A and 262A work as described above in reference to FIGS. 1B, 3 and 4. In the embodiment shown in FIG. 17, lines 212A and 211A, after exiting the flow controllers in each line are combined into line 214 forming a partially blended slurry or a partially blended chemical stream comprising component C and component B and line 214 is combined with line 210A after it exits flow controller 260A into line 215 forming a blended slurry or blended chemical blend stream comprising components A, B and C. The blended stream comprising components A, B and C then flows into a static mixer 241 to mix the components that originally were in lines 210A, 211A and 212A.

In alternative embodiments, multiple static mixers could be used, for example to mix the partially blended chemical blend in line 214 (comprising components B and C) before combining the component A stream in line 210A with stream 214.

In the embodiment shown in FIG. 17, the slurry or chemical blend in line 218 that exits mixer 241 (comprising mixed components A, B and C) flows through an optional filter 265. The filter is provided to collect any particles that may form due to any chemical reactions between the components due to the blending or that were present as an impurity in one of the otherwise typically high purity component streams A, B and C. Alternatively one or more banks of filters could be provided that can be in series or in parallel arrangements and/or may be in a filter loop as described above for any of the filter elements used in any of the other modules or embodiments described above. If the apparatus supplies a chemical blend only, two or more filters with decreasing pore sizes in series are preferred.

The filter elements including filter loops may be used in one or more of the feed module, blend module, analytical module and distribution module or connected to any piping in any embodiment of this invention.

After the filter element 265, the slurry and/or chemical blend supply apparatus 20 may comprise an optional analytical module 310 in fluid communication with the filter element and to which the slurry or chemical blend exiting the filter flows. As shown line 70 connects and transports the slurry or chemical blend exiting the filter module to the analytical module 310. The slurry or chemical blend exiting the analytical module flows to the distribution tank 491 via line 71. Embodiments of the analytical module have been described in detail above and will not be repeated here. In alternative embodiments, the analytical module may, alternatively or additionally, be located downstream of the distribution tank 491 and may analyze the slurry or chemical blend prior to its delivery to its point of use which may be a tool, such as a cleaning tool in a semiconductor fab or another slurry or chemical blend mixing device, such as, a separate slurry supply apparatus. The analytical module may receive and analyze the entire stream or a portion which may be a small portion of the slurry or chemical blend if needed or for some slurries or chemical blends the analytical module may be by-passed if desired. Note also that the location of the filter and the analytical module may be switched if desired, and the filter element may be by-passed unless the analysis of the slurry by the analytical module indicates that the slurry or chemical blend should be analyzed in which case the slurry will be directed to the filter element by the controller, by opening and closing valves (not shown) and filtered by the filter element.

In this embodiment, the slurry and/or chemical blend supply apparatus 20 may further comprise means to dose the chemical blend in the tank 491. As shown, pipes 210D, 211D and 212D are provided for components A, B and C respectively. If, for example, an operator, one or more analytical apparatuses that are part of the analytical module, or an algorithm (may be based on time) determines that a dose of one or more of the chemical components is needed into the slurry or chemical blend present in the distribution tank, the flow into one or more of the pipes 210D, 211D and 212D of the respective component(s) is allowed by opening the one or more corresponding three-way valves 210V, 211V and/or 212V connected to pipes 210D, 211D and 212D. In the embodiment shown in FIG. 17, while the dosing is taking place, the overall controller for the apparatus will adjust the flow of the component(s) through one or more flow controllers 260A (or 260B), 261A (or 261B) and/or 262A (or 262B) to allow only the component or components to flow to the distribution tank 491 for dosing the distribution tank. The flow of one or more of the components may be stopped. Preferably, the blending in the blend module will be temporarily discontinued until the flow of the one or more components measured by the flow controller 260A (or 260B), 261A (or 261B) and/or 262A (or 262B) for the dosing step is complete. The dosing may be timed by the controller using totaling software to provide the total amount of desired component or components to be dosed into the distribution tank. Providing a dosing means is particularly desirable if one or more of the components in the chemical blend has (have) a relatively short shelf life. Additionally, dosing the distribution tank may be in response to an analysis of the slurry or chemical blend being analyzed in analytical module 310 after blending or after being transported in the global loop (not shown). The analytical module 310 may receive slurry or chemical blend for analysis via sample ports and tubes or loops as described above. (In separate embodiments pipes 210D, 211D and 212D may be equipped with separate flow controllers (not shown), especially when located upstream of flow controllers 260A, 261A and 262A.)

Also provided in the embodiment of the slurry and/or chemical blend supply apparatus shown in FIG. 17 is a sample compartment 599. The sample compartment was described above in reference to FIG. 5, the only difference being that valve 542, although described above was not shown in FIG. 5, but is shown in line 598 of FIG. 17. The description above is otherwise fully applicable here.

In the embodiment shown in FIG. 17, if one or more of the components are strong acids or bases (having either a low pH and/or high pH), it is preferred to mix the most reactive component with the least reactive component, that is, typically either a strong acid or base should be combined first with water, an unreactive diluent or unreactive solvent. In this way, the most reactive component will be diluted before combining it with the next component to be added to make a partially blended slurry or partially blended chemical blend or to make the fully blended slurry or fully blended chemical blend. As shown in FIG. 17, it is therefore, preferred to introduce water or unreactive diluent or unreactive solvent into the blend module 200 as component stream B. If there are 2 other components to be combined, stream C will typically be the most reactive and stream A will be less reactive than stream C. If a slurry is being blended, the raw slurry is typically component stream A or C.

Figure 18:
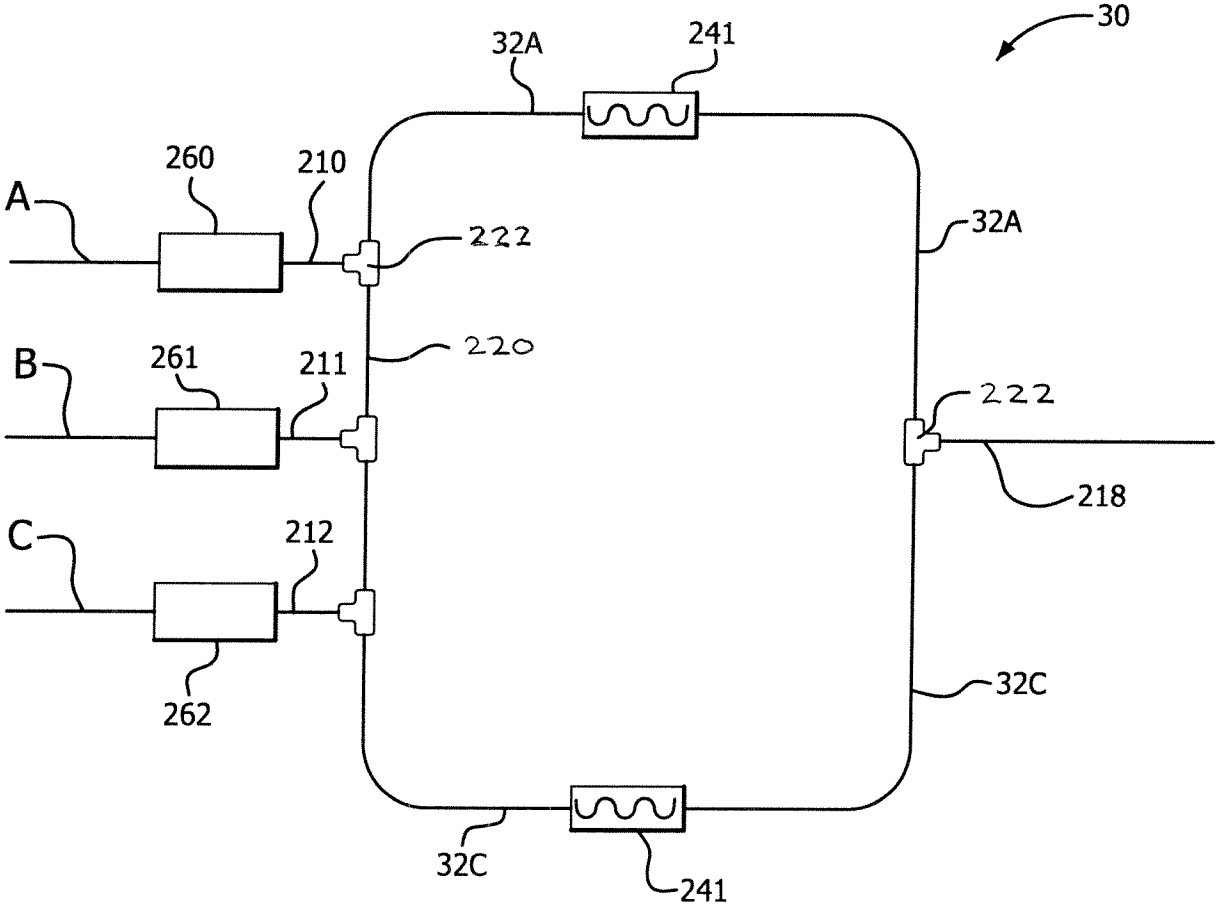
FIG. 18 shows an embodiment of a split mixer of a blend module useful in the slurry and/or chemical blend supply apparatus of this invention.

FIG. 18 shows an alternative embodiment of a portion of the blend module, showing three individual component streams comprising lines 210, 211 and 212 for each of components A, B, and C that flow into and combine in a split mixer 600. (The split mixer as shown is used instead of the blend trains using the staged blending or the pump (dynamic) blending shown in the other figures. In alternative embodiments, it could be used in addition to the staged or pump blending.) The amounts of components A, B and C that are mixed by the split mixer are controlled by flow controllers 260, 261 and 262 respectively. The split mixer 600 optionally comprises one or more static mixers 241, one or more feed pipes for each of the component streams to be combined (as shown pipes 210, 211 and 212), connected to receiving pipe 220 that is connected at opposite ends of the receiving pipe (as shown) to at least 2 split pipes (labeled 32A and 32C) such that the flow of the components into the split mixer are split between the at least 2 split pipes that come together or are ultimately reconnected in a rejoinder pipe 218 in which all the components are present as the blended slurry or blended chemical blend. Within one or more of the split pipes 32A and 32C may comprise one or more static mixers 241. The feed pipes 210, 211, 212 and receiving pipe 220 may be connected via connectors 222 shown as t-shaped connectors. It is preferred to use the split mixer 600 when one or more of the components may be reactive with or potentially negatively impacted by one or more of the components if quickly mixed together at high concentrations and one of the components is not reactive with either of the reactive components. In that embodiment the least reactive component (as shown component B) can be introduced between the one or more reactive components (as shown components A and C) such that the flow of component B will split between the split pipes 32A and 32C and will dilute each of the reactive components A and C in each of those pipes. Typically, component B is water or an unreactive liquid diluent. The amounts and ratio of the flow of component B into each of the split pipes 32A and 32C will be dependent upon the relative flow rates of the components flowing into the split mixer, any flow directors if present in the pipes and/or the connectors including the shape of the connectors, and the pipe sizes. In the embodiment shown in FIG. 18, the split mixer can be used so that a majority, if not all, of component A will flow through pipe 32A with a portion of component B, and a majority, if not all, of component C will flow through pipe 32C with the balance of component B flowing into the split mixer 600. The flow rates of each of the components A, B and C into each split pipe 32A and 32C can be adjusted by adjusting the size of the pipes in the split mixer, or adding flow directors within the pipes or the flow connectors, which can include changing the angle that the component stream is directed into the split mixer, for example using a Y-shaped connector instead of a T-shaped connector. Other examples of flow directors, include putting any type of restriction in a pipe to limit the flow therein or change the direction of the flow, such as a valve, e.g. a check valve or the like. Both of the streams in pipe 32A and 32C will be blended by the static mixers and the streams will meet and mix in the connection 222 that attaches to and combines the contents of pipes 32A and 32C into rejoinder pipe 218. The stream in rejoinder pipe 218 is the blended slurry or chemical blend. In alternative embodiments, not shown in which more than 3 components are blended, a split mixer can be used as is, if two of the component streams are combined upstream or downstream of the split mixer. Alternatively, another feed pipe can be added to the split mixer to provide 4 feed pipes into pipe 220 or alternatively into one or both of the split pipes 32A and 32C. Depending upon the expected or desired flows through the pipes, pipe sizing or check valves can be provided in the split mixer 600 to provide for the desired mixing and flow. The split mixer is shown in FIG. 18 as having a rectangular shape, it can be rectangular or diamond or curved (meaning, for example, that the receiving pipe may not have defined ends and may just bend into split pipes that may run adjacent to each other to a connector to the rejoinder pipe) or any shape desired as long as at least a first component stream is split into at least two streams and at least a first portion of the first component stream is mixed with at least a portion (preferably at least a majority) of a second component stream, and preferably simultaneously a second portion of a first component stream is mixed with at least a portion (preferably at least a majority) of a third component stream.

Line 218 in FIG. 18 comprises the blended slurry or chemical blend that flows to the distribution module 400 and may flow through (or a portion or a sample thereof may flow through) an optional filter element 265 and/or an optional analytical module 310, as shown in FIG. 17. As shown in FIG. 17, the entire stream of the chemical blend or blended slurry is filtered in the filter element 265 and the entire stream of the chemical blend or blended slurry is analyzed is the analytical module 310. Alternatively, only a sample of the stream of the blended slurry or chemical blend is analyzed in the analytical module and/or only a portion of the stream of the blended slurry or chemical blend is filtered by the filter element 265. In an alternative embodiment, line 218 may connect with a blend module pump (not shown), if a pump is needed to transport the chemical blend or blended slurry to one or more of the distribution module, filter element and/or analytical module.

FIG. 19 shows another embodiment of the distribution module of this invention that can be used in combination with any of the other modules (blending and/or analytical and/or feed module) or aspects in an apparatus of this invention. As shown in FIG. 19, the slurry or chemical blend is transported via line 71 from the blend module to the distribution module 400 comprising a distribution tank 491. As with the other embodiments, line 71 may be connected directly to and transport slurry directly from the blend module, an analytical module, a filter element before or after either of the blend module or analytical module, or from a by-pass line for either or both of an analytical module and a filter element. The distribution module 400 may comprise one or more distribution tanks (as shown and/or described for earlier embodiments).

As shown in FIG. 19, the distribution module 400 comprises one or more distribution tanks, as shown one distribution tank 491 and at least one global loop, as shown two global loops 111A and 111B supplied by the distribution tank 491. Additionally, the distribution module 400 comprises at least one pressure vessel element, two pressure vessel elements 920A and 920B are shown, each one being in fluid communication with the distribution tank 491 and one of the global loops 111A or 111B. The distribution module 400 may further comprise one or more filter elements. As shown, there are two filter elements 265A, 265B downstream of each of the pressure vessel elements. Each global loop comprises at least one filter element. Additionally, the distribution module 400 comprises at least one pump, as shown, each pressure vessel element 920A and 920B has at least one pump 101A, 101B that is in fluid communication with it and transports slurry or chemical blend to the pressure vessel element 920A or 920B from the distribution tank 491. In alternative embodiments, one pump could be used with the addition of at least one valve or two or more valves and associated piping to transport slurry or chemical blend to one or two or more pressure vessel elements. Further in another alternative embodiment, one pressure vessel element 920A could transport blended slurry or chemical blend to one or more global loops, however, in the preferred mode there are two pressure vessel elements, each having at least one pump in fluid communication therewith. Additionally or alternatively, two or more pressure vessel elements could supply a single global loop. In that embodiment, the pressure vessel elements 920A, 920B would each be connected to the same global loop that would preferably comprise at least one filter element and at least one flow sensor or transmitter downstream of the pressure vessel element in the global loop. The pressure vessel element 920A, 920B could simultaneously or in an alternating fashion supply the same global loop. Alternatively, one pressure vessel element could be used only for back up purposes should one pressure vessel element not function. As in earlier described embodiments, the pump, pressure vessel element and global loop labeled with a B may be provided as a backup of the A labeled parts and would only be used in case of a failure. In alternative embodiments, the A and B labeled parts will be used simultaneously to supply two different global loops to two different or the same sets of tools or both pressure vessel elements will be used serially to supply the same global loop.

As shown in FIG. 19, the distribution module comprises a connection (pipe) between the pressure vessel element 920A to a pressurized air or inert gas source 992, and a pressure regulator 991A located in the pipe between the pressure vessel element 920A and the pressurized air or inert gas source. The pressure regulator may be an electronic pressure regulator. The pressure regulator maintains the pressure in the pressure vessels 986A and 987A at a pressure at or lower than the pressure of the pressurized air or inert gas source 992, preferably less than the pressure of the pressurized air or inert gas source 992. The pump that supplies the one or more pressure vessels of the pressure vessel element is selected so that it can push the slurry or chemical blend at a pressure higher than the pressure in the pressure vessels so that the slurry or chemical blend will flow into the pressure vessels. By the action of the pressure regulator, the pressure in the (one or more pressure vessels of the) pressure vessel element will be maintained at a substantially steady pressure even if the action of the pump imparts an uneven or unsteady (a pulsing) pressure to the pumped slurry or chemical blend that is pumped into the pressure vessel element. Stated differently, the pressure regulator 991A is used to regulate the pressure and maintain the pressure in the one or more pressure vessels of the pressure vessel element at a steady pressure within a desired range in the pressure vessel element. In the preferred embodiment, while the global loop is continuously supplied by the pressure vessel element, the pump in fluid communication with the pressure vessel element continuously supplies the pressure vessel element with slurry or chemical blend and the pressure regulator continuously maintains the pressure in the pressure vessel element at a steady pressure, so that the supply to the global loop of the slurry or chemical blend is continuous and at a substantially steady flow rate.

The rate at which the blended slurry or chemical blend is pumped by either or both of pumps 101A and/or 101B to the one or more pressure vessel elements is typically determined by the rate that slurry or chemical blend exits the one or more pressure vessel elements and enters the one or more global loops. If both global loops are to be supplied simultaneously by both pressure vessel elements, the distribution tank and related pumps and piping can be sized so that they are able to supply both global loops simultaneously. In an alternative embodiment both pressure vessel elements may be supplied serially and the distribution tank, pumps and piping can be sized for that level of operation. The flow rate of the slurry or chemical blend to the one or more global loops can be regulated by regulating the pressure (via the pressure regulator) in the pressure vessel element. To increase the flow rate, the pressure in one or both of the pressure vessel elements can be increased; to decrease the flow rate the pressure can be decreased.

Like in other embodiments, in the distribution module in FIG. 19, blended slurry or chemical blend will flow to and fill the distribution tank 491 to a previously defined minimum level as measured by the level sensor 939, which may be an ultrasonic level sensor, which communicates with a controller (not shown) that the distribution tank 491 is ready to supply slurry or chemical blend to at least one of the global loops. The controller will already know by previous programming or a technician's input if one or both of the global loops are to be supplied and on what basis. If one global loop is to be supplied, then the controller will send a signal to both of the valves 931A and 931B to direct one to close and one to open and also it will send a signal to one pump 101A or 101B to begin pumping the slurry or chemical blend. (The operating pump and open valve will be located in the same plumbing line labeled A or B after the associated numbers.) For example, if global loop 111A is to be supplied, then valve 931B will be (or remain) closed and pump 101B will be (or remain) idle and valve 931A will open or remain open and pump 101A will pump slurry or chemical blend to the pressure vessel element 920A. When pump 101A is pumping, it will draw the slurry or chemical blend out of the distribution tank 491 via the tank's exit opening 727 connected to line 74 through pipe junction 930 through valve 931A, through pump 101A and push the slurry or chemical blend (at a higher pressure than the pressure vessel element 920A through pipe 76A to the pressure vessel element 920A. The pressure vessel element 920A comprises one, two or more pressurized vessels, two pressure vessels 986A and 987A are shown. The pressure vessel element 920A further comprises pipes 973A and 974A that provide a connection to and are in fluid communication between the pressure vessels 986A and 987A and a pipe 972A that connects to a pressurized air or inert gas source 992A. (For some embodiments, a pressurized inert gas source will be preferred or required.) Pipe 972A comprises a pressure regulator 991A that controls the connection between pressurized air or inert gas source 992 and the pressure vessels 986A and 987A of pressure vessel element 920A. The (electronic) pressure regulator 991A is used to maintain the pressure within a desired range in the pressure vessel element 920A.

When pump 101A is running the slurry or chemical blend is transported into pressure vessels 986A and 987A. The pump 101A can achieve a pressure greater than the regulated pressure inside the pressure vessels 986A and 987A. The pump can be any kind of pump, for example, diaphragm or centrifugal pumps as described earlier. For this embodiment, a diaphragm is preferred because of the higher pressure needed to transport the slurry or chemical blend into the pressure vessels 986A, 987A of pressure vessel element 920A. Because of the higher pump pressures, and the use of the diaphragm pump to fill the pressure vessels 986A, 987A, this embodiment of a distribution module is preferred for chemical blends.

The pump 101A is preferably sized so that, if necessary, it can fill the pressure vessel(s) in fluid communications therewith (in this embodiment pressure vessels 986A and 987A) in a fraction (such as less than 50% or less than 30%) of the time that it takes to empty the pressure vessels 986A and 987A at the maximum flow rate, that way, for example, the pump 101A used to supply the one or more pressure vessel elements will, if working properly, always be able to provide more slurry or chemical blend to the pressure vessels 986A and 987A than is drawn from the pressure vessels 986A, 987A. Because of the pressurized air or inert gas present in the pressure vessels 986A, 987A, and the absence of valves in the line between the pump 101A and the pressure vessels 986A, 987A nor between the pressure regulator 991A and the pressure vessels 986A, 987A, the slurry or chemical blend pumped by pump 101A will flow substantially equally (to maintain a pressure balance) into both pressure vessels 986A and 987A via lines 975A and 976A that are in fluid communication with pipe 76A and pump 101A. Both pressure vessels 986A and 987A will be at the same pressure. When the maximum fill level in the pressure vessels 986A and 987A has been reached, one or both level indicators 882A and 982A on pressure vessels 986A and 987A, respectively, will communicate with the controller (not shown) or with the pump 101A to tell the pump 101A to stop pumping slurry or chemical blend to the pressure vessel element 920A. (In an embodiment for which both pressure vessel elements are in use by distribution module 400 intermittently, meaning that only one pressure vessel element is filled and supplies a global loop at one time, a computer (controller) may switch from one pressure vessel element 920A to the other based on a timer. If the pressure vessel element 920A is being used to supply a global loop and it is almost time to switch to pressure vessel element 920B, the pump 101A will stop pumping, valves 931A and 931B will switch from open to closed and closed to open respectively and pump 101B will start pumping slurry or chemical blend from the distribution tank 491 to the pressure vessel element 920B that functions the same as pressure vessel element 920A. Prior to bringing the pressure vessel element 920B on line, by opening valve 927B to the global loop, a sample of the slurry or the chemical blend may be sent via a sample tube or sample loop (not shown) to an analytical module (not shown) for testing and only if the slurry or chemical blend is in specification will the slurry or chemical blend from the pressure vessel element 920B be sent to the global loop. While testing the slurry or chemical blend from pressure vessel element 920B the slurry or chemical blend for pressure vessel element 920A will continue to be delivered to the global loop until the pressure vessels 986A and 987A are empty. If the analysis of slurry and/or chemical blend is satisfactory and pressure vessels 986A and 987A are empty, then valve 927A will close and valve 927B will open and the slurry or chemical blend from pressure vessel element 920B will supply the global loop 111B. The pipes and the pressure regulator 991B between the pressurized air or inert gas source 992B and pressure vessels 986B and 987B will provide the substantially even pushing force necessary to cause the slurry or chemical blend in pressure vessels 986B and 987B to flow to and preferably through the global loop.

As stated above, in one embodiment the pumping rate of pump 101A could be such that the supply to the pressure vessel element 920A of slurry or chemical blend is at a rate that is similar to the amount of slurry or chemical blend provided from pressure vessel element 920A so that the pump 101A is running at a substantially steady rate continuously. Pressure vessel element 920B could also operate the same way as pressure vessel element 920A, and pump 101B could be running continuously like pump 101A (as compared to an on-and-off manner) except that pump 101B would supply pressure vessel element 920B. In this embodiment, pressure vessel elements 920A and 920B and pressure vessels 986A, 987A, 986B and 987B could all be supplied continuously with slurry or chemical blend and emptied continuously to supply one or more global loops.

Upon exiting the pressure vessel element 920A the slurry or chemical blend is transported through pipe 77A to the global loop 111A. The global loop as shown comprises an optional filter element 265A, optional flow sensor or transmitter 79A. The slurry or chemical blend from the pressure vessel element 920A will flow through optional flow sensor 79A to line 80A which are all part of the global or distribution loop 111A. The distribution loop 111A delivers the slurry or chemical blend to supply CMP or other tools (not shown). If the slurry or chemical blend by-passes or is otherwise unused by the tools, the global loop(s) return(s) the unused slurry or chemical blend via the global loop return pipe 86A to distribution tank 491. As described above, in operation there is preferably always some unused slurry or chemical blend in all parts of the global loop that is returned to the distribution tank 491. The complete distribution loop 111A (or 111B) is not shown in FIG. 19. The global loop 111A comprises back pressure controller 84A. The back pressure controller 84A is located downstream of the junctions (not shown) to the tools (not shown) in fluid communication with the global loop 111A in line 83A and is located in the global loop near the return line 86A. The one or more back pressure controllers 84A in the global loop communicates with the controller (computer, LPC) if the pressure falls below a certain level in the global loop. The controller will increase the speed of pump 101A to supply more chemical blend or slurry to the pressure vessel element 920A and/or the pressure regulator 991A may increase the pressure in the pressure vessel element 920A to increase the flow of slurry or chemical blend to the global loop. These feedback control loops that adjust one or more of the pump speed, pressure regulator, and the back pressure controller repeat the measuring, calculating and adjusting steps continuously or every minute or for any pre-set desired time period which may be longer or shorter than every minute. The back pressure controller and pressure regulator and/or pump speed are adjusted continuously or at set intervals to maintain slurry or chemical blend everywhere in the distribution loop at all times including a sufficient amount to supply the tools that are in operation and using the blended slurry and/or chemical blend, but limiting the maximum pressure so that the pipes do not rupture.

In one method of operating the embodiment shown in FIG. 19, especially when the global loops supply the same tools, or there is only one global loop (not shown) that is supplied slurry or chemical blend from either pressure vessel element 920A or 920B, the A labeled parts in the distribution module can be on-line when the B parts are being filled and off-line (and/or the slurry or chemical blend in the B parts is sent to the analytical module), and once the pressure vessels 986B and 987B are beginning to be filled, the B parts can wait on standby until the A parts are emptied or close to empty. In an embodiment in which the pressure vessel elements are used in an alternating (on and off) mode, once the pressure vessel element 920A has been emptied or nearly emptied of the slurry or chemical blend that is in the pressure vessels 986A and 987A, then the pressure vessel element 920B can be brought on line, and pressure vessel element 920A taken off-line for cleaning or maintenance, for example.

In an alternative embodiment of operating the distribution module shown in FIG. 19, both pressure vessel element 920A and 920B are continuously on-line and both pressure vessel element 920A and 920B can each supply a different global loop 111A and 111B respectively, and the global loops my supply the same or different tools. As described above, in a preferred mode the maximum level in the distribution tank will rarely be reached and the amount of blended slurry or chemical blend present in a tank will for the majority of the time that the apparatus 20 is in operation be between from 20% to 80% or between from 30% to 70% of the volume of the tank and the controller (not shown) for the apparatus 20 will use feedback from the various level sensors and pressure and flow rate sensors in the modules to adjust the feed rates in the feed module 100, if present, and the flow rates in the blend module 200 such that blended slurry or chemical blend is made and provided to the distribution module 400 at a volumetric rate that is similar and preferably nearly equivalent (within +/−20% or within +/−15% or within +/−10%) to the rate (volume/time or mass/time) that the blended slurry or chemical blend from the distribution tank is consumed by the CMP or other tools and not returned to the distribution tank via the one or more global loops. The pressure vessels 986A,B and 987A,B may be for example, between 5 to 20 liters, or 8 to 17 liters or 10 to 15 liters each depending upon the desired flow rates of chemical blend or slurry from the pressure vessels to the one or more global loops.

Similar to earlier described embodiments, global loop 111B and (in the embodiment shown) pressure vessel element 920B perform the same way as described for global loop 111A and pressure vessel element 920A of FIG. 19. Additionally the pump 101B also performs in the same way as described above for pump 101A. The operation of pump 101B, pressure vessel element 920B, pressure regulator 991B and global loop 111B will not be repeated here. (In an alternate embodiment, a single pump and/or a single pressure vessel element could be used to supply two global loops by providing valves after the pump and/or after the pressure vessel element to direct the slurry or chemical blend to either global loops or to both global loops simultaneously. Additionally, although not shown one or more sets of at least two valves and at least one pipe could be provided in the embodiment shown in FIG. 19 to make it possible to divert the blended slurry and/or chemical blend from global loop 111A to global loop 111B, and/or from pipe 77A to pipe 77B and/or from pipe 76A to pipe 76B. The pipes (not shown) between the A labeled parts of the distribution module 400 to the B labeled parts may be provided for backup in case any of the pump 101A, pressure vessel element 920A, pressure regulator 991A, optional filter element 265A, global loop 111A fails. If both of the pumps 101A, 101B, pressure vessel elements 920A, 920B and global loops 111A, 111B are in use, then depending upon where a failure occurs, then one of the pumps and one of the pressure vessel elements if they are sized correctly may be used to supply one or both global loops simultaneously, if desired.

The apparatus 20 comprising the distribution module 400 shown in FIG. 19 may be run so that the amount of blended slurry or chemical blend being made in the blend module 200 is about equivalent to the amount of blended slurry or chemical blend being consumed in the one or more global loops so that a somewhat continuous steady flow of blended slurry or chemical blend from the blend module to the distribution module is established and additionally, if present, that there is at least a small portion of slurry and/or chemical blend in the feed module 100 (if present), distribution module 400 and optional analytical module 300 flowing and recirculating continuously. It is preferable that there are no stagnant modules where slurry and/or chemical blend (especially slurry) is not in motion. If lines, tanks, sensors, etc. are not in use, it is preferred to flush them with DIW after the slurry or chemical blend exits the lines and discard the flush water via a waste stream.

As shown in FIG. 19, the distribution module 400 comprises a filter element 265 (A or B) that can be present anywhere before or within the global loop or elsewhere in the distribution module, for example at the tank exit or upstream of either or both pumps. The filter element can be any of the filter elements described above. The filter element can filter a portion of or up to 100% of the slurry or chemical blend stream moving through a line that is part of the distribution module. As described above for other embodiments, it may be desirable to provide a bypass line to bypass the filter element or to provide at least 2 filters (or banks of filters) in parallel and/or that may be provided in a separate filter loop, so that the stream can be directed away from one or more plugged filters to unplugged filters. Additionally, pressure sensors can be provided to measure the pressure upstream or downstream of the filter (element, e.g. filter bank) to determine when the flow of slurry or chemical blend should be directed away from a first (plugged) filter (or other filter element, e.g. bank of one or more filters) and associated pipes and valves to a second (unplugged) filter (or other filter element, e.g. bank of one or more filters) and its associated pipes and valves as described above and a filter change signaled to a technician. The location of the filter(s) or other one or more filter elements in fluid communication with at least one global loop provides filtration to one or both global loops (or wherever the filter element, e.g. filter or filter bank is located). (In embodiments having more than one global loop, each global loop preferably has its own filter element.) Filtering the slurry and/or chemical blend in the global loop close to and (directly) upstream of the tools is beneficial for preventing unwanted particles from being transported to the tools. In one embodiment the filter element 265 comprises at least two filters in series, the first filter being for relatively larger particles and the second filter being for relatively smaller particles. Note that for chemical blends, the provision and placement of multiple filter elements, although desirable for some chemical blends is not as important as compared to blended slurries. Additionally, for some chemical blends whose components will not separate if stagnant, in the embodiment shown in FIG. 19, and other distribution modules described herein, a circulation loop for the chemical blend may not be required (since no particles will settle if not in motion), so the global loop, may be modified to dead head and not return to the distribution tank, if desired.

The distribution module further comprises sample ports 900, 900A and 900B. Sample loops comprising tubing (not shown) attached to the ports located at 900 and 900A and 900B can be used to draw samples of the slurry or chemical blend and transport the sample to an analytical module such as one of the analytical modules shown in FIGS. 1B, 4 and 5. Alternatively, the samples may be transported to the analytical module, analyzed in the analytical module and then sent to a waste stream (not shown). In an alternative embodiment, samples of the slurry or chemical blend are drawn from ports 900, 900A or 900B and transported to an analytical module via tubes (not shown) and returned to the distribution tank 491 via line 936.

The distribution tank 491 may or may not be open to the ambient atmosphere. As shown in FIG. 19, particularly when the distribution tank 491 is used for the distribution of a hazardous, reactive and/or volatile slurry or chemical blend or components thereof, the distribution tank may be sealed from the ambient atmosphere. In those cases, the distribution tank may be provided with a cover 938, which when closed will attach to the tank 491 in such a way to provide a near or fully air-tight and water-tight seal to the distribution tank 491. The cover and the tank may be provided with mating threaded parts, the cover and/or tank may have one or more gaskets and one or more locking mechanisms, such as screws, or the cover and the tank may be closed and sealed by using an adhesive. Additionally, depending upon the composition of the slurry or chemical blend, the distribution tank may be provided with a pipe 937 that provides to the head space at the top of the tank a pressurized flow of inert gas. In the embodiment having an inert gas supplied to the headspace in the distribution tank, the inert gas may be introduced into the distribution tank before any slurry or chemical blend is introduced into the distribution tank to lessen or avoid any contact of the slurry or chemical blend with air.

In this embodiment, the feed pipes into the tank 491 are shown penetrating the tank through the tank cover 938, which may be done if the tank has a tank liner made of polytetrafluoroethylene (e.g. Teflon®) or similar material. To avoid breaching the tank liner, the side walls of the tank were not breached by any pipes which all pass through the cover. In an alternative embodiment another pipe through the cover could replace the exit opening at the bottom of the tank too. This tank is especially suited for caustic materials. Alternative embodiments of the tank may be substituted herein, such as the one shown in FIGS. 7 and 8, if non-caustic chemical blends and slurries are to be held therein. One of more of the pipes, for example return pipes 86A and 86B may have eductors thereon. In this and alternative embodiments of the other tanks, instead of or in addition to eductors, the tanks may comprise a mechanical or other mixer (not shown) to mix the slurry or chemical blend in the tank.

The description of filters and filter elements and any of the other aspects of the distribution module described above in reference to the other figures and embodiments is applicable to the embodiment shown in FIG. 19 and are incorporated herein by reference.

Figure 7:
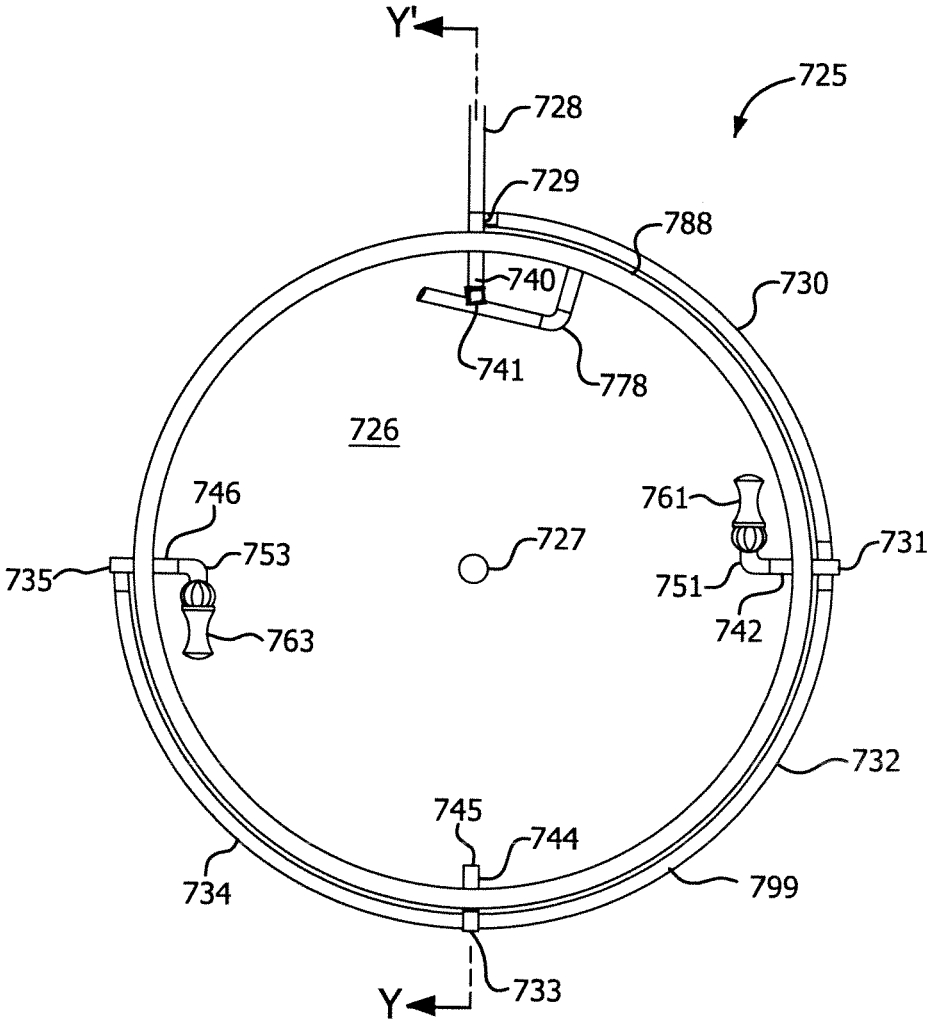
FIG. 7 shows a top-view of a tank that may be used in the apparatus and method of this invention as either the feed tank or the distribution tank.
Figure 8:
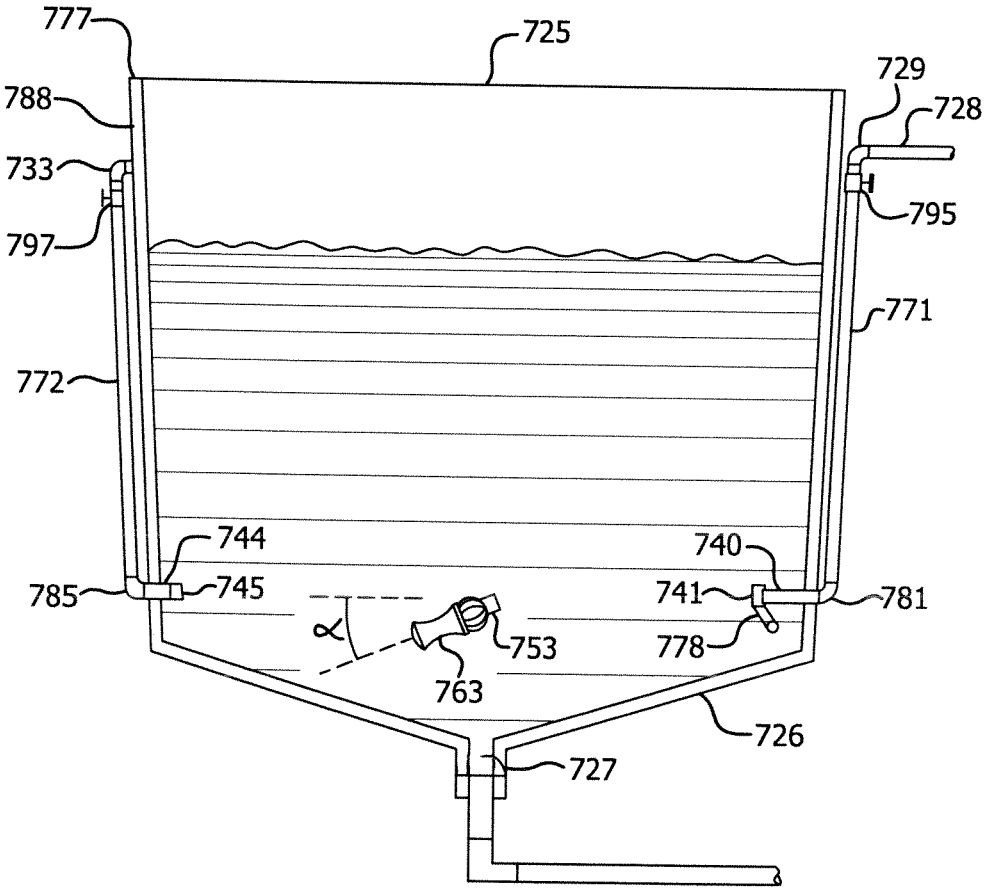
FIG. 8 shows a cross-sectional side view of tank taken along line Y-Y' on FIG. 7.
Figure 9:
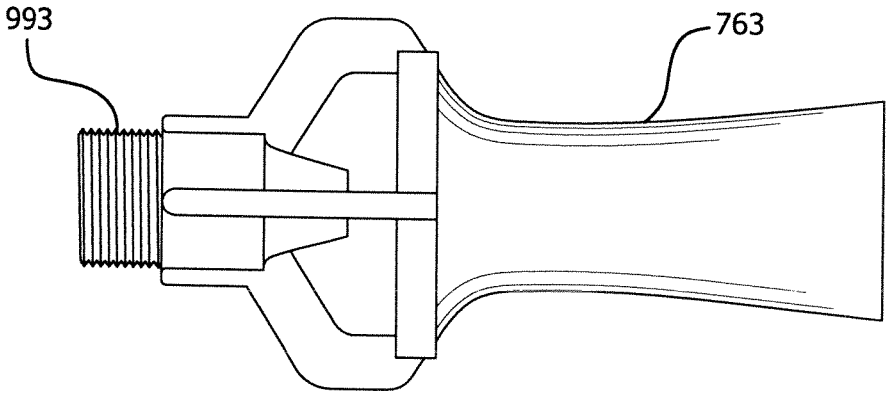
FIG. 9 is an eductor useful in this invention.

FIG. 7 shows a top-view of one embodiment of a tank that may be a distribution tank or a day tank useful in this invention showing two eductors at the bottom portion of the tank and two capped eductor connectors. FIG. 8 shows a cross-sectional view of the same tank in FIG. 7 taken along the line Y-Y' showing the side view of one eductor and the capped eductor connectors. FIG. 9 shows an eductor that may be used in the invention.

It is desirable to use the eductors located near the bottom or, stated differently, in the bottom portion of the tank for the flow of the slurry or chemical blend into the tank that is returned to the tank, for example, via the recirculation line for the day tank (of the feed module) and via the return from the global loop or the return pipe for the filter loop for the blended slurry or chemical blend that is returned to the distribution tank (of the distribution module). (As shown in FIG. 7 is the return line 728 to the tank 725, which for example as shown in FIG. 2 for the feed module is the line 21 that is part of the recirculation loop 82 for the feed tank 80.) The eductors are used because for every volume of the returned slurry or chemical blend that flows through the eductor per unit time into the tank, a multiple of that volume per unit time of slurry or chemical blend that is present in the tank is sucked into and through the eductor. Useful eductors that can be used in the tanks of this invention may circulate 2 to 20 gallons, 2 to 10 gallons, or 4 to 5 gallons for each gallon introduced into the tank via each eductor. This helps to keep all of the slurry and/or chemical blend present in the tank moving. Depending upon the size of the tank and the volumetric flow rate of slurry or chemical blend that is typically returned to the tank and volume of slurry or chemical blend that must be kept in motion in the tank, any number of the eductors can be used, for example, from 1 to 10 eductors, or 1 to 8 or 1 to 6 or 1 to 4 or 1 to 3 or 1 to 2 eductors. The total flow of all of the slurry or chemical blend in the tank is preferably at a rotational average speed that is higher at or near the sidewall of the tank and decreases towards the center. The preferred rotational speed of the moving slurry or chemical blend is such that the circular motion of the slurry or chemical blend is noticeable, and the top of the slurry or chemical blend is a bit agitated, but mostly level across the top of the slurry or chemical blend. It is presently believed that the slurry or chemical blend slowly rises along the inside surface of the tank sidewall as it flows in a circular motion around the circumference of the tank and then at or near the top of the slurry or chemical blend, the slurry or chemical blend flows away from the sidewall of the tank and into the center and then flows to the bottom of the tank. Regardless of the motion, by using the eductors for the return slurry or chemical blend, the slurry or chemical blend seems to be mixed from the bottom to the top of the tank. By the motion provided by the educators, the slurry or chemical blend at or near the bottom of the tank does not stay at the bottom of the tank and the top of the slurry or chemical blend does not stay there either where the slurry might form a crust by semi-continuous or continuous exposure to the air or inert gas in the tank.

To prevent a loss of water by the agitated slurry or chemical blend, humidified air or nitrogen or other inert gas may be added to the top of the tanks via a small pipe (not shown) located above the maximum level of the slurry or chemical blend in the tank inserted through the lid or upper wall of the tank. The tanks shown in FIGS. 7 and 8 are preferably at atmospheric pressure. (The tank shown in FIG. 19 is at slightly above atmospheric pressure due to the cover and the inert gas added to the headspace.)

FIG. 7 shows a top-view of a tank 725 that may be used in the apparatus and method of this invention as either the day tank or the distribution tank. FIG. 8 shows a side view of the same tank 725 taken along line Y-Y' on FIG. 7. As shown, tank 725 comprises vertical or near vertical sidewall 788, a conical-shaped bottom wall 726, an exit opening 727, one or more eductors for the return slurry or chemical blend, and one or more lines in which the slurry or chemical blend flows to the one or more eductors. The conical bottom wall 726 of the tank 725 slopes down, typically from 5 to 35 degrees, or from 25 to 35 degrees from the horizontal to the exit opening 727. The exit opening 727 may be connected to recirculation and/or distribution loops or other pipes. For example, exit opening 727 may be connected to line 25 if the tank is day tank 80 shown in FIG. 1A and line 74A (74B) if the tank is distribution tank 491A (491B) shown in FIG. 1C. Tank 725 may be made of high density polyethylene (HDPE) or polyvinylidene difluoride (PVDF) or other roto-moldable resin and may be sized from 30 to 45 inches inside diameter to hold from 25 to 1000 or from 50 to 600 or from 75 to 500 or from 75 to 350 gallons of slurry or chemical blend. Useful tanks are available from suppliers such as St. Gobain and Chemtainer.

The return line 21 that is part of the recirculation loop 82 to the day tank 80 may return the raw slurry or chemical blend to the bottom portion of the day tank 80. Further, the return line 86A (or 86B) to distribution tank 491A (or 491B) from the global loop 111A (or 111B) may return the blended slurry or chemical blend to the bottom portion of the tank 491A (or 491B). The bottom portion of the tank is the lower half of the tank height or 40% or less, or 30% or less, or 25% or less, or 20% or less, or 15% or less, or 10% or less wherein the tank height is measured from the exit opening 727 to top 777 of the tank. It is preferred that the eductors are located below the preset minimum level of slurry or chemical blend for the tank in the bottom portion of the tank. Typically one or more pumps that draw slurry or chemical blend from the tank may not begin to run or continue to run unless the slurry or chemical blend is above the preset minimum level in the tank. A level sensor in communication with the controller can be used to start and stop the pump based on the level of slurry or chemical blend in the tank.

The return line that introduces the returned slurry or chemical blend into the tank in FIGS. 7 and 8 is labeled 728; however, it is understood that it could be, for example, return line 21 or 86A (or 86B) as shown in FIGS. 1A and 1C. Additionally, as shown in FIG. 1C the return line (for example, 98 or 99 in FIG. 1C) from the filter loop may be connected to line 728 also. Line 728, as shown in this embodiment, is connected via a substantially horizontal tube and substantially vertical tubes to eductors 761 and 763, with two-, three-, and four-way pipe joints/connectors and 90 degree pipe joints/connectors and eductor connectors therebetween. FIG. 7 shows a substantially horizontal pipe 799 that traverses around most of the circumference of the tank 725, preferably the outside circumference of the sidewall 788 of the tank 725. As shown, the pipe 799 (comprising pipe sections 730, 732 and 734 and pipe joints 729, 731, 733 and 735) is mounted such that the return slurry or chemical blend flows into the pipe 799 that traverses 270 degrees around the (outside) circumference of the tank 725 and connects with four vertical pipes (only vertical pipes 771 and 772 are shown in FIG. 8). The vertical pipes are preferably also on the outside of the tank 725. Pipe 799 is preferably mounted at a slight decline from its connection to pipe 728 to its connection to the last vertical pipe (to the eductor) around the circumference which may be at any location around the circumference. The two vertical pipes that are not shown are in fluid communication with the two eductors 761, 763, and their eductor connectors 742 and 746, respectively. As shown, eductor connectors 740, 744, 742, 746 penetrate the wall of the tank 725 at about the same height from the bottom of the tank as the eductors to which they are connected and are in fluid communication. Alternatively, horizontal pipe 799 could flow 360° or greater or fewer degrees, or 300° or fewer degrees or 270° or fewer degrees or 180° or fewer degrees or 90° or fewer degrees or 45° or fewer degrees around the outside circumference of the tank 725 and direct slurry or chemical blend into any number of eductors. Alternatively, pipe 728 could introduce the returned slurry or chemical blend directly into a single eductor.

As shown, the horizontal pipe 799 is made up of connectors 729, 731, 733 and 735 and pipe segments 730, 732, 734. The connectors 729, 731, 733 and 735 connect and are in fluid communication with the horizontal sections of pipe 799 and connect to two vertical pipes (not shown) that are in fluid communication with the eductors 761, 763 and eductor connectors 742, 746, respectively. Additional vertical pipes 771, 772 are in fluid communication with eductor connectors 740, 744 that have caps 741, 745 thereon, respectively. For the vertical pipes (771, 772) that flow to capped eductors, or for which an eductor may be attached but presently is not in use, hand valves (hand valves 795 and 797 are shown) are provided in the vertical lines and may be closed to prevent the flow of the slurry or chemical blend into the vertical tubes (vertical tubes 771, 772 are shown).

The eductors 763 and 761, as shown, are attached to elbow connectors 753 and 751 respectively which are connected to the eductor connectors 746 and 742 that penetrate the sidewall 788 of the tank 725 and via elbow joints (not shown as connected to the eductors but shown as 785 and 781 for the eductor connectors, 740 and 744 that are capped) connect with the vertical lines (vertical lines 772 and 771 are shown for the capped eductor connectors 740 and 744) and then through pipe connections 735 and 731 to the (near) horizontal line 799 that provides for the flow of slurry or chemical blend to the eductors. It is preferred that the length of the connectors and piping (collectively the plumbing) to the one or more eductors located inside the tank (and to the one or more supply conduit) is minimized (that is, it is less than 10 or less than 6 or less than 3 or less than 2 times the length (the biggest dimension) of the eductor) so that the interference between the plumbing in the tank and the slurry or chemical blend circulating in the tank is minimized. (This is compared to piping through the cover and running vertically from the cover to the bottom of the tank. Pipes running vertically from the cover will interfere with the circulation of the slurry and chemical blend in the tank.) The eductors are mounted in the tank so that the slurry or chemical blend exiting the eductor is directed at an angle that may be at any angle pointed (below the horizontal that is) towards the bottom surface of the tank, may be horizontal or may be at any angle pointed (above the horizontal that is) towards the top surface of the tank, the educator is optionally also pointed partially at and partially along the tank sidewall, as shown in the FIGS. 7 and 8. The slurry or chemical blend exiting the eductors will cause the slurry or chemical blend located near or along the bottom wall to move and will cause slurry or chemical blend to flow along the sidewall of the tank too. As shown, the eductor is positioned so that the slurry and/or chemical blend exiting the eductor is directed at an angle $\alpha$ that may be between from 0 degree to 45 degrees, or between from 0 to 40 degrees or between from 0 to 35 degrees or between from 5 to 35 degrees or between from 3 to 40 degrees above or below the horizontal dashed line and measured from the horizontal line shown in FIG. 8. For the sake of clarity, the eductor shown in FIG. 8 is at an angle $\alpha$ below the horizontal line.

The angle of the eductors and the number of eductors in the tank are selected to provide a slurry or chemical blend that is in continuous motion. The motion of the slurry or chemical in the tank does not provide large waves or splashing in the tank. The motion of the slurry or chemical blend in the tank should be visible on the surface of the slurry and/or chemical blend. In one embodiment, the eductors provide for a velocity gradient across the diameter of the tank, that is, the movement of the slurry or chemical blend is at a higher velocity near the sidewall of the tank, and the velocity decreases towards the center of the tank. In this embodiment, the majority of the slurry or chemical blend preferably moves in a clockwise or counterclockwise motion along and around the interior sidewall of the tank and the velocity of the slurry or chemical blend is higher at or near the sidewall and slower in the center of the tank. The movement of the slurry or chemical blend may provide a net slow downward velocity of the slurry or chemical blend in the center of the tank and a net faster upward velocity at or near the sidewall.

The tank may also comprise one or more supply conduits, for example supply conduit 778 as shown in FIGS. 7 and 8. One or more supply conduits are used for the supply of slurry or chemical blend into the tank from other than a recirculation loop. For example supply into the distribution tank (shown in FIG. 1C) would be from line 72A or 72B, and for the day tank (shown in FIG. 1A) would be from line 55. The supply conduits are also located in the bottom portion of the tank below the minimum expected level for the slurry or chemical blend when it is operating to supply the global loop. In this embodiment of the tank, supply conduits 778 do not comprise an educator, just a pipe that opens into the bottom of the tank. (In other embodiments, each supply conduit may comprise an eductor.) In some embodiments the angle of the pipe opening and the direction of the pipe opening are similar to those described for one or more of the eductors. The piping to the supply conduit 778 is not shown but may be similar to the piping to the eductors for the return line especially if more than one supply pipe is provided into the tank. Like the eductors the supply pipe penetrates the sidewall of the tank at about the same level that the exit of the supply pipe is located in the tank. It is preferred that the tank comprises supply and/or return lines that penetrate the wall at about the same level as described above.

The optimum angle of the eductors to provide for movement of all of the slurry or chemical blend in the tank may require the adjustment of the angle of the eductors; therefore, the eductors provided in the tank are provided with adjustment means, for example an adjustable elbow. To determine the optimum angle and number of the eductors, an operator should consider the tank diameter, the shape of the bottom of the tank, the amount of slurry or chemical blend in the tank, the number of the eductors, the flow rate through the eductors, the eductor multiplier and the slurry or chemical blend characteristics. In some embodiments, the typical return flow rate into the distribution tank or day tank may be 20 liters/min+/−4-5 liters/minute, the eductor may circulate 3-4 liters for every 1 liter of flow into the eductor, the tank diameter may be 31 to 45 inches inner diameter (30 to 50 inches inner diameter), the height of tank may be 8 feet and the eductor angle may be within 45 degrees above or below the horizontal line, for example 6 degrees upward from the horizontal or 15 degrees below the horizontal.

The total volumetric flow rate through the eductors is preferably between from 5 to 40 liters per minute or 10 to 30 liters per minute, plus the additional flow due to the eductor circulation multiplier(s). As shown the two eductors 761, 763 are positioned so that the exiting flow is directed in the same direction around the circumference of the tank 725. However, if the flow rate of the slurry or chemical blend added to the tank from the eductors is such that the returned slurry or chemical blend is causing too much movement, for example the slurry or chemical blend is moving too fast along the tank sidewall and the radian speed of the slurry or chemical blend is having a detrimental impact on the slurry or chemical blend, it may be desirable to add a third (or one or more) eductor facing in the opposite direction from the eductors already present. Depending on how much change in the flow rate is desired, the eductor that may be added, may be smaller than the eductors already present in the tank. Additionally, the flow to any eductor can be increased or decreased by using the valves in the vertical lines to increase or decrease the flow to one or more of the eductors. On the other hand, if two eductors do not provide enough movement of the slurry or chemical blend, additional eductors may be provided and positioned so that all of the flow is in the same circumferential direction, meaning that all of the slurry or chemical blend exits the eductors flowing in the same circular direction into the tank. If the amount of the slurry or chemical blend to be returned to the tank is too much for the eductors, an additional line (not shown) that penetrates into the tank 725 preferably near the bottom, similar to the supply line without an educator thereon, may be provided so that the flow of the slurry or chemical blend though the eductors does not cause the flow rate around the tank to increase above a preset maximum value.

FIG. 9 shows one embodiment of an eductor 763 that is useful in this invention. Eductors like the one shown are commercially available from BEX. The eductor comprises a threaded portion 993 which is connected to the elbow 753 (shown in FIG. 7) via a threaded portion of the elbow 753 (not shown).

Figure 16:
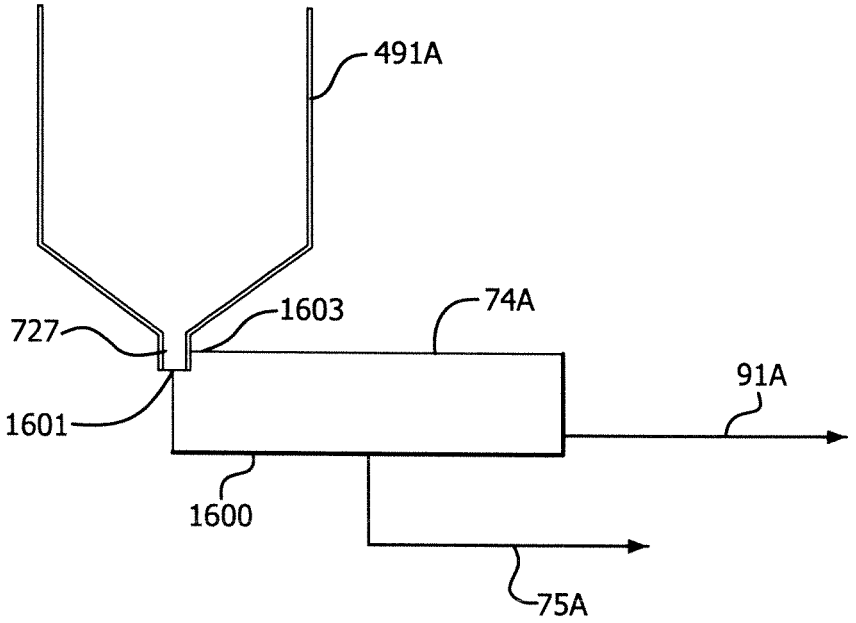
FIG. 16 shows a double line exit loop from the bottom of a tank.

FIG. 16 shows the piping at the bottom of a tank 725. The apparatus 20 is able to respond to surges in demand by having already blended slurry or chemical blend circulating in the tanks and loops. To improve the tanks ability to respond to surges in demand, the piping at the bottom of the tank may be a double line loop. One embodiment of the distribution tank 491A is shown in FIG. 16. In the embodiment shown, the slurry and/or chemical blend supply apparatus comprises a tank comprising line 74A that exits the tank 491A having two connections 1601, 1603 to the exit opening 727 (at the bottom of the tank) and via piping forms a double line loop 1600 in which both lines connected to the connections 1601 and 1603 are each directly or indirectly in fluid communication with each other and form a loop. (The two connections at the exit opening may be provided in a pipe connected to the exit opening 727 that forms the double loop 1600.) Shown connected to the double line loop 1600 are lines 91A to the filter loop and line 75A to the global loop as shown in FIG. 1C. When demand is high because of the two connections 1601, 1603 to the exit opening 727 at the bottom of the tank, the flow of the slurry or chemical blend from the tank will not restrict the supply and become a limiting factor. The flow rate of the slurry or chemical blend provided by the double lines from the tank will meet the demand.

As stated above the pipes, tubing, hand valves, pneumatic valves, pumps, tanks, eductors, etc, used to construct the individual modules and the apparatus described herein are mostly off-the-shelf items. The plumbing is connected using pipes or tubing connectors that are manufactured with mating threaded portions that in the case of the tubing may require cutting the tubes and flaring the tube ends. These manufacturing techniques are known to a person of ordinary skill.

The apparatuses of this invention although it may be designed and used to provide for flexibility in the supply of one or more blended slurries and/or one or more chemical blends, it may be designed and used to provide for large volumes (in many cases more than 10 lpm) of a single high quality, consistently blended slurry or chemical blend (with little variation in the percentage of the composition and particle sizes (if slurry) therein), to be provided to large numbers of tools (e.g., 8 or more). Most of the prior art systems are designed to supply small volumes of slurry or chemical blends and to supply a small number of tools (e.g., 1-4 tools.). The apparatus, herein, that blends slurry, preferably tests the raw slurry using a liquid particle counter and/or particle size distribution analyzer in the feed module, which can be used to analyze the raw slurry to detect bad slurry before much of or any volume of the raw slurry from the slurry supply container reaches the feed tank or blend module. The liquid particle counter and/or particle size distribution analyzer in the feed module can be used only to analyze the raw slurry (not the blended slurry) so that the dilution equipment (e.g., valves, pumps, piping, etc. for the desired slurry and water flow rates) associated with that liquid particle counter and/or particle size distribution analyzer can be set and unchanged for the optimized dilution ratio (slurry:water ratio) of the slurry for the liquid particle counter and/or particle size distribution analyzer (matching the dilution to the sensitivity ranges of the equipment). (In the same way, a second liquid particle counter and/or particle size distribution analyzer can be provided for analyzing only the blended slurry in the apparatus, and a different optimized dilution ratio, if needed, can be used for the blended slurry. The blended slurry likely requires a different dilution ratio (as compared to the raw slurry) prior to analysis by the second liquid particle counter and/or particle size distribution analyzer and the dilution equipment (e.g. valves, pumps, piping for the desired slurry and water flow rates, etc.) associated with the liquid particle counter and/or particle size distribution analyzer can be optimized for the blended slurry, set and unchanged to provide consistent dilution of the blended slurry prior to analysis by the second liquid particle counter and/or particle size distribution analyzer.) The analysis of only the raw slurry supply (continuously or semi-continuously or with each new slurry supply container being added to the feed module), if the apparatus is used to blend large volumes of the same blended slurry will be of the same raw slurry. By checking the quality of the raw slurry supply, with the same analytical equipment that is used to only analyze the raw slurry, and the raw slurry supply is the same raw slurry for large quantities of slurry to be blended, there is decreased likelihood that there will be dilution errors, or other errors and the results of the analysis by that equipment will be more reliable. Filter elements and/or treatment means in the blend and other modules are also provided to maintain the high quality of the slurry and chemical blend. The entire slurry supply and/or chemical blend supply apparatus can be designed and operated in a substantially steady-state manner for the large quantities of the same slurry and/or chemical blend. Once a steady state is established, the flow rates and pressures throughout the apparatus are kept substantially consistent. In normal operation, the volumes of slurry and/or chemical blend in the feed and distribution modules are kept at volumes (tank levels) that can respond to increased demand by the tools (providing slurry or chemical blend so that the slurry or chemical blend circulates in the circulating loops (global loop) continuously) without running out of slurry or chemical blend and with a sufficient buffer amount so that the blend module can run at its steady-state rate and replace the volume in the distribution tank when the demand increases, and the volumes of raw slurry in the feed module can be replaced, if necessary, in its range of ordinary steady-state operation. The buffer volumes in the feed module and the distribution module make it possible for the blend module flow controllers to be kept at the same (unchanged) settings (within the most accurate range for each flow controller) with consistent upstream supplies of the components (pressures and flow rates) to the flow controllers to consistently blend the same slurry or chemical blend when the blend module is blending. (If more than one slurry and/or chemical blend is to be blended, separate blend trains may be provided for each and the flow controllers in each blend train with unchanged setpoints (once established) therein for the separate materials to be blended.) Once the equipment parts and settings are established and the apparatus is running at steady-state, the apparatus can operate for days, weeks or months using the steady-state settings to supply a plurality of tools a consistent, high quality blend of slurry or chemical blend. The slurry provided by the apparatus of this invention to CMP tools may lead to a reduction in slurry generated defects on wafers as compared to slurry supplied to the same CMP tools using a different slurry supply apparatus. The apparatus may only be turned off for scheduled maintenance; however, redundant tanks, pumps, filter elements and piping can be provided in the apparatus so that the intervals for turning off the entire apparatus for maintenance can be longer than similar equipment.

This invention further provides methods of manufacturing the apparatus. Some embodiments are as follows:

A method of manufacturing a slurry and/or chemical blend supply apparatus comprising the steps of: constructing a feed module and/or analytical module and/or blend module and/or distribution module. A method of manufacturing comprising, alone or in combination with the prior method providing a feed module comprising at least one feed tank, at least one pump and piping, connecting a first pump to piping and connecting said piping to said at least one feed tank, said first pump and said piping is for transporting raw slurry to said at least one feed tank from a slurry supply container, said method further comprising the step of connecting additional piping to said at least one feed tank to form a circulation loop and connecting a second pump in said circulation loop to draw slurry from said at least one feed tank and return at least some of the raw slurry to said at least one feed tank. This invention provides alone or in combination with any of the just described methods of manufacturing a method comprising the step of connecting a back pressure controller within said circulation loop of said feed module.

This invention provides any of the prior described methods of manufacturing alone or in combination with a method comprising the step of connecting a flow sensor within said circulation loop that is used to measure the flow rate in said circulation loop and further installing said flow sensor so that said measured flow rate can be used to directly or indirectly electrically communicate with and regulate the second pump. This invention further provides alone or in combination with any of the prior described methods of manufacturing a method comprising the step of connecting a pressure sensor and a back pressure controller in said circulation loop, wherein said pressure sensor is used to measure the pressure in said circulation loop and said valve in said back pressure controller is regulated based on the pressure measured by said pressure sensor via electrical connections, the electrical connections may also be connected to a controller. Any of the prior described methods of manufacturing further comprising alone or in combination with the step of connecting at least one pipe to the circulation loop that is connected to and thereby transfers raw slurry to a blend module.

This invention further provides alone or in combination with any of the prior described methods of manufacturing a method comprising the step of connecting electrical connections between said pressure sensor and the second (feed) pump so that a decrease in pressure below a set point will result in an increase in said second pump speed. This invention further provides alone or in combination with any of the prior described methods of manufacturing a method comprising the step of connecting an in-line liquid particle counter via a slip stream connected between said particle counter and a pipe downstream of the first (slurry transfer) pump in the feed module so that the liquid particle counter can analyze a sample of the raw slurry. This invention further provides alone or in combination with any of the prior described methods of manufacturing a method comprising the step of connecting an in-line particle size distribution analyzer via a slip stream preferably downstream of the first (raw slurry transfer from the container) pump so that the particle size distribution analyzer can analyze a sample of the raw slurry in the feed module. Additionally upstream or downstream of the particle size distribution analyzer may be connected to a liquid particle counter so that the liquid particle counter can analyze a sample of the raw slurry. A single slip stream or tubing loop may take a sample to the particle size distribution analyzer and/or liquid particle counter or separate slip streams or tubing loops may be provided to each. Alternatively, one or both of the particle size distribution analyzer and the liquid particle counter may provide for analysis of the entire raw slurry stream. This invention further provides alone or in combination with any of the prior methods, a method of manufacturing the slurry and/or chemical blend supply apparatus, comprising the step of connecting a slip stream or sample loop from sample ports connected in the piping in any module in the slurry and/or chemical blend supply apparatus.

Any of the prior described methods of manufacturing further comprising the step of connecting an in-line analytical apparatus and connecting in fluid communication therewith at least one slip stream, preferably at least two slip streams so that said analytical apparatus can draw samples of raw slurry or chemical blend from at least one location in a module via the one or more slip streams connected to sample ports connected to the piping in the module. Any of the prior described methods of manufacturing further comprising the step of arranging said slip streams into sample loops by providing a slip stream from said analytical apparatus to piping in said module from which the sample was drawn. Any of the prior described methods of manufacturing further comprising connecting a dilution apparatus which may comprise the connection of a dilution fixture prior to said in-line analytical apparatus to provide for the dilution of the sample prior to analyzing a slurry or chemical blend sample. Said dilution apparatus may be a multiple (e.g. double) dilution apparatus that may comprise two or more dilution fixtures, said method further comprising connecting pipes and valves and a high purity water source to one or more pipes carrying a sample of slurry or a chemical blend.

Any of the prior described methods of manufacturing further comprising the step of connecting at least one peristaltic pump, at least one flow sensor and at least one needle valve upstream of said analytical module (which may comprise a liquid particle counter and/or particle size distribution analyzer) to dilute the slurry or chemical blend sample prior to analyzing the diluted sample. Any of the prior described methods of manufacturing further comprising the steps of connecting more than one flow sensor, more than one needle valve and more than one pneumatically controlled valve upstream of said analytical apparatus to dilute the slurry or chemical blend sample prior to analyzing the diluted sample. Any of the prior described methods of manufacturing further comprising the step of connecting one or more analytical apparatuses and one or more dilution fixtures upstream of said one or more analytical apparatuses, said dilution fixtures for the purpose of introducing slurry or chemical blend into UPW to create a diluted sample. Any of the prior described methods of manufacturing further wherein said one or more analytical apparatuses connected in said connecting step is selected from the group consisting of one or more pH sensors, one or more hydrogen peroxide sensors, one or more density sensors, one or more conductivity sensors, one or more liquid particle counters and one or more particle size distribution analyzers. Any of the prior described methods of manufacturing further comprising connecting to said circulation loop that is connected to said raw slurry tank, a blend module, said blend module comprises pipes for each of two or more flowing component streams that flow into a single pipe to form a blended slurry chemical blend stream, one of said component streams is said raw slurry stream from said circulations loop.

Any of the prior described methods of manufacturing further comprising the step of connecting said blend module comprising a pipe for each component stream and at least one flow controller in each of the component pipes to control the flow rate of the components and wherein said component pipes are connected and combined into a single pipe to form the blended slurry or chemical blend stream. Any of the prior described methods of manufacturing further comprising the step of connecting a blend module comprising pipes for each of three or more component streams and at least one flow controller in each of those pipes to control the flow rate of the components and wherein two of said component pipes are combined into a single pipe downstream of the flow controllers in each of the pipes to form a partially blended slurry or chemical blend stream and then the third component stream is combined with the partially blended slurry or chemical blend stream downstream of the flow controller in the third component pipe to form a blended slurry or chemical blend. Any of the prior described methods of manufacturing further comprising the step of connecting a static mixer downstream of where the component pipes are connected and the component streams flow together in said blend module. Any of the prior described methods of manufacturing further comprising the step of connecting a pipe from the blend module to an analytical module (apparatus(es)) so that at least a portion of the blended slurry chemical blend stream is analyzed by said analytical module (apparatus(es)). Any of the prior described methods of manufacturing further comprising the step of connecting at least one pipe between the blend module and the distribution module so that at least a portion of the blended slurry or chemical blend stream from the blend module is transported to the distribution module.

Any of the prior described methods of manufacturing further comprising the step of connecting at least one pipe between the analytical module and the distribution module so that at least a portion of the blended slurry or chemical blend stream from the analytical module is transported to the distribution module. Any of the prior described methods of manufacturing further comprising the step of connecting more than one pipe between the analytical module and the distribution module so that at least a portion of the blended slurry or chemical blend stream from the analytical module is transported to and from the distribution module. Any of the prior described methods of manufacturing comprising the step of connecting at least one pipe from the blend module to the distribution module so that at least a portion of the blended slurry or chemical blend stream from the blend module is transported to the distribution module. Any of the prior described methods of manufacturing comprising the step of connecting at least one pipe from the analytical module to the distribution module so that at least a portion of the slurry or chemical blend stream from the analytical module is transported to the distribution module. Any of the prior described methods of manufacturing further comprising the step of connecting a pipe between a blend module and said circulation loop of said feed module wherein said blend module comprises at least two pipes and a pump, each of said two pipes is for flowing a component stream to be blended in said blend module, wherein said at least two pipes are combined to form a single stream in a single pipe within 1 foot or less than 6 inches (or any distance stated earlier) of said pump and passing the single stream through the pump to dynamically blend the streams. Any of the prior described methods of manufacturing further comprising the step of connecting flow controllers in said two pipes for said component streams upstream of said single pipe in said blend module. Any of the prior described methods of manufacturing further comprising the step of connecting a pipe between said feed module and said blend module, said blend module comprising at least three pipes for one each of at least three component streams, at least one static mixer and at least one pump; connecting two of said at least three pipes into a first single pipe and connecting a static mixer in said first single pipe; connecting said first single pipe and the last pipe of the at least three pipes to a last single pipe wherein the final combination of said at least three component streams in said last single pipe is connected to said pump and flows into said pump to dynamically blend the streams. Any of the prior described methods of manufacturing further comprising the step of connecting a pipe between the distribution module and the blend module to provide for a stream of already blended slurry or already blended chemical blend from said distribution module to be combined with at least one of the streams (comprising one or more components, that is a partially blended slurry or a partially blended chemical blend stream or a fully blended slurry or a fully blended chemical blend stream) in the blend module. Any of the prior described methods of manufacturing wherein said connecting step connects the pipe from the distribution module to the last single pipe that flows into said pump to dynamically blend the streams.

Any of the prior described methods of manufacturing further comprising the step of connecting at least one pipe (may be a tube or slip stream) between said blend module and an analytical module, wherein said at least one pipe is connected to said blend module downstream of said pump that dynamically blends the streams. Any of the prior described methods of manufacturing further comprising the step of connecting at least one pipe from the analytical module (that is, downstream of the analytical equipment in said analytical module) to the blend module upstream of the blend module pump. Any of the prior described methods of manufacturing further comprising the step of connecting at least one filter element in said blend module in a pipe downstream of the pump in the blend module. Any of the prior described methods of manufacturing further comprising the step of connecting at least one filter element in said blend module in the last single pipe in said blend module. Any of the prior described methods of manufacturing further comprising the step of connecting at least one pipe between the blend module and the distribution module wherein said distribution module comprises a tank and wherein said at least one pipe transports a blended slurry or chemical blend stream from said blend module to said distribution tank. Any of the prior described methods of manufacturing further comprising the step of connecting a three-way valve and a restriction orifice in at least one pipe and connecting a second pipe to said three-way valve, said valve when open to said second pipe provides for restricted flow of slurry or chemical blend in said pipe having said restricted orifice therein, said pipe having said restricted orifice is used to change the direction of at least part of said slurry or chemical blend stream. Any of the prior described methods of manufacturing further comprising the step of connecting said pipe having said restricted orifice to an analytical module. Any of the prior described methods of manufacturing further comprising the step of connecting a pipe between said blend module pump and said distribution module and connecting a slip stream tube to said pipe between said blend module pump and said distribution module and connecting said slip stream to said analytical module. Any of the prior described methods of manufacturing further comprising the step of connecting a pipe from said blend module to a carboy compartment for removing samples of the blended slurry or chemical blend. Any of the prior described methods of manufacturing further comprising the steps of: providing a distribution module comprising one or more distribution tanks, one or more distribution global loops, and one or more pumps, said at least one distribution tank, at least one distribution global loop and at least one pump are in fluid communication, and connecting said distribution module to said blend module via at least one pipe. Any of the prior described methods of manufacturing further comprising the step of connecting at least one filter or filter element via at least one pipe into fluid communication with said distribution tank. Any of the prior described methods of manufacturing wherein at least one filter or filter element is connected within the global loop so that blended slurry or chemical blend flows from the global loop through at least one of the at least one filter or filter element and after passing through the at least one of the at least one filter or filter element the blended slurry or chemical blend returns to the global loop downstream of said at least one of the at least one filter or filter element. Any of the prior described methods of manufacturing further comprising the step of connecting one or more sample ports in said distribution module and connecting the sample ports via tubes to the analytical module to provide slurry or chemical blend from said distribution module to said analytical module for testing. Any of the prior described methods of manufacturing further comprising the step of connecting one or more sample ports in said distribution module and connecting to the sample ports tubes that are also connected to the analytical module to provide slurry or chemical blend from said distribution module to said analytical module for testing, and also optionally further comprising the step of connecting a tube between said analytical module and said distribution module to return at least a portion of the sample to the distribution module after testing by the analytical module wherein optionally only one analytical module is provided for the slurry and/or chemical blend apparatus.

Any of the prior described methods of manufacturing further comprising the step of connecting one or more back pressure controllers and pressure sensors in the distribution module's global loop. Any of the prior described methods of manufacturing further comprising the step of connecting one or more flow sensors in the distribution module's global loop. Any of the prior described methods of manufacturing further comprising the step of connecting the return exit pipe of the distribution module's global loop to the distribution tank and attaching one or more eductors to the exit of the return pipe of the global loop into the distribution tank.

A method of manufacturing a slurry and/or chemical blend supply apparatus comprising the step of connecting at least one pipe to a tank and connecting at least one eductor to said at least one pipe. Any of the prior described methods of manufacturing a slurry and/or chemical blend supply apparatus of any of the preceding claims wherein said apparatus further comprises a tank, and said tank comprises one or more eductors located at the bottom portion of said tank comprising the step of attaching said one or more educators to a return pipe located at the bottom of the tank. Any of the prior described methods of manufacturing comprising the step of connecting a strainer in at least one pipe of said apparatus to remove debris or particles. Any of the prior described methods of manufacturing a slurry and/or chemical blend supply apparatus comprising the step of connecting to a tank a double line loop to a pipe at the exit opening of said tank. Any of the prior described methods of manufacturing further comprising the step of connecting at least one of each of a centrifugal pump, a diaphragm pump and a peristaltic pump to the slurry and/or chemical blend supply apparatus.

This invention further provides the method of manufacturing any of the embodiments of a slurry and/or chemical blend supply apparatus disclosed herein which entails the step of connecting the component parts of the apparatus or modules of the apparatus in such a way to manufacture the slurry and/or chemical blend supply apparatuses described and shown in the specification including the drawings. This invention further provides the use of any of the apparatuses disclosed or claimed herein to blend, supply, dilute, transport and/or analyze the slurry and/or chemical blend.

Additional embodiments (possible claims) of this invention include the following:

1. A slurry and/or chemical blend supply apparatus, methods of use and methods of manufacturing the apparatus comprising any of the modules or aspects of the modules or components described in the specification or claims, alone or in any combination.

2. A slurry and/or chemical blend supply apparatus comprising an optional feed module comprising at least one pump and tank for holding raw slurry, and a circulation loop connected to the tank for circulating the raw slurry in the tank.

3. Any of the claims or embodiments wherein said circulation loop further comprises a pump connected to a pipe at or near the bottom of the tank and a return pipe that returns the raw slurry to the tank.

4. Any of the claims or embodiments wherein said circulation loop further comprises a back pressure controller.

5. Any of the claims or embodiments wherein said circulation loop comprises a flow sensor (that may be used to regulate the speed of the pump).

6. Any of the claims or embodiments wherein said circulation loop comprises a pressure sensor (that may be used to regulate the back pressure controller).

7. Any of the claims or embodiments wherein said circulation loop comprises at least one pipe connected to the circulation loop that transfers slurry to the blend module.

8. Any of the claims or embodiments wherein said circulation loop comprises one or more pumps that pump raw slurry from one or more slurry supply containers and transfers the slurry to the tank.

9. Any of the claims or embodiments wherein said feed module can supply raw slurry to the blend module on-demand.

10. A slurry and/or chemical blend supply apparatus alone or in combination with any of the claims or embodiments wherein said feed module further comprises or comprises an in-line liquid particle counter and/or particle size distribution analyzer and one or more sample ports that can draw slurry samples from at least one or two or more locations in the feed module, optionally the slurry can be analyzed before transporting it from the slurry supply container to the feed tank, said in-line liquid particle counter and/or particle size distribution analyzer may optionally analyze only raw slurry, with the apparatus comprising a second optional in-line liquid particle counter and/or particle size distribution analyzer for analyzing only blended slurry and/or chemical blend.

11. Any of the claims or embodiments further comprising or comprises an in-line liquid particle counter and/or particle size distribution analyzer or other analytical apparatus, sensor or module.

12. The slurry and/or chemical blend supply apparatus of any of claims 10-11 further wherein said at least one liquid particle counter and/or at least one particle size distribution analyzer to other analytical apparatus, sensor or module comprises a single dilution means or perform a single dilution step prior to analyzing a slurry sample.

13. The slurry and/or chemical blend supply apparatus of any of claims 10-12 further wherein said at least one liquid particle counter and/or at least one particle size distribution analyzer or other analytical apparatus, sensor or module comprises double dilution means to perform two dilution steps of the slurry sample prior to analyzing the diluted sample.

14. The slurry and/or chemical blend supply apparatus of any of claims 10-13 wherein said at least one liquid particle counter and/or at least one particle size distribution analyzer or other analytical apparatus, sensor or module comprises at least one peristaltic pump, flow sensors and needle valves to dilute the slurry sample prior to analyzing the diluted sample.

15. The slurry and/or chemical blend supply apparatus of any of claims 10-14 wherein said at least one liquid particle counter and/or at least one particle size distribution analyzer or other analytical apparatus, sensor or module comprises more than one flow sensors, more than one needle valves and more than one pneumatically controlled valves to dilute the slurry sample prior to analyzing the diluted sample.

16. The slurry and/or chemical blend supply apparatus of any of claims 10-15 wherein said apparatus and/or said at least one liquid particle counter and/or at least one particle size distribution analyzer or other analytical apparatus, sensor or module further comprises one or more than one dilution fixtures for the purpose of introducing the slurry or diluted slurry into UPW to create the diluted sample.

17. The slurry and/or chemical blend supply apparatus of claims 10-16 wherein the at least one analytical apparatus, sensor or module comprises one or more of the group consisting of one or more pH sensors, one or more hydrogen peroxide sensors, one or more density sensors, one or more conductivity sensors, optionally one or more liquid particle counters and optionally one or more particle size distribution analyzers.

18. Any of the claims or embodiments further comprising a blend module that combines two or more flowing component streams to form a blended slurry or chemical blend in a pipe.

19. Any of the claims or embodiments wherein said blend module comprises a pipe for each component stream and at least one flow controller in each of the component pipes to control the flow rate of the components and wherein said component pipes are connected and combined into a single pipe to form the blended slurry or chemical blend stream.

20. Any of the claims or embodiments wherein said blend module combines three or more flowing component streams and comprises a pipe for each component stream and at least one flow controller in each of those pipes to control the flow rate of the components and wherein two component pipes comprising a first and second component streams are combined into a single pipe to form a partially blended slurry or partially blended chemical blend stream and the third component stream is combined with the partially blended slurry or partially blended chemical blend stream.

21. Any of the claims or embodiments wherein said blend module further comprises one or more static mixers downstream of where any two or all of the component pipes are connected and the component streams flow together.

22. Any of the claims or embodiments wherein at least a portion of the blended slurry or chemical blend stream from the blend module passes through and is analyzed in an analytical module comprising one or more analytical apparatuses, optionally also comprising single or double dilution equipment and/or optionally comprising a liquid particle counter and/or particle size distribution analyzer.

23. Any of the claims or embodiments wherein at least a portion of the blended slurry or chemical blend stream from the blend module is transported to the distribution module.

24. Any of the claims or embodiments wherein at least a portion of the blended slurry or chemical blend stream from the analytical module is transported to the distribution module.

25. Any of the claims or embodiments wherein at least a portion of the blended slurry or chemical blend stream from the analytical module is transported to the blend module.

26. Any of the claims or embodiments wherein at least a portion of the blended slurry or chemical blend stream from the blend module is simultaneously transported to each of the distribution module and the analytical module.

27. Any of the claims or embodiments wherein said apparatus comprises a blend module wherein two or more component streams selected from the group consisting of raw slurry, water, one or more chemical components, one or more chemical components blended with water, partially blended slurry, fully blended slurry, partially blended chemical blend and fully blended chemical blend wherein said blend module further comprises a blend module pump and at least two of said component streams that are connected to and are combined in a single pipe to form a single stream within 1 foot upstream of the pump and said single pipe is connected to the pump so that the single stream is passed through the pump to dynamically blend the streams to form a blended slurry or chemical blend stream.

28. The slurry and/or chemical blend apparatus of claim 27 wherein said pipes for each of said component streams comprise flow controllers therein to control the amount of each component that is combined with the other components to form the blended slurry or chemical blend stream.

29. The slurry and/or chemical blend supply apparatus of any of claims 26-28 wherein the pipes for each of three component streams flowing therein are combined in stages, the first two pipes (first and second pipes) for the first two component streams are combined into a single (combined streams) pipe, said single (combined streams) pipe optionally having a static mixer therein to form a partially blended slurry and/or partially blended chemical blend stream, said single (combined streams) pipe is connected to a third pipe comprising said third component stream to form a second single pipe, said second single pipe being in fluid communication with a downstream pump, to dynamically blend the first, second and third component streams to form a blended slurry or chemical blend stream.

30. The slurry and/or chemical blend supply apparatus of any of claims 26-29 wherein a stream of already blended slurry or already blended chemical blend is combined with the other slurry or chemical blend component streams in said blend module.

31. The slurry and/or chemical blend supply apparatus of any of the claims 26-30 further comprising a pipe connected to said blend module downstream of said blend module pump and said analytical module wherein at least a sample of the blended slurry or chemical blend stream is sent to an analytical module via said pipe following said blend module pump.

32. The slurry and/or chemical blend supply apparatus of claim 31 wherein at least a portion of the sample is returned to the blend module upstream of the blend module pump after analysis by the analytical module.

33. The slurry and/or chemical blend supply apparatus of any of the claims 26-32 wherein said blend module further comprises at least one filter or at least one filter element located downstream of the blend module pump and the blended slurry or chemical blend stream (or additional blended slurry or additional blended chemical blend) downstream of the blend module pump is filtered.

34. Any of the claims or embodiments further comprising at least one filter element selected from the group consisting of one or more filters or filter banks, in serial or parallel arrangements, that optionally may be within one or more filter loops, in at least one, optionally in at least two, or optionally in at least three modules.

35. Any of the claims or embodiments further comprising at least one filter or filter bank in a parallel arrangement comprising valves to isolate each filter or filter bank, the filters or filter banks operate sequentially, that is, when at least one filter or filter bank is on-line, the other at least one filter or filter bank is off-line.

36. A slurry and/or chemical blend supply apparatus alone, or of any of the claims or embodiments, further comprising one or more filter loops wherein each filter loop comprises a pipe loop and at least one filter or filter bank that may be in a serial or parallel arrangement and a pump in the pipe loop; the pipe loop comprises an inlet and an outlet, said inlet connects to and is in fluid communication with a pipe or tank within at least one of the modules that supplies the slurry or chemical blend to be filtered, said outlet connects to and is in fluid communication with a pipe or tank within at least one of the modules (that may be the same or different module from the pipe or tank that the inlet connects to) for the return of the slurry or chemical blend after filtering, said pump in said filter loop draws slurry or chemical blend from the module to which the inlet is in fluid communication, filters the slurry or chemical blend in the at least one filter or filter bank and returns it to the same or a different module via the outlet.

37. Any of the claims or embodiments wherein said filter loop further comprises one or more valves in said inlet and optionally one or more valves in said outlet that can be opened or closed to bring said filter loop on-line or to take the filter loop off-line.

38. The slurry and/or chemical blend supply apparatus alone or of any of the preceding claims or embodiments further comprising or further wherein at least one filter is part of at least two filters or two filter banks arranged in series that operate simultaneously in series with the stream exiting the first filter or filter bank entering the second filter or filter bank.

39. Any of the claims or embodiments wherein at least a portion of said blended slurry or chemical blend stream from said blend module is transported to said distribution tank.

40. Any of the claims or embodiments further comprising means to change the direction of at least part of a slurry or chemical blend stream, said means comprising using a three-way valve to direct the slurry or chemical blend stream into a pipe having a restricted orifice therein.

41. Any of the claims or embodiments wherein said means are used to direct at least part of a stream of blended slurry or chemical blend into an analytical module.

42. Any of the claims or embodiments wherein for said slurry or chemical blend stream after said blend module pump, at least portion of said blended slurry and/or chemical blend is directed into an analytical module.

43. Any of the claims or embodiments comprising (in or downstream of said blend module) a carboy compartment for removing samples of the blended slurry or chemical blend from said slurry and/or chemical blend supply apparatus.

44. Any of the claims or embodiments further wherein said apparatus further comprises one or more sample ports, located in at least one module, preferably in at least two or at least three modules, that provide slurry or chemical blend to the analytical module.

45. Any of the claims or embodiments further wherein said blend module further comprises one or more sample loops that provide slurry or chemical blend to the analytical module and return it to the blend module.

46. Any of the claims or embodiments further wherein said feed module further comprises one or more sample ports that provide slurry or chemical blend to the analytical module.

47. Any of the claims or embodiments further wherein said feed module further comprises one or more sample loops that provide slurry and/or chemical blend to the analytical module and/or to a liquid particle counter and/or particle size distribution analyzer for the raw slurry and returns it to the feed module.

48. Any of the claims or embodiments comprising a distribution module comprising one or more distribution tanks and one or more pumps.

49. Any of the claims or embodiments further wherein said distribution module further comprises at least one or at least two filters, or at least one or at least two filter elements.

50. Any of the claims or embodiments wherein said at least one filter or at least one filter element is in the global loop, optionally upstream of the one or more tools.

51. Any of the claims or embodiments further wherein said distribution module further comprises one or more sample ports that provide slurry or chemical blend to the analytical module.

52. Any of the claims or embodiments further wherein said distribution module further comprises one or more sample loops that provide slurry or chemical blend to the analytical module and return it to the distribution module.

53. Any of the claims or embodiments further wherein said distribution module further comprises one or more global loops, one or more back pressure controllers and one or more pressure sensors on each of said one or more the global loops.

54. Any of the claims or embodiments further wherein said distribution module comprises one or more flow sensors on each of the one or more global loops.

55. Any of the claims or embodiments wherein said at least one global loop further comprises a pump connected to a pipe at or near the bottom of the distribution tank and a return pipe that returns the raw slurry or chemical blend to the tank.

56. Any of the claims or embodiments wherein said at least one global loop further comprises a back pressure controller.

57. Any of the claims or embodiments wherein said at least one global loop comprises a flow sensor (that may be used to regulate the speed of the pump).

58. Any of the claims or embodiments wherein said at least one global loop comprises a pressure sensor (that may be used to regulate the back pressure controller).

59. Any of the claims or embodiments further wherein said distribution tank and optionally the feed tank comprises one or more lines that penetrate the sidewall of the tank in the bottom portion of the tank.

60. Any of the claims or embodiments wherein said apparatus further comprises a tank, and said tank comprises one or more eductors.

61. Any of the claims or embodiments wherein said apparatus further comprises a tank, and said tank comprises one or more eductors located at the bottom portion of said tank wherein the line connected to the educator penetrates the sidewall of the tank in the bottom portion of the tank.

62. A slurry and/or chemical blend supply apparatus alone of any of the claims or embodiments further comprising a strainer in any of the lines to remove debris or particles, (especially in the lines preceding the one or more pumps in the feed module that draws the slurry from a slurry supply container, or circulates the slurry in the circulation loop, and/or the one or more lines upstream of the analytical module (for example, upstream of the liquid particle counter and/or particle size distribution analyzer in the feed module or elsewhere in the apparatus)).

63. A slurry and/or chemical blend supply apparatus alone or of any (e.g. feed, distribution tanks) of the claims or embodiments wherein a tank has a double line loop at its exit.

64. A slurry and/or chemical blend supply apparatus alone or of any of the claims or embodiments comprising a particle size distribution analyzer or a liquid particle counter.

65. An apparatus or method for blending a slurry and/or chemical blend for distribution to a tool (either alone or in combination with any of the claims or embodiments disclosed herein) comprising a pump fed by a single stream for which within 12 feet upstream of the pump comprises at least one junction where two or more streams are combined into a single stream, said two or more streams selected from the group consisting of raw slurry or chemical blend streams, water, chemical component streams comprising one or more chemicals or one or more chemicals and water, partially blended slurry, partially blended chemical blend streams and fully blended slurry or fully blended chemical blend streams.

66. The apparatus or method of claim 65 or any of the claims or embodiments wherein the streams (two or more or three or more) are combined within 5 feet (or within 2 feet or within 1 foot or within 6 inches) of said pump.

67. The apparatus or method of claim 65 or 66 or any of the claims or embodiments wherein the pump is selected from the group consisting of a centrifugal pump, a diaphragm pump and a peristaltic pump.

68. The apparatus or method of any of claims 65-67 or any of the claims or embodiments wherein the blend module pump is a centrifugal pump.

69. The apparatus or method of any of claims 65-68 or any of the claims or embodiments wherein said two or more streams are different.

70. The apparatus or method of any of claims 65-69 or any of the claims or embodiments wherein at said one or more junctions three of said streams are combined into a single stream.

71. The apparatus or method of any of claims 65-70 or any of the claims or embodiments wherein upstream of said pump are two or more junctions combining at least two of said component streams into a single stream.

72. The apparatus or method of any of claims 65-71 or any of the claims or embodiments wherein upstream of said pump is a first junction and a second junction wherein said first junction is closer to said pump, in said first junction a first stream comprising one or more chemical components and water is combined with a second stream comprising raw slurry and blended slurry flowing from said second junction wherein at said second junction a third and a fourth stream are combined, wherein said third stream comprises raw slurry and said fourth stream comprises blended slurry.

73. Any of the claims or embodiments further comprising (or wherein said one or more filters is part of) one or more filter loops comprising a piping loop, a pump and one or more filters or banks of filters in said loop, said pump directs slurry and/or chemical blend to and from the one or more filters or banks of filters, optionally said pump operates at higher pressures than other pumps in the distribution module (for example), additionally or alternatively one or more of the filters used in the filter loop have smaller pores than if the filter were in fluid communication (not in a filter loop) with the global loop (for example).

74. The slurry and/or chemical blend supply apparatus alone or in combination with any of the claims or embodiments, said apparatus comprising a feed module, a blend module, an analytical module and a distribution module wherein said apparatus blends and supplies continuously greater than 10 liters per minute of blended slurry or chemical blend to a global loop (or one of two global loops) that is in fluid communication with a plurality of tools.

75. Any of the claims or embodiments, wherein said distribution module comprises at least two distribution tanks and at least two global loops wherein said apparatus blends and supplies blended slurry to the first of said at least two distribution tanks to supply a first global loop in fluid communication with the first distribution tank and blends and supplies chemical blend to a second of said at least two distribution tanks to supply a second of said global loops in fluid communication with the second distribution tank, said apparatus optionally also comprising a first and second blend train for blending the blended slurry in the first blend train and the chemical blend in the second blend train.

76. Any of the claims or embodiments, wherein said distribution module comprises at least two distribution tanks and at least two global loops wherein said apparatus blends and supplies one type of blended slurry to the first of said at least two distribution tanks to supply the first of said global loops in fluid communication with the first distribution tank and blends and supplies a second blended slurry to a second of said at least two distribution tanks to supply the second of said global loops in fluid communication with the second distribution tank, optionally also comprising a first and second blend train for blending each of the first and second slurries.

77. Any of the claims or embodiments wherein said apparatus wherein said first and second global loops are each in fluid communication with a plurality of tools (may be more than 8 tools) that may be the same or different tools for each global loop.

78. The use of any of the apparatuses of any of the preceding claims.

79. The method of making any of the apparatuses of any of the preceding claims.

80. The process of blending at least two or more component streams selected from the group consisting of raw slurry or chemical blend, water, one or more chemical components, one or more chemical components blended with water, partially blended slurry, fully blended slurry and fully blended chemical blend comprising the step of combining at least two streams to form a single stream within 2 feet of a pump and passing the single stream through the pump to dynamically blend the streams in a dynamic blending step.

81. Any of the claims or embodiments wherein the streams are combined within 1 foot of said pump and optionally three or more or four or more component streams are combined.

82. Any of the claims or embodiments wherein the pump is a centrifugal pump.

83. Any of the claims or embodiments wherein prior to said combining step comprises mixing (combining) three of said component streams.

84. Any of the claims or embodiments wherein upstream of said combining step is a first step of combining at least two of said component streams into a single stream.

85. Any of the claims or embodiments wherein after said earlier combining step, and before said combining step is a second step of combining at least two of said component streams.

87. Any of the claims or embodiments wherein said first combining step combines at least two or more component streams selected from the group consisting of raw slurry water, chemical components, partially blended slurry, fully blended slurry, partially blended chemical blend and fully blended chemical blend within 5 feet of a pump.

88. Any of the claims or embodiments wherein the results from any analysis performed by an analytical apparatus that may be part of said analytical module causes the blended slurry or chemical blend or raw slurry to be redirected to one or more of the following: one or more filter elements (e.g., filter, filter loop, filter bank), one or more small particle removal means, or to a waste stream, or for the apparatus to adjust the flow controllers for the slurry or chemical blend component streams in the blend module, or for the distribution tank to receive a dose of one or more of the component streams, or for an alarm to sound.

89. The process of using any of the apparatus of any of the preceding claims to blend, supply, dilute, transport, circulate or analyze the raw slurry, blended slurry or chemical blend, or raw slurry and at least two types of blended slurry or raw slurry, blended slurry and chemical blend, or two types of chemical blends.

90. A slurry and/or chemical blend supply apparatus, alone or of any of the previous embodiments or claims in any combination, comprising a blend module that combines two or more flowing component streams to form a blended slurry and/or chemical blend in a pipe, wherein said blend module comprises a pipe for each component stream and at least one flow controller in each of at least two of the component pipes to control the flow rate of the components and wherein said component pipes are connected and combined into a single pipe to form the blended slurry or blended chemical blend stream.

91. A slurry and/or chemical blend supply apparatus, alone or of any of the previous embodiments or claims in any combination, comprising a blend module, wherein said blend module combines three or more component streams, said blend module comprises, three or more pipes, one pipe for each of said three or more component streams and at least one flow controller in at least three of the pipes to control the flow rate of each of the three or more component streams and wherein first and second pipes of said three or more pipes are combined into a single pipe to form a partially blended slurry or partially blended chemical blend stream and a third pipe of said three or more pipes is combined with the said single pipe to combine a third component stream with the partially blended slurry or partially blended chemical blend stream into a second single pipe.

92. Any of the embodiments or claims in any combination, wherein said one or more component pipes are combined in stages.

93. Any of the embodiments or claims in any combination, wherein said blend module comprises a split mixer comprising at least three feed pipes for each of three component streams, said feed pipes are each connected to a receiving pipe with a middle feed pipe located between the other two feed pipes, at least two split pipes connected to opposite ends of said receiving pipe and a rejoinder pipe connected where said at least two split pipes come together.

94. Any of the embodiments or claims in any combination, wherein the least reactive of said components is introduced into the middle feed pipe.

95. Any of the embodiments or claims in any combination, wherein said blend module further comprises a pump.

96. Any of the embodiments or claims in any combination, wherein said blend module further comprises a pump and said two or three or more component pipes flow two or three or more component streams selected from the group consisting of raw slurry, water, one or more chemical components, one or more chemical components blended with water, partially blended slurry, fully blended slurry, partially blended chemical blend and fully blended chemical blend and further wherein said at least two component pipes are connected and combined into a single pipe upstream of and within 2 feet of said blend module pump.

97. Any of the embodiments or claims in any combination, wherein said blend module further comprises a pump and said three or more component pipes for three or more component streams selected from the group consisting of raw slurry, water, one or more chemical components, one or more chemical components blended with water, partially blended slurry, fully blended slurry, partially blended chemical blend and fully blended chemical blend and further wherein said at least three component pipes are connected and combined into a single pipe upstream of and within 2 feet of said blend module pump.

98. Any of the embodiments or claims in any combination, wherein the blend module pump is selected from the group consisting of a centrifugal pump, a diaphragm pump and a peristaltic pump.

99. Any of the embodiments or claims in any combination, wherein the blend module pump is a centrifugal pump.

100. Any of the embodiments or claims in any combination, wherein upstream of said blend module pump is a first junction of pipes and a second junction of said component pipes wherein said first junction is closer to said pump, in said first junction a first stream comprising one or more chemical components and water is combined with a second stream comprising raw slurry, said first stream flowing from said second junction wherein at said second junction a third and a fourth stream are combined, wherein said third stream comprises water and said fourth stream comprises one or more chemical components to make said first stream.

101. Any of the embodiments or claims in any combination, wherein said blend module further comprises a static mixer in the pipe for said first stream.

102. Any of the embodiments or claims in any combination, wherein said blend module further comprises at least one component pipe for flowing at least one stream of fully blended slurry or fully blended chemical blend into said blend module to combine with said components of said blended slurry or chemical blend to form additional fully blended slurry or additional fully blended chemical blend.

103. Any of the embodiments or claims in any combination, wherein said blend module further comprises two component pipes for flowing two streams of fully blended slurry or fully blended chemical blend into said blend module to form additional fully blended slurry or additional fully blended chemical blend.

104. Any of the embodiments or claims in any combination, further comprising an analytical module in fluid communication with said blend module and wherein at least a portion of the blended slurry or chemical blend stream from the blend module flows to and is analyzed in said analytical module.

105. Any of the embodiments or claims in any combination, further comprising an analytical module in fluid communication with said blend module wherein said at least a portion of the blended slurry and/or chemical blend stream downstream of said blend module pump flows to and is analyzed by said analytical module.

106. Any of the embodiments or claims in any combination, further comprising a distribution module and wherein at least a portion of the blended slurry or chemical blend stream from the blend module is transported to the distribution module.

107. Any of the embodiments or claims in any combination, further comprising a distribution module and an analytical module that are in fluid communication, said blend module being in fluid communication with said analytical module and said distribution module, wherein at least a portion of the blended slurry or chemical blend stream from the blend module flows to the analytical module and at least a portion of the stream from the analytical module flows to the distribution module.

108. Any of the embodiments or claims in any combination, further wherein at least a portion of the stream that flows to said analytical module flows to a waste stream downstream of the analytical module.

109. Any of the embodiments or claims in any combination, wherein at least a portion of the blended slurry or chemical blend stream from the analytical module is transported to the blend module.

110. Any of the embodiments or claims in any combination, wherein at least a portion of the blended slurry or chemical blend stream from the distribution module is transported to the blend module as an additional component stream that is blended in said blend module.

111. Any of the embodiments or claims in any combination, wherein said distribution module comprises a distribution tank and said blended slurry or chemical blend stream from the distribution module is transported from said distribution tank to said blend module.

112. Any of the embodiments or claims in any combination, wherein a slip stream tube connects the blend module to the analytical module.

113. Any of the embodiments or claims in any combination, further comprising an analytical module wherein at least a sample of the additional fully blended slurry or additional fully blended chemical blend stream flows to the analytical module downstream of said blend module or downstream of a blend module pump.

114. Any of the embodiments or claims in any combination, wherein at least a portion of the sample is returned to the blend module as an additional component stream that is blended in said blend module.

115. Any of the embodiments or claims in any combination, wherein said blend module further comprises at least one filter element.

116. Any of the embodiments or claims in any combination, wherein said blend module further comprises at least one filter element and wherein said at least one filter element is located downstream of said blend module pump.

117. Any of the embodiments or claims in any combination, further comprising a distribution module comprising a distribution tank and additional one or more pipes and at least one valve in each of said one or more pipes connecting the at least one of said component pipes in said blend module to said distribution tank for dosing at least one of said components directly into said distribution tank.

118. Any of the embodiments or claims in any combination, wherein said at least one valve and said one or more pipes for dosing the distribution tank are connected downstream of said flow controller in said at least one of said component pipes.

119. Any of the embodiments or claims in any combination, further comprising a distribution module or wherein said distribution module comprises one or more distribution tanks, one or more global loops, and one or more pumps.

120. Any of the embodiments or claims in any combination, wherein said distribution module comprises two distribution tanks, and two or more pumps.

121. Any of the embodiments or claims in any combination, further wherein each of said one or more distribution tanks comprises one or more level sensors.

122. Any of the embodiments or claims in any combination, wherein said apparatus further comprises two or more distribution tanks, each distribution tank connected to at least one global loop.

123. Any of the embodiments or claims in any combination, wherein each distribution tank is connected to the same global loop.

124. Any of the embodiments or claims in any combination, wherein said apparatus comprises two distribution tanks, wherein each distribution tank is connected to a different global loop.

125. Any of the embodiments or claims in any combination, wherein said apparatus blends and supplies blended slurry to one of said two distribution tanks and blends and supplies chemical blend to the other of said two distribution tanks or a second blended slurry to the second distribution tank.

126. Any of the embodiments or claims in any combination, further comprising a distribution module or wherein said distribution module further comprises at least one distribution tank, at least one pressure regulator, at least one pump at least one global loop, and at least one pressure vessel elements comprising one or more pressure vessels, each pressure vessel element is in fluid communication with a pressurized gas source, said at least one pressure regulator and said at least one pump; said at least one pump is in fluid communication with said distribution tank for transferring slurry or chemical blend from said at least one distribution tank into said at least one pressure vessel element continuously or nearly continuously at the same time slurry or chemical blend is supplied continuously or nearly continuously to said at least one global loop from said at least one pressure vessel element.

127. Any of the embodiments or claims in any combination, wherein said pump operates at a higher pressure than the pressure in the pressure vessel element into which said pump is transferring slurry or chemical blend.

128. Any of the embodiments or claims in any combination, wherein said apparatus comprises first and second pressure vessel elements, first and second pumps and first and second pressure regulators, wherein the first pressure vessel element, the first pump and the first pressure regulator operate together to supply slurry or chemical blend to the global loop, and the second pressure vessel element, the second pump and the second pressure regulator operate together to supply slurry or chemical blend to the at least one global loop.

129. Any of the embodiments or claims in any combination, wherein first pressure vessel element, first pump and first pressure regulator and said second pressure vessel elements, second pumps and pressure regulator alternate their operation to supply the same global loop.

130. Any of the embodiments or claims in any combination, wherein said distribution module further comprises one or more filter elements.

131. Any of the embodiments or claims in any combination, wherein at least one of said one or more filter elements is located in the global loop.

132. Any of the embodiments or claims in any combination, wherein at least one of said one or more filter elements is a filter loop.

133. Any of the embodiments or claims in any combination, further comprising an analytical module and wherein said distribution module further comprises one or more sample ports and one or more tubes or sample loops in fluid communication with said one or more sample ports that each provide slurry and/or chemical blend to the analytical module.

134. Any of the embodiments or claims in any combination, wherein said distribution module further comprises one or more back pressure controllers and pressure sensors on each of the one or more global loops.

135. Any of the embodiments or claims in any combination, wherein said distribution module further comprises one or more flow sensors on each of the one or more global loops.

136. Any of the embodiments or claims in any combination, further comprising an analytical module, said analytical module comprising one or more analytical apparatuses selected from the group consisting of in-line liquid particle counter, particle size distribution analyzer, pH sensor, hydrogen peroxide sensor, density sensor and conductivity sensor.

137. Any of the embodiments or claims in any combination, wherein said analytical module further comprises in-line single dilution equipment for performing a single dilution of a sample, said in-line dilution equipment being located upstream of said at least one of said one or more analytical apparatuses, and comprising at least one peristaltic pump, at least one flow sensor and at least one needle valve to dilute the slurry and/or chemical blend sample prior to analyzing the diluted sample.

138. Any of the embodiments or claims in any combination, wherein said analytical module further comprises in-line double dilution equipment for performing a double dilution of a sample, said in-line dilution equipment being located upstream of at least one of said one or more analytical apparatuses and comprising more than one flow sensor, more than one needle valve and more than one pneumatically controlled valve to dilute the slurry and/or chemical blend sample prior to analyzing the diluted sample.

139. Any of the embodiments or claims in any combination, wherein said analytical module comprises first and second analytical apparatuses and an inlet pipe for flowing a sample to said one or more analytical apparatuses wherein said pipe comprises at least one junction to direct said sample to at least a first analytical apparatus or to at least a second analytical apparatus.

140. Any of the embodiments or claims in any combination, wherein said analytical module comprises an inlet pipe for flowing a sample to one or more analytical apparatuses wherein said inlet pipe comprises at least one junction and at least one valve to direct said sample to in-line dilution equipment prior to flowing said diluted sample into said liquid particle counter or said particle size distribution analyzer, said liquid particle counter or said particle size distribution analyzer connected to a downstream waste stream for said diluted sample.

141. Any of the embodiments or claims in any combination, wherein said junction and said valve can alternatively direct said sample to one or more analytical apparatuses in said analytical module without dilution, said one or more analytical apparatuses without dilution are selected from the group consisting of one or more pH sensors, one or more hydrogen peroxide sensors, one or more density sensors and one or more conductivity sensors.

142. Any of the embodiments or claims in any combination, wherein said analytical module comprises piping downstream of said one or more analytical apparatuses to return said sample to a module of said slurry and/or chemical blend supply apparatus after analysis in said one or more analytical apparatuses.

143. Any of the embodiments or claims in any combination, wherein said analytical module further comprises at least one dilution fixture for diluting slurry and/or chemical blend in UPW to create a diluted sample prior to analyzing the diluted sample by said analytical module.

144. Any of the embodiments or claims in any combination, wherein the analytical module further comprises two analytical apparatuses selected from the group consisting of pH sensors, hydrogen peroxide sensors, density sensors, conductivity sensors and liquid particle counters and particle size distribution analyzers.

145. Any of the embodiments or claims in any combination, wherein said analytical module comprises two or more pH sensors and one or more conductivity sensors upstream of one or more peroxide sensors, wherein downstream of the pH and conductivity sensors and upstream of the one or more peroxide sensors, said analytical module comprises a pipe junction to split a sample stream so that only a portion of the sample stream flows to said one or more peroxide sensors.

146. Any of the embodiments or claims in any combination, further comprising means to redirect all or a portion of a stream into said analytical module comprising a 3-way valve and a restriction orifice.

147. Any of the embodiments or claims in any combination, further comprising a blend module and a distribution module and an optional feed module, and further comprising more than one sample ports and more than one sample tubes or sample loops connected to said sample ports in said one or more other modules, said one or more sample ports and more than one sample tubes or sample loops being in fluid communication with said analytical module for analyzing samples from more than one sample port in said apparatus.

148. Any of the embodiments or claims in any combination, further comprising a feed module, said feed module comprising a first pump and at least one feed tank for holding raw slurry, said first pump for transporting raw slurry from a slurry supply container into said feed tank, said feed module further comprising at least one circulation loop and a second pump in the at least one circulation loop connected to the at least one feed tank, said second pump for pumping said raw slurry from the feed tank through the circulation loop and back to the feed tank, wherein the circulation loop further comprises a pipe that supplies only a portion of the raw slurry from the circulation loop to said blend module when the blend module is blending slurry, said circulation loop further comprises a back pressure controller, and a pressure sensor that measures a pressure in the circulation loop that is used to regulate a valve in said back pressure controller to maintain said raw slurry circulating through all of the circulation loop continuously.

149. Any of the embodiments or claims in any combination, wherein said feed module further comprises a liquid particle counter and/or particle size distribution analyzer.

150. Any of the embodiments or claims in any combination, wherein said feed module further comprises an in-line liquid particle counter and/or particle size distribution analyzer and further comprises more than one sample port for analyzing a sample of raw slurry from more than one location in the feed module.

151. Any of the embodiments or claims in any combination, further comprising one or more filter elements, one or more membranes, or other treatment means for the removal of large or small particles from said slurry.

152. Any of the embodiments or claims in any combination, wherein said slurry is directed to said one or more filter elements, one or more membranes or other treatment means after analysis by said liquid particle counter or particle size distribution analyzer.

153. Any of the embodiments or claims in any combination, further comprising a filter loop in the feed module.

154. Any of the embodiments or claims in any combination, further comprising means to change the direction of at least part of a stream, said means comprising a three-way valve, pipes and a restricted orifice in one of said pipes, said three-way valve capable of directing the stream into said pipe having said restricted orifice therein.

155. Any of the embodiments or claims in any combination, further comprising a carboy compartment for removing samples of the blended slurry or chemical blend from the apparatus.

156. Any of the embodiments or claims in any combination, wherein said distribution module further comprises two or more sample loops that provide slurry and/or chemical blend to the analytical module and return it to the distribution module.

157. Any of the embodiments or claims in any combination, further comprising one or more strainer components.

158. Any of the embodiments or claims in any combination, further wherein said strainer components are located upstream of at least one flow controller or at least one pump.

159. Any of the embodiments or claims in any combination, further comprising one or more filter loops, said one or more filter loops comprising a piping loop and at least one filter element, and a pump within said piping loop.

160. Any of the embodiments or claims in any combination, further comprising one or more filter elements in a global loop upstream of the tools.

161. Any of the embodiments or claims in any combination, further comprising at least one feed tank or at least one distribution tank wherein said tank comprises one or more eductors in the bottom portion of said tank.

162. Any of the embodiments or claims in any combination, wherein said tank comprises one or more side walls, and further comprising piping connected to said eductors, said piping penetrates the side wall in the bottom portion of said tank.

163. Any of the embodiments or claims in any combination, wherein said tank further comprises a double exit loop.

164. Any of the embodiments or claims in any combination, comprising a blend module, an analytical module, a distribution module and an optional feed module, wherein said apparatus blends and supplies greater than 10 liters per minute of blended slurry or chemical blend continuously to at least one global loop that is in fluid communication with a plurality of tools.

165. Any of the embodiments or claims in any combination, wherein said apparatus supplies 10 or more tools.

166. Any of the embodiments or claims in any combination, wherein the apparatus comprising a distribution module comprises one or more distribution tanks, one or more pumps and one or more global loops in fluid communication, wherein raw slurry and/or chemical blend in said one or more global loops are continuously or near continuously circulating in at least one of said one or more global loops.

167. Any of the embodiments or claims in any combination, wherein the apparatus further comprises a feed module comprising feed tank, a pump and a circulation loop in fluid communication wherein raw slurry in said circulation loop is continuously or near continuously circulating.

168. Any of the embodiments or claims in any combination, wherein said one or more distribution tanks each comprise tank level indicators, and the apparatus further comprises one or more blend modules that blend blended slurry and/or chemical blend when a tank level indicator in said one or more distribution tanks indicates that the level of blended slurry and/or chemical blend in that distribution tank is below a previously defined level.

169. Any of the embodiments or claims in any combination, wherein said blend module will stop blending when said one of said one or more tank level indicators in said one or more distribution tanks to which blended slurry and/or chemical blend is being supplied by said blend module, measures that the level of blended slurry and/or chemical blend being supplied by said blend module is at or above a previously defined level.

170. Any of the embodiments or claims in any combination, wherein said feed tank comprises a tank level indicator that will cause said apparatus to sound an alarm when said tank level indicator in said feed tank measures that the level of raw slurry in the feed tank is below a previously defined level.

171. Any of the embodiments or claims in any combination, wherein said one or more global loops comprise one or more filter elements that continuously or near continuously filter the blended slurry and/or chemical blend in the global loop.

172. Any of the embodiments or claims in any combination, wherein said one or more global loops comprise said one or more filter elements upstream of tools in fluid communication with the one or more global loops.

173. Any of the embodiments or claims in any combination, or alone, a process of blending and supplying a slurry and/or chemical blend to a plurality of tools said process comprising the step of blending at least two or more component streams in a slurry and/or chemical blend supply apparatus, the at least two or more component streams being selected from the group consisting of raw slurry, water, one or more chemical components, one or more chemical components blended with water, partially blended slurry, fully blended slurry, partially blended chemical blend and fully blended chemical blend streams, by flowing the at least two or more component streams through flow controllers that provide measured amounts of the streams to be combined and combining at least two streams to form a single stream.

174. Any of the embodiments or claims in any combination, wherein the combining step to form said single stream occurs within 2 feet of a pump and passing said single stream through the pump.

175. Any of the embodiments or claims in any combination, wherein the streams are combined within 1 foot of said pump.

176. Any of the embodiments or claims in any combination, wherein the pump is a centrifugal pump.

177. Any of the embodiments or claims in any combination, wherein said combining step comprises combining three of said component streams.

178. Any of the embodiments or claims in any combination, wherein prior to said combining step is a first step of combining at least two of said component streams to form a first partially blended slurry or first partially blended chemical blend stream.

179. Any of the embodiments or claims in any combination, wherein after said first step of combining but before said combining step is a second step of combining at least two of said component streams to form a second partially blended slurry or a second partially blended chemical blend stream.

180. Any of the embodiments or claims in any combination, wherein one of said at least two component streams that are combined in said second step of combining is said first partially blended slurry or said first partially blended chemical blend.

181. Any of the embodiments or claims in any combination, wherein the first step of combining is within 5 feet of said pump.

182. Any of the embodiments or claims in any combination, further comprising the step of pumping raw slurry from a slurry supply container into a feed tank and circulating said raw slurry around a circulation loop connected to said feed tank.

183. Any of the embodiments or claims in any combination, further comprising the step of providing a raw slurry stream to a blend module from said circulation loop, blending said raw slurry steam in the blend module with one or more other component streams to make a blended slurry by flowing said raw slurry stream and said one or more component streams through at least one flow controller for each said streams and combining said streams downstream of the flow controllers by combining the pipes for each stream into a single pipe containing all of the streams to create a blended slurry.

184. Any of the embodiments or claims in any combination, further comprising the step of blending chemical blend, providing said chemical blend to a global loop.

185. Any of the embodiments or claims in any combination, further comprising the step of combining said pipes for each stream in stages and directing the single pipe into a pump.

186. Any of the embodiments or claims in any combination, further comprising the step of directing at least a portion of said blended slurry or chemical blend, downstream of said combining step, to one or more of the following: one or more tools, an analytical apparatus, an analytical module, a distribution tank, a global loop, back to the blend module, or to a filter element.

187. Any of the embodiments or claims in any combination, further comprising the step of pumping the raw slurry in a circulation loop from said slurry supply container for a period of time prior to and/or simultaneously with pumping the raw slurry from the slurry supply container into said feed tank.

188. Any of the embodiments or claims in any combination, further comprising the step of passing raw slurry through a strainer before one or more pumps in the feed module.

189. Any of the embodiments or claims in any combination, further comprising the step of filtering said raw slurry from said slurry supply container prior to and/or simultaneously with transporting it to said feed tank or to said circulation loop.

190. Any of the embodiments or claims in any combination, further comprising the step of filtering said raw slurry in a filter loop in communication with the slurry supply container prior to transferring the slurry to the feed tank.

191. Any of the embodiments or claims in any combination, further comprising the step of by-passing the feed tank and transporting raw slurry to the blend module when there is an urgent demand for raw slurry in the blend module.

192. Any of the embodiments or claims in any combination, further comprising the step of circulating raw slurry from the feed tank through a circulation loop and back to the feed tank.

193. Any of the embodiments or claims in any combination, or alone, a process comprising the step of, transferring at least a portion of the slurry in the circulation loop of the feed module to a blend module when the blend module is blending slurry.

194. Any of the embodiments or claims in any combination, further comprising the step of, stopping the transfer of the slurry from the circulation loop in the feed module to the blend module when the blend module is not blending slurry.

195. Any of the embodiments or claims in any combination, further comprising the step of filtering the slurry while it circulates in the circulation loop.

196. Any of the embodiments or claims in any combination, further comprising the step of filtering the slurry in the circulation loop when the slurry is not being transferred to the blend module, and not filtering the slurry in the circulation loop when the slurry is being transferred to the blend module.

197. Any of the embodiments or claims in any combination, further comprising the step of analyzing raw slurry, chemical blend or blended slurry using one or more analytical apparatuses from one or more of said feed, blend or distribution modules.

198. Any of the embodiments or claims in any combination, further comprising the step of diluting at least a portion of the slurry to form a diluted slurry prior to analyzing the slurry.

199. Any of the embodiments or claims in any combination, further comprising the step of diluting said diluted slurry to form a twice diluted slurry prior to analyzing said slurry.

200. Any of the embodiments or claims in any combination, further comprising the step of transporting the slurry and/or chemical blend from one or more modules (feed, and/or blend and/or distribution) of the slurry and/or chemical blend supply apparatus to an analytical module via sample tubes or via sample loops.

201. Any of the embodiments or claims in any combination, further comprising the step of returning the slurry and/or chemical blend to the slurry and/or chemical blend supply apparatus, optionally to the same module, after said analyzing step.

202. Any of the embodiments or claims in any combination, further comprising controlling the flow and/or dilution of slurry and/or chemical blend in said analytical module using one or more pieces of equipment selected from the group consisting of: a needle valve, a peristaltic pump, a rotometer and a dilution fixture.

203. Any of the embodiments or claims in any combination, further comprising transporting slurry or chemical blend from one or more feed and/or blend and/or distribution modules, analyzing the slurry or chemical blend, optionally diluting the slurry prior to analyzing, and optionally returning at least a portion of the slurry or chemical blend to a module which may be the same module from which the slurry and/or chemical blend was transported from.

204. Any of the embodiments or claims in any combination, further comprising the step of returning the slurry or the chemical blend to the distribution tank or sending it to a waste stream.

205. Any of the embodiments or claims in any combination, further comprising the step of drawing slurry or chemical blend from multiple modules sequentially for analysis by one or more analytical apparatuses in said analytical module.

206. Any of the embodiments or claims in any combination, further comprising the step of using one or more measurements made by the analytical module by a computer for the apparatus for directing the apparatus to take action based on one or more of the measurements.

207. Any of the embodiments or claims in any combination, further comprising the step of directing raw slurry and/or blended slurry and/or partially blended slurry and/or one or more chemical component streams and/or partially blended chemical blend and/or a chemical blended stream to a waste stream from any module in the apparatus, or directing the slurry to one or more filters, or treatment means, or adjusting the composition in the blend module or adding a metered amount of one or more components to the distribution tank from the blend module, or sending raw slurry to the blend module, or sounding an alarm.

208. Any of the embodiments or claims in any combination, further comprising the step of analyzing raw slurry using a particle size distribution analyzer or a liquid particle counter prior to or at the beginning of transferring raw slurry to the feed tank from the slurry supply container so that the transfer can be terminated if said analyzing step determines that the raw slurry is out of specification.

209. Any of the embodiments or claims in any combination, further comprising the step of analyzing raw slurry using a particle size distribution analyzer or a liquid particle counter prior to transferring raw slurry to the blend module so that the transfer can be terminated if said analyzing step determines the raw slurry is out of specification.

210. Any of the embodiments or claims in any combination, further comprising the step of analyzing blended slurry using a particle size distribution analyzer or a liquid particle counter or one or more other analytical apparatuses prior to transferring blended slurry to the distribution tank from the blend module so that the transfer can be terminated if said analyzing step determines the slurry is out of specification.

211. Any of the embodiments or claims in any combination, further comprising the step of passing slurry and/or chemical blend through a strainer in one or more pipes in the slurry and/or chemical blend supply apparatus.

212. Any of the embodiments or claims in any combination, further comprising the step of passing slurry and/or chemical blend through a strainer in one or more pipes in the slurry and/or chemical blend supply apparatus upstream of one or more of the pieces of equipment selected from the group consisting of flow controllers, pumps, needle valves, analytical apparatuses or other restricted valves or orifices.

213. Any of the embodiments or claims in any combination, further comprising the step of controlling the flow through the circulation loop or global loop by measuring a flow rate using a flow sensor and using the measured flow rate to adjust a pump speed and measuring a pressure and using the pressure in the circulation loop or global loop to adjust the pump speed, and/or using a pressure sensor to adjust a back pressure controller, said back pressure controller being located near the return of the circulation loop or global loop.

214. Any of the embodiments or claims in any combination, further comprising the step of filtering the slurry and/or chemical blend in one or more modules, optionally in each of the feed, blend and distribution modules.

215. Any of the embodiments or claims in any combination, further comprising the step of filtering slurry or chemical blend in a separate filter loop, said filter loop comprising a pipe loop, a filter loop pump, and one or more filters in fluid communication with the pipe loop.

216. Any of the embodiments or claims in any combination, further comprising the step of blending at least two or more component streams, the at least two or more component streams being selected from the group consisting of raw slurry, water, one or more chemical components, one or more chemical components blended with water, a partially blended slurry, partially blended chemical blend stream, fully blended slurry or fully blended chemical blend stream, said process comprising the steps of flowing the at least two streams through flow controllers that provide measured amounts of each of the streams to be combined and combining the at least two streams to form a single stream, optionally wherein said combining step to form said single stream occurs upstream of the pump, within less than 5 or 2 feet or 1 foot or 6 inches of flowing distance of said single stream to the pump and flowing said single stream downstream through the pump.

217. Any of the embodiments or claims in any combination, further comprising the step of flowing said raw slurry stream through a strainer upstream of said flow controller.

218. Any of the embodiments or claims in any combination, wherein said flowing step and said combining step combines three of said component streams.

219. Any of the embodiments or claims in any combination, further comprising the step of prior to said combining step, a first step of combining at least two of said component streams to form a first partially blended slurry and/or first partially blended chemical blend stream.

220. Any of the embodiments or claims in any combination, further comprising the step of combining said first partially blended stream (slurry or chemical blend) with another component stream in said combining step.

221. Any of the embodiments or claims in any combination, further comprising, after said first step of combining but before said combining step, a second step of combining at least two of said component streams to form a second partially blended (slurry and/or chemical blend) stream or a fully blended (slurry and/or chemical blend) stream, said combining step therefore becoming a third step of combining.

222. Any of the embodiments or claims in any combination, further comprising the step of wherein one of said at least two component streams that are combined in said second step of combining is said first partially blended slurry or first partially blended chemical blend.

223. Any of the embodiments or claims in any combination, further comprising the step of combining all the component streams combined in all of the combining steps within 2 feet upstream of a pump.

224. Any of the embodiments or claims in any combination, further comprising the step of combining a fully blended slurry or fully blended chemical blend in any one of said first, second or third combining steps or in an optional additional fourth combining step of blending component streams in said blend module.

225. Any of the embodiments or claims in any combination, further comprising the step of flowing said fully blended slurry or fully blended chemical blend from a distribution tank or from an analytical module or from the blend module or from a container of blended slurry or chemical blend.

226. Any of the embodiments or claims in any combination, wherein said step of combining blended slurry or blended chemical blend may be preceded by any one or more of the steps selected from the group consisting of: filtering said blended slurry or chemical blend, analyzing said blended slurry or chemical blend, or flowing said blended slurry or chemical blend from said distribution tank to said blend module.

227. Any of the embodiments or claims in any combination, wherein the blended stream after any of the combining steps is selected from the group consisting of partially blended slurry stream or partially blended chemical blend stream, fully blended slurry, fully blended chemical blend, additional fully blended slurry and additional fully blended chemical blend stream.

228. Any of the embodiments or claims in any combination, further comprising the step of analyzing the slurry and/or chemical blend from one or more modules of the slurry and/or chemical blend supply apparatus, using one or multiple in-line analytical modules.

229. Any of the embodiments or claims in any combination, further comprising one or more of the following steps in response to the analyzing step performed by said one or more in-line analytical modules: alerting a technician, directing slurry into a treatment means, dosing said distribution tank with one or more components.

230. Any of the embodiments or claims in any combination, further comprising the steps of dosing said distribution tank with one or more components by flowing one or more components from said blend module to said distribution tank and terminating the dosing step once a sufficient amount of said one or more components has been dosed into the distribution tank.

231. Any of the embodiments or claims in any combination, further comprising the step of blending slurry or chemical blend by flowing two or more component streams into a split mixer.

232. Any of the embodiments or claims in any combination, further comprising the step of transporting blended slurry or chemical blend from the blend module to the distribution module, the distribution module may comprise a distribution tank for receiving the blended slurry or chemical blend, and the process may further comprise pumping the blended slurry or chemical blend from the distribution tank through a global loop to one or more CMP or other tools.

233. Any of the embodiments or claims in any combination, wherein said step of pumping the slurry or chemical blend around the global loop further includes the step of transporting at least a portion of the blended slurry or chemical blend in the global loop back to the one or more distribution tanks.

234. Any of the embodiments or claims in any combination, further comprising the step of measuring the pressure is said global loop and the flow rate of blended slurry or chemical blend in the global loop and adjusting the speed of the pump and the back pressure controller in response to those measurements to regulate the flow of the blended slurry or chemical blend in the global loop.

235. Any of the embodiments or claims in any combination, further comprising the step of measuring the level of slurry or chemical blend in the distribution tank and blending slurry or chemical blend if the level in the distribution tank is below a predefined level.

236. Any of the embodiments or claims in any combination, further comprising the step of providing a distribution module comprising first and second distribution tanks, at least one pump and at least one global loop, further comprising terminating the flow of slurry or chemical blend from a blend module to said first distribution tank and directing the flow of slurry or chemical blend to said second distribution tank.

237. Any of the embodiments or claims in any combination, further comprising the steps of providing a slurry or chemical blend supply apparatus comprising first and second distribution tanks, first and second distribution pumps, and first and second global loops; terminating the flow of blended slurry or chemical blend to and through the first distribution tank, the first pump, and the first global loop and instead directing the blended slurry or chemical blend to flow to and through the second distribution tank, the second pump and the second global loop.

238. Any of the embodiments or claims in any combination, further comprising the step of providing a slurry and/or chemical blend supply apparatus comprising first and second distribution tanks, first and second distribution pumps, and first and second global loops; and pumping via the first pump blended slurry or chemical blend from the first distribution tank to the first global loop, and pumping via the second pump blended slurry or chemical blend from the second distribution tank to the second global loop, 239. Any of the embodiments or claims in any combination, further comprising the step of blending a first and second blended slurry or a first and second chemical blend or first blended slurry and second chemical blend in the blend module and directing said first streams to said first distribution tank and said second streams to said second distribution tank.

240. Any of the embodiments or claims in any combination, further comprising the step of controlling the blending by the blend module of the first and second blended slurries or the first and second chemical blends or the first blended slurry and the second blended chemical blend based on demand by the first or second global loop or tank level sensors in said first or second distribution tanks.

241. Any of the embodiments or claims in any combination, further comprising the step of supplying raw slurry to the feed tank and/or to the blend module in response to demand from the slurry and/or chemical blend supply apparatus for blended slurry in distribution module.

242. Any of the embodiments or claims in any combination, further comprising the step of increasing or decreasing the speed of the global loop supply pump in response to an increase or decrease in the consumption of blended slurry and/or chemical blend by the tools in fluid communication with the global loop.

243. Any of the embodiments or claims in any combination, further comprising the step of starting or stopping the blending in the blend module based a level sensor measurement in at least one distribution tank.

244. Any of the embodiments or claims in any combination, further comprising the step of increasing the feed module pump speed on the circulation loop when the blend module consumes an increased amount of raw slurry and decreasing the feed module pump speed on the circulation loop when the blend module consumes a decreased amount of raw slurry.

245. Any of the embodiments or claims in any combination, further comprising the step of operating the slurry and/or chemical blend supply apparatus such that the distribution module is continuously circulating slurry and/or chemical blend through a global loop and the analytical module is continuously analyzing at one or more pre-set intervals individual samples of at least some slurry or chemical blend.

246. Any of the embodiments or claims in any combination, further wherein during said operating step, said analytical module analyzes individual samples from two or more sample loops from two or more modules in the apparatus.

247. Any of the embodiments or claims in any combination, further wherein during said operating step said feed module is continuously circulating slurry in a circulation loop.

248. Any of the embodiments or claims in any combination, further wherein during said operating step slurry or chemical blend is flowing through and is present in more than 75% of the total linear flowing distance of all of the pipes, tanks, and other parts and equipment that slurry or chemical blend flow through of the slurry and/or chemical blend supply apparatus when slurry and/or chemical blend is being supplied to the global loop.

249. Any of the embodiments or claims in any combination, further comprising the step of flowing slurry and/or chemical blend into a tank by passing the slurry and/or chemical blend through an eductor.

250. Any of the embodiments or claims in any combination, further comprising the step of transporting slurry and/or chemical blend from the exit opening at the bottom of each tank through a circulation loop to the return pipe in the tank and flowing the slurry and/or chemical blend out of one or more eductors located at the end of the return pipe inside the tank wherein said return pipe penetrates the sidewall of the tank at about the same level from the bottom of the tank as the eductor is located.

251. Any of the embodiments or claims in any combination, further comprising the step of flowing slurry or chemical blend out of the exit opening at the bottom of a tank into a double line exit loop.

252. Any of the embodiments or claims in any combination, further comprising the step of redirecting the flow of at least a portion of a slurry or chemical blend stream using a restricted orifice and a three-way valve.

253. Any of the embodiments or claims in any combination, further comprising the step of pumping slurry or chemical blend from a distribution tank into one or more pressure vessel elements, each of said one or more pressure vessel elements comprising one or more pressure vessels.

254. Any of the embodiments or claims in any combination, further comprising the step of maintaining the one or more pressure vessels of the one or more pressure vessel elements under a constant elevated pressure via a pressure regulator connected to a pressurized gas source.

255. Any of the embodiments or claims in any combination, further comprising the step of continuously pumping the slurry or chemical blend from a distribution tank at a pressure greater than the pressure in the one or more pressure vessels to continuously supply the one or more pressure vessel elements with slurry or chemical blend, so that said one or more pressure vessels can continuously supply one or more global loops with slurry or chemical blend.

256. Any of the embodiments or claims in any combination, further comprising the step of switching from the supply from the distribution tank of slurry or chemical blend by a first pump to a first pressure vessel element to the supply from the distribution tank of slurry or chemical blend by a second pump to a second pressure vessel element in the distribution module to supply one or more global loops with slurry or chemical blend.

257. Any of the embodiments or claims in any combination, further wherein the first pump supplying the first pressure vessel element and the second pump supplying the second pressure vessel element, both supply the same global loop.

258. Any of the embodiments or claims in any combination, further comprising the step of sounding an alarm when a sensor detects a slurry or chemical blend that is out of specification, while the global loop continues to supply slurry or chemical blend to the tools.

259. Any of the embodiments or claims in any combination, further comprising the step of circulating 10-30 LPM of slurry or chemical blend in at least one global loop continuously.

260. Any of the embodiments or claims in any combination, further wherein the slurry and/or chemical blend supply apparatus supplies 8 or more tools simultaneously and continuously for days or weeks or more at a time.

261. Any of the embodiments or claims in any combination comprising a bend module and a distribution module in fluid communication, said blend module comprises at least two component pipes, each component pipe for flowing a component stream therein, said component pipes combine to form a blended slurry or chemical blend in a single pipe; said distribution module comprises at least two distribution tanks and at least two global loops wherein said apparatus blends and supplies blended slurry to the first of said at least two distribution tanks to supply said blended slurry to a first global loop in fluid communication with the first distribution tank and said apparatus blends and supplies a chemical blend or a second blended slurry to a second of said at least two distribution tanks to supply a chemical blend or a second blended slurry to a second global loop in fluid communication with the second distribution tank.

262. Any of the embodiments or claims in any combination, wherein said blend module comprises first and second blend trains for blending the blended slurry in the first blend train and for blending the chemical blend or second blended slurry in the second blend train.

263. Any of the embodiments or claims in any combination, wherein said first and second blended slurries are not the same.

264. Any of the embodiments or claims in any combination, wherein said first and second global loops are each in fluid communication with a plurality of tools.

265. Any of the embodiments or claims in any combination, wherein said first and second global loops are each in fluid communication with a plurality of tools.

266. Any of the embodiments or claims in any combination, wherein said first and second global loops are in fluid communication with the same tools.

267. Any of the embodiments or claims in any combination, wherein said first global loop comprises at least one filter element upstream of said tools.

268. Any of the embodiments or claims in any combination comprising a blend module and a distribution module, said blend module being in fluid communication with said distribution module, said blend module combines two or more flowing component streams to form a blended slurry or chemical blend stream, wherein said blend module comprises a pipe for each component stream and at least one flow controller in each of the component pipes to control the flow rate of the components and wherein said component pipes are connected and combined into a single pipe to form the blended slurry or chemical blend stream, said distribution module comprising at least one distribution tank, said single pipe being in fluid communication with said at least one distribution tank, and further wherein said apparatus comprises one or more additional pipes and at least one valve in each of said one or more pipes connecting the at least one of said component pipes in said blend module to said distribution tank for dosing at least one of said components directly into said distribution tank as needed.

269. Any of the embodiments or claims in any combination, wherein said at least one valve and said one or more pipes for dosing the distribution tank are connected downstream of said at least one flow controller in said at least one of said component pipes.

270. Any of the embodiments or claims in any combination, further comprising a sample tube in fluid communication with the single pipe in the blend module, wherein at least part of the blended slurry or chemical blend from the blend module is directed to the analytical module by the sample tube.

271. Any of the embodiments or claims in any combination, further comprising a second sample tube in fluid communication with the global loop in the distribution module wherein at least part of the blended slurry or chemical blend from the distribution module is directed to the analytical module by the second sample tube.

272. Any of the embodiments or claims in any combination, further comprising a controller for controlling the dosing based on the time that the blended slurry or chemical blend is present in said distribution tank.

273. Any of the embodiments or claims in any combination, wherein said one or more additional pipes for dosing each have flow controllers therein for controlling an amount of said component dosed into the distribution tank.

274. Any of the embodiments or claims in any combination, comprising an analytical module, said analytical module comprising at least one dilution means comprising at least one dilution fixture to introduce slurry or diluted slurry into UPW to create a diluted sample prior to analyzing the diluted sample in said analytical module.

275. Any of the embodiments or claims in any combination, wherein said at least one dilution means comprises single dilution means, said single dilution means further comprising at least one peristaltic pump, at least one flow sensor and at least one needle valve.

276. Any of the embodiments or claims in any combination, wherein said at least one dilution means further comprises more than one flow sensors, more than one needle valves and more than one pneumatically controlled valves to dilute the slurry sample prior to analyzing the diluted sample.

277. Any of the embodiments or claims in any combination, wherein the analytical module comprises one or more of the group consisting of one or more pH sensors, one or more hydrogen peroxide sensors, one or more density sensors, one or more conductivity sensors, one or more liquid particle counters and one or more particle size distribution analyzers.

278. Any of the embodiments or claims in any combination, comprising a feed module for pumping raw slurry, a blend module that makes a blended slurry comprising said raw slurry, a distribution module, at least one particle size distribution analyzer or at least one liquid particle counter, and a treatment means, wherein said raw slurry or said blended slurry is directed to a treatment means for the removal of large or small particles from said slurry when said large or small particles are detected by said at least one distribution analyzer or at least one liquid particle counter.

279. Any of the embodiments or claims in any combination, wherein said feed module comprises said at least one liquid particle counter and/or said at least one particle size distribution analyzer and further comprises more than one sample tubes for analyzing a sample of the slurry from more than one location in the feed module, blend module or distribution module.

280. Any of the embodiments or claims in any combination, wherein said treatment means is selected from the group consisting of one or more filter elements or one or more membranes.

281. Any of the embodiments or claims in any combination, comprising a feed module comprising a feed tank, and a filter loop in fluid communication with a raw slurry supply container, said filter loop comprising a pump, one or more filters and a pipe loop for filtering the raw slurry in the raw slurry supply container before pumping it to the feed tank.

We claim:

1. A slurry and/or chemical blend supply apparatus comprising a bend module and a distribution module, said bend module and said distribution module being in fluid communication, said blend module comprises at least one blend train comprising at least three component pipes, each component pipe for flowing a different component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one pump, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different;

and wherein said first global loop comprises at least one filter element located in said global loop upstream of said plurality tools.

2. The slurry and/or chemical blend supply apparatus of claim 1 wherein said blend module comprises first and second blend trains for blending the first chemical blend or first blended slurry in the first blend train and for blending the second chemical blend or second blended slurry in the second blend train.

3. The slurry and/or chemical blend supply apparatus of claim 1 wherein said first and second blended slurries are not the same.

4. A slurry and/or chemical blend supply apparatus comprising a bend module and a distribution module, said bend module and said distribution module being in fluid communication, said blend module comprises at least one blend train comprising at least three component pipes, each component pipe for flowing a different component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one pump, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different; wherein said blend train further comprises a split mixer wherein said split mixer comprises at least three feed pipes one for each of the three component streams, said feed pipes are each connected to a receiving pipe with a middle feed pipe located between the other two feed pipes, at least two split pipes connected to opposite ends of said receiving pipe and a rejoinder pipe connected where said at least two split pipes come together and connect to said single pipe.

5. The slurry and/or chemical blend supply apparatus of claim 1 wherein said first and second global loops are in fluid communication with the same said plurality of tools.

6. A slurry and/or chemical blend supply apparatus comprising a bend module and a distribution module, said bend module and said distribution module being in fluid communication, said blend module comprises at least one blend train comprising at least two component pipes, each component pipe for flowing a component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one pump, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different; further comprising one or more additional pipes and at least one valve in each of said one or more pipes connecting at least one of said component pipes in said blend module to said distribution tank for dosing at least one of said components directly into said distribution tank as needed.

7. The slurry and/or chemical blend supply apparatus of claim 6 wherein said at least one valve and said one or more additional pipes for dosing the distribution tank are connected downstream of said at least one flow controller in said at least one of said component pipes.

8. The slurry and/or chemical blend supply apparatus of claim 6 further comprising an analytical module and a sample tube in fluid communication between the single pipe in the blend module and the analytical module, wherein at least part of the blended slurry or chemical blend from the blend module is directed from the blend module to the analytical module by the sample tube and further wherein the analytical module comprises one or more of the group consisting of one or more pH sensors, one or more hydrogen peroxide sensors, one or more density sensors, one or more conductivity sensors, one or more liquid particle counters and one or more particle size distribution analyzers.

9. The slurry and/or chemical blend supply apparatus of claim 8 further comprising a second sample tube in fluid communication with the first global loop wherein at least part of the blended slurry or chemical blend from the distribution module is directed to the analytical module by the second sample tube.

10. The slurry and/or chemical blend supply apparatus of claim 6 further comprising a controller for controlling the dosing based on the time that the blended slurry or chemical blend is present in said distribution tank.

11. The slurry and/or chemical blend supply apparatus of claim 6 wherein said one or more additional pipes for dosing each have flow controllers therein for controlling an amount of said component dosed into the distribution tank.

12. A slurry and/or chemical blend supply apparatus comprising a bend module and a distribution module, said bend module and said distribution module being in fluid communication, said blend module comprises at least one blend train comprising at least two component pipes, each component pipe for flowing a component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one PUMP, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different; further comprising an analytical module, said analytical module comprising at least one dilution means comprising at least one dilution fixture comprising a tube and a T-shaped pipe connector to introduce slurry or diluted slurry into ultra pure water (UPW) to create a diluted sample prior to analyzing the diluted sample in said analytical module, wherein the analytical module comprises one or more of the group consisting of one or more pH sensors, one or more hydrogen peroxide sensors, one or more density sensors, one or more conductivity sensors, one or more liquid particle counters and one or more particle size distribution analyzers.

13. The slurry and/or chemical blend supply apparatus of claim 12 wherein said at least one dilution means comprises single dilution means, said single dilution means further comprising at least one peristaltic pump, at least one flow sensor and at least one needle valve.

14. The slurry and/or chemical blend supply apparatus of claim 12 wherein said at least one dilution means further comprises more than one flow sensor, more than one needle valve and more than one pneumatically controlled valve to dilute the slurry sample prior to analyzing the diluted sample.

15. A slurry and/or chemical blend supply apparatus comprising a bend module and a distribution module, said bend module and said distribution module being in fluid communication, said blend module comprises at least one blend train comprising at least two component pipes, each component pipe for flowing a component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one pump, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different; further comprising an analytical module comprising one or more of the group consisting of one or more pH sensors, one or more hydrogen peroxide sensors, one or more density sensors, one or more conductivity sensors, one or more liquid particle counters and one or more particle size distribution analyzers, said analytical module in fluid communication with the blend module and the distribution module and analyzes samples from the blend module and the distribution module.

16. A slurry and/or chemical blend supply apparatus comprising a bend module and a distribution module, said bend module and said distribution module being in fluid communication, said blend module comprises at least one blend train comprising at least two component pipes, each component pipe for flowing a component stream therein and comprising at least one flow controller in each component pipe, said component pipes combine to form blended slurry or chemical blend in a single pipe in said blend module; said distribution module comprises at least two distribution tanks and at least two global loops wherein said blend module blends and supplies at least part of said blended slurry or said chemical blend to a first distribution tank of said at least two distribution tanks of said distribution module to supply said blended slurry or said chemical blend to a first global loop of said at least two global loops in fluid communication with the first distribution tank and said blend module blends and supplies at least part of a second chemical blend or a second blended slurry to a second distribution tank of said at least two distribution tanks to supply said second chemical blend or said second blended slurry to a second global loop in fluid communication with the second distribution tank; each of said global loops comprises a connection to an exit opening of each of said distribution tanks, at least one pump, connections to a plurality of tools, and global loop return pipe to each of said distribution tanks; wherein each of said global loops transports said first or second chemical blend or said first or second blended slurry from each of said distribution tanks to said plurality of tools that consumes at least a portion of said chemical blend or blended slurry and returns any unused said chemical blend or said blended slurry to each of said distribution tanks; and further wherein said first and second chemical blends may be the same or different, and said first and second blended slurries may be the same or different; further comprising a feed module comprising a pump for pumping raw slurry from a raw slurry supply container and transporting said raw slurry to said blend module, said blend module makes a blended slurry comprising said raw slurry as one of said component streams in one of said component pipes, said feed module further comprises at least one particle size distribution analyzer or at least one liquid particle counter, and a treatment means, wherein said raw slurry or said blended slurry is directed to the treatment means for the removal of large or small particles from said slurry when said large or small particles are detected by said at least one distribution analyzer or at least one liquid particle counter.

17. The apparatus of claim 16 wherein said feed module comprises said at least one liquid particle counter and/or said at least one particle size distribution analyzer and said said at least one liquid particle counter and/or said at least one particle size distribution analyzer further comprises more than one sample tube in fluid communication with more than one of said feed module, said blend module and said distribution module for analyzing a sample of the slurry from more than one of the feed module, the blend module and the distribution module.

18. The apparatus of claim 17 wherein said treatment means is selected from the group consisting of one or more filter elements or one or more membranes.

19. The slurry and/or chemical blend supply apparatus of claim 16 wherein said feed module comprises a feed tank, and a filter loop in fluid communication with said raw slurry supply container, said filter loop comprising a pump, one or more filters and a pipe loop for filtering the raw slurry in the raw slurry supply container before pumping it to the feed tank.

20. The slurry and/or chemical blend supply apparatus of claim 16 further comprising a strainer component upstream of said flow controller in said component pipe in said blend module for said raw slurry.

21. The slurry and/or chemical blend supply apparatus of claim 1 further comprising an analytical module and a sample tube in fluid communication between the single pipe in the blend module and the analytical module, wherein at least part of the blended slurry or chemical blend from the blend module is directed from the blend module to the analytical module by the sample tube and further wherein the analytical module comprises one or more of the group consisting of one or more pH sensors, one or more hydrogen peroxide sensors, one or more density sensors, one or more conductivity sensors, one or more liquid particle counters and one or more particle size distribution analyzers.

22. The slurry and/or chemical blend supply apparatus of claim 21 further comprising a second sample tube in fluid communication with the first global loop wherein at least part of the blended slurry or chemical blend from the distribution module is directed to the analytical module by the second sample tube.

* * * * *